US008090072B2

(12) United States Patent
Rubbia

(10) Patent No.: US 8,090,072 B2
(45) Date of Patent: Jan. 3, 2012

(54) NEUTRON-DRIVEN ELEMENT TRANSMUTER

(75) Inventor: Carlo Rubbia, Genève (CH)

(73) Assignee: European Organization for Nuclear Research, Geneva (CH)

( * ) Notice: Subject to any disclaimer, the term of this patent is extended or adjusted under 35 U.S.C. 154(b) by 55 days.

(21) Appl. No.: 10/985,323

(22) Filed: Nov. 9, 2004

(65) Prior Publication Data

US 2005/0082469 A1 Apr. 21, 2005

Related U.S. Application Data

(62) Division of application No. 09/446,144, filed on Mar. 2, 2000, now Pat. No. 7,796,720.

(51) Int. Cl.
*G21G 1/06* (2006.01)
*G21G 1/00* (2006.01)
*G21C 1/22* (2006.01)

(52) U.S. Cl. ..... 376/158; 376/156; 376/359; 376/360

(58) Field of Classification Search ..... 376/359, 376/360

See application file for complete search history.

(56) References Cited

U.S. PATENT DOCUMENTS

| | | | | | |
|---|---|---|---|---|---|
| 3,197,375 | A * | 7/1965 | Borst | ..... | 376/171 |
| 3,325,371 | A * | 6/1967 | Stanton | ..... | 376/193 |
| 3,349,001 | A * | 10/1967 | Stanton | ..... | 376/193 |
| 4,123,497 | A * | 10/1978 | Ruddock | ..... | 424/1.61 |
| 4,309,249 | A * | 1/1982 | Steinberg et al. | ..... | 376/192 |
| 4,721,596 | A * | 1/1988 | Marriott et al. | ..... | 376/189 |
| 5,160,696 | A * | 11/1992 | Bowman | ..... | 376/189 |
| 6,442,226 | B1 * | 8/2002 | Venneri et al. | ..... | 376/170 |

OTHER PUBLICATIONS

Glasstone, Principles of Nuclear Reactor Engineering, D. Van Nostrand Co. Inc. 1955.*

A glossary of Terms in Nuclear Science and Technology, 1957.*

Batskikh et al. Accelerator-Based transmuter-breeder and energy producer from transuranic actinides and thorium, Moscos Radiotechnical Institute, Russia Academy of Scienes, Moscos, Russia, 1995 American Institute of Physics, pp. 738-744.*

Mukaiyama et ai, Review of Research and Development of Accelerator-Driven System in Japan for Transmutation of Long Lived Nuclides, Progress in Nuclear Energy, vol. 38, Issues 1-2, 2001, pp. 107-134, Accelerator Transmutation of Waste.

Tsujimoto et al., Accelerator Driven System for Transmutation of High-Level Waste, Progress in Nuclear Energy vol. 37, Issues 1-4, 2000, pp. 339-344, Global Environment and Nuclear Energy Systems-3 Proceedings of the Third International Symposium.

(Continued)

*Primary Examiner* — Mary Cheung
*Assistant Examiner* — Daniel L Greene
(74) *Attorney, Agent, or Firm* — Patzik, Frank & Samotny Ltd.

(57) ABSTRACT

A material is exposed to a neutron flux by distributing it in a neutron-diffusing medium surrounding a neutron source. The diffusing medium is transparent to neutrons and so arranged that neutron scattering substantially enhances the neutron flux to which the material is exposed. Such enhanced neutron exposure may be used to produce useful radio-isotopes, in particular for medical applications, from the transmutation of readily-available isotopes included in the exposed material. It may also be used to efficiently transmute long-lived radioactive wastes, such as those recovered from spent nuclear fuel. The use of heavy elements, such as lead and/or bismuth, as the diffusing medium is particularly of interest, since it results in a slowly decreasing scan through the neutron energy spectrum, thereby permitting very efficient resonant neutron capture in the exposed material.

8 Claims, 21 Drawing Sheets

OTHER PUBLICATIONS

Bi, Li, F, and Be, pp. 505, Handbook of Chemistry and Physics, The Chemical Rubber Publishing Company, 1961.

Bi, Li, F, and Be, Neutron Scattering Lengths and Cross Sections, available @ http://www.ncnr.nist.gov/resources/n-lengths, last accessed Nov. 22, 2005.

* cited by examiner

FIG.3a.
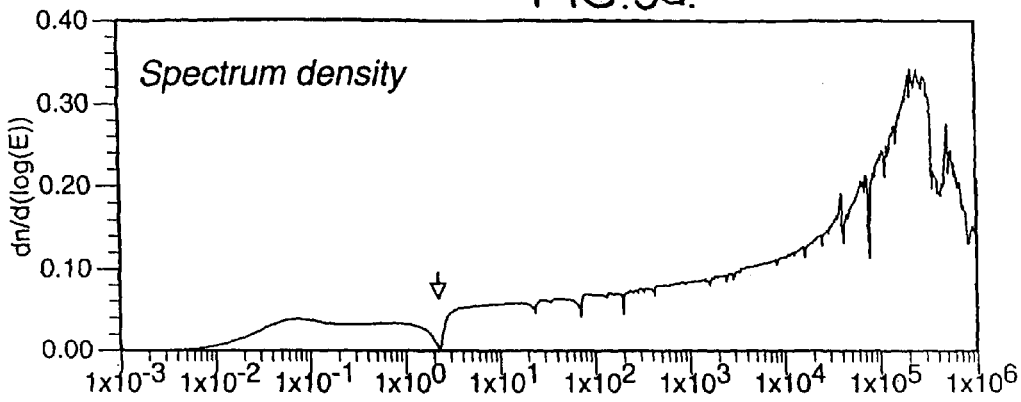
FIG.3b.
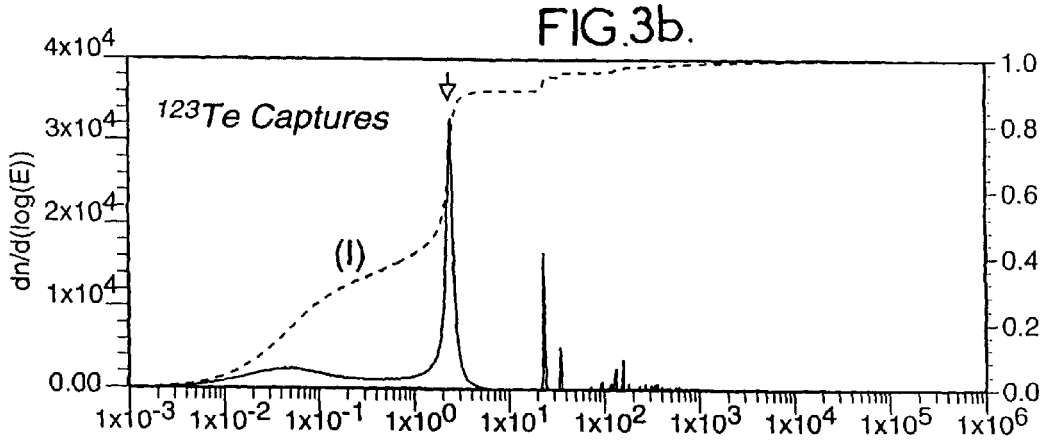
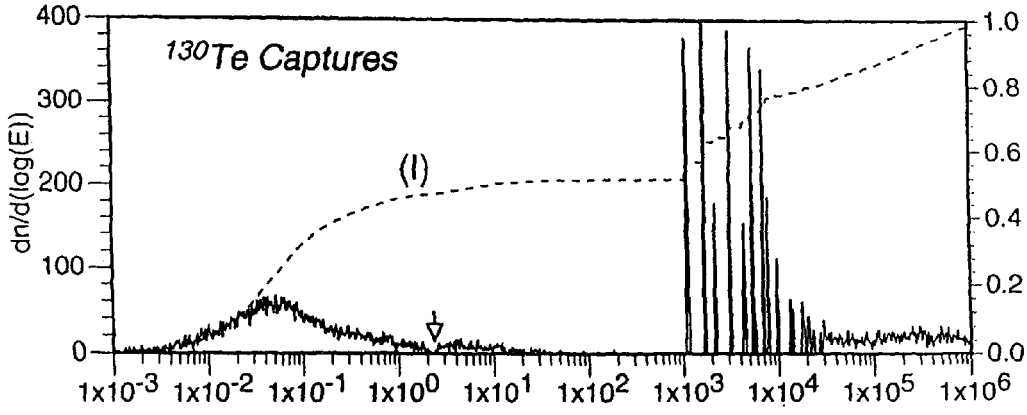
FIG.3c.

FIG.13a.
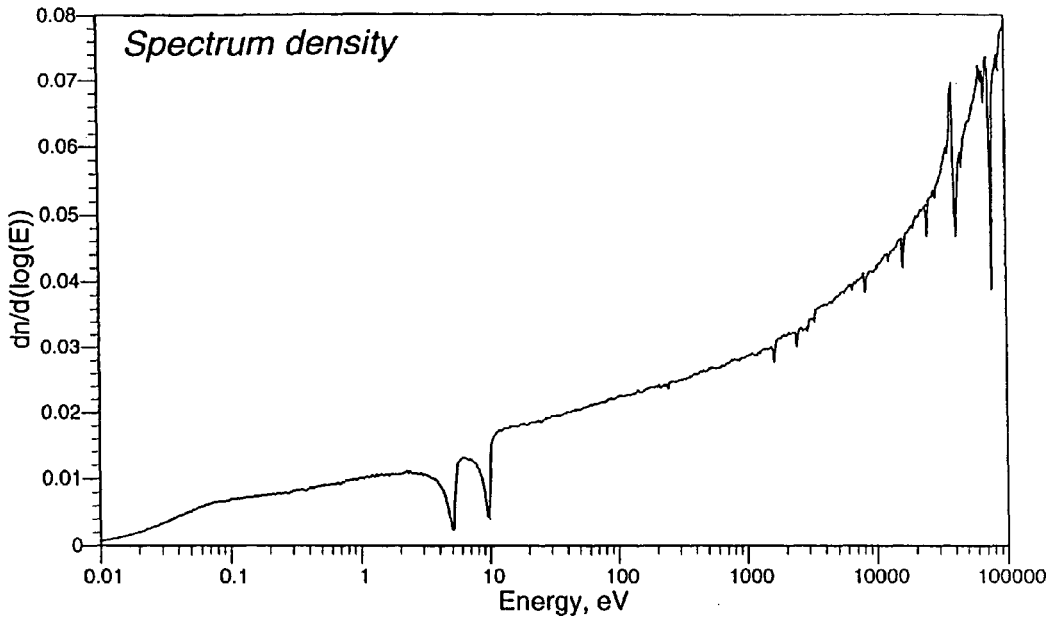
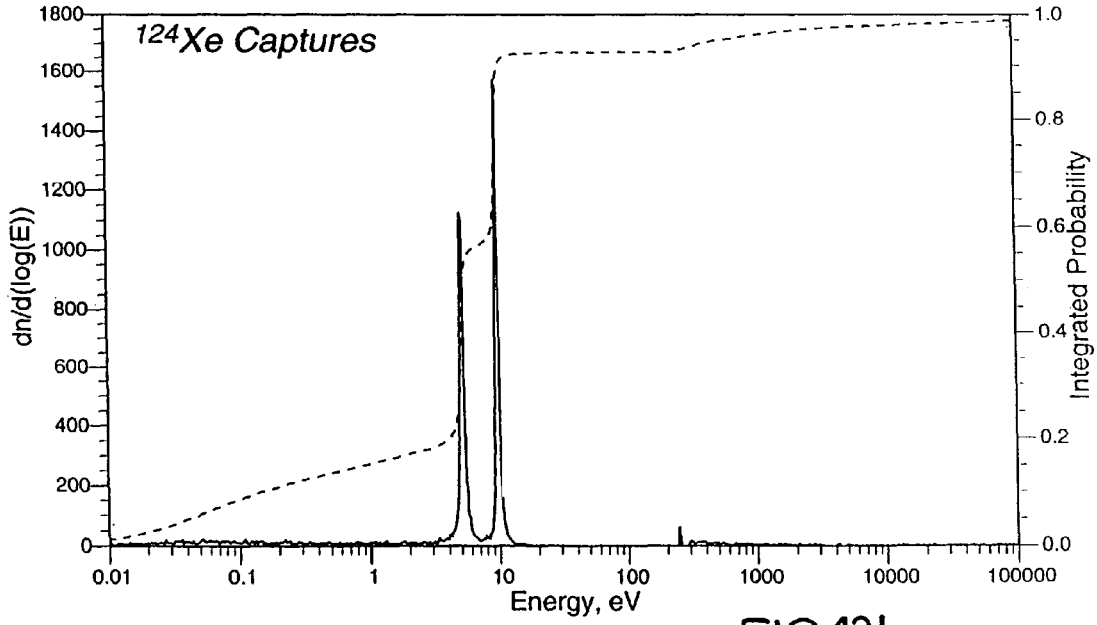
FIG.13b.

NEUTRON-DRIVEN ELEMENT TRANSMUTER

This is a division of application Ser. No. 09/446,144, filed Mar. 2, 2000 now U.S. Pat. No. 7,796,720.

1. SUMMARY OF THE INVENTION

1.1—Method of Transmutation

The present invention proposes a method of element transmutation by efficient neutron capture $E_i(A, Z)+n \rightarrow E_S^*(A+1, Z)$ of an initial "father" isotope, embedded in a diffusing medium which is highly transparent to neutrons and which has the appropriate physical properties as to enhance the occurrence of the capture process. The produced "daughter" nucleus, depending on the application, can either be used directly, or in turn, allowed for instance to beta-decay, $$E_S^*(A+1, Z) \xrightarrow{\beta^- - decay} E_f^*(A+1, Z+1),$$

or more generally, to undergo an adequate: spontaneous nuclear transformation into another radio-active isotope.

Accordingly, the basis of the present transmutation scheme is a method of exposing a material to a neutron flux, wherein said material is distributed in a neutron-diffusing medium surrounding a neutron source, the diffusing medium being substantially transparent to neutrons and so arranged that neutron scattering within the diffusing medium substantially enhances the neutron flux, originating from the source, to which the material is exposed.

The device employed to achieve the efficient neutron capture according to the invention is referred to herein as a "Transmuter". The term "transmutation" is understood herein to generally designate the transformation of a nuclear species into another nuclear species, having the same or a different atomic number Z.

The Transmuter is driven by an internal neutron source, which, depending on the application, can be of a large range of intensities and appropriate energy spectrum. It may be, for instance, a beam from a particle accelerator striking an appropriate neutron generating and/or multiplying target or, if a more modest level of activation is required, even a neutron-emitting radioactive source. The source is surrounded by a diffusing medium in which neutrons propagate, with a geometry and composition specifically designed to enhance the capture process. The material to be exposed to the neutron flux is located in a dispersed form inside the diffusing medium.

The Transmuter presently describe&relies on a vastly increased neutron capture efficiency. Neutron capture efficiency is defined as the capture probability in the sample for one initial neutron and unit mass of father element. It is designated by the symbol $\eta$, typically in units of $g^{-1}$. In the case of a gas, the mass is replaced with the unit volume at normal pressure and temperature conditions (n.p.t., i.e. atmospheric pressure and 21° C.), and the capture efficiency is indicated with $\eta_v$ for which we use typical units of $litre^{-1}$.

According to the invention, the increased neutron capture efficiency is achieved with the help of the nature and of the geometry of the medium surrounding the source, in which a small amount of the element to be transmitted is introduced in a diffused way:

(1) The medium is highly transparent, but highly diffusive. Transparency is meant as the property of a medium in which neutrons undergo mostly elastic scattering. The succession of many, closely occurring elastic scattering events (generally about isotropic) gives a random walk nature to the neutron propagation. The flux is enhanced because of long resulting, tortuous, random, paths that neutrons follow before either being captured or exiting the large volume of the transparent medium. Using an optical analogy, the target-moderator sphere is chosen to be diffusive, but highly transparent to neutrons. Doping it with a small amount of additional material makes it "cloudy". As a consequence, most of the neutrons are captured by the absorbing impurities.

(2) In addition, the large peak values of the capture cross-section of the sample which correspond to the nuclear resonances may be exploited using a diffusing medium having the above feature (1), but of large atomic mass A. In such medium, he neutron energy is slightly reduced at each (elastic) scattering, thus "scanning" in very tiny energy steps through the resonance spectrum of the sample during the smooth, otherwise unperturbed, energy slow-down of the initially high energy (MeV) neutrons of the source.

The choice of the diffusing medium depends on the most appropriate energy at which neutron captures must occur. If neutrons are to be thermalised, i.e. captures have to occur at thermal energies (≈0.025 eV, only the previously mentioned feature (1) is used and a low A (atomic mass number) medium but very transparent to neutrons is to be used, like for instance reactor purity grade graphite or $D_2O$ (deuterated water).

If, instead, neutron capture has to be performed with father elements having large values of capture cross-section in correspondence with resonances, both features (1) and (2) are used and the best elements for the diffusing medium are Lead and Bismuth (or a mixture thereof), which have simultaneously an anomalously small neutron capture cross-section and a very small "lethargy", $\xi=9.54\times10^{-3}$. According to the Shell Nuclear model, built in analogy to atomic electrons, "magic" numbers occur in correspondence of "closed" neutron or proton shells. Atomic number Z=82 is magic, so is the number of neutrons in correspondence of $^{208}Pb$. Magic number elements in the nuclear sense have a behaviour similar to the one of Noble Elements in the atomic scale. Therefore, the neutron transparency is the consequence of a specific nuclear property, similar to the one for electrons in noble gases. Lethargy ($\xi$) is defined as the fractional average energy loss at each neutron elastic collision. While $^{209}Bi$ is a single isotope, natural Lead is made of $^{204}Pb$ (1.4%), $^{206}Pb$ (24.1%), $^{207}Pb$ (22.1%) and $^{208}Pb$ (52.4%), which have 10 quite different cross-sections. Isotopic enrichment of isotope $^{208}Pb$ could be beneficial. However, the use of natural Pb will be more specifically considered herein, for its excellent neutron properties, low activation and its low cost.

1.2—Main Domains of Applications

The domain of applications of the present method of enhancement of neutron captures is very vast.

A first applicative aspect of the invention relates to a method of producing a useful isotope, which comprises transforming a first isotope by exposing a material containing said first isotope to a neutron flux as set forth hereabove, and the further step of recovering said useful isotope from the exposed material.

A second applicative aspect of the invention relates to a method of transmuting at least one long-lived isotope of a radioactive waste, by exposing a material containing said long-lived isotope to a neutron flux as set forth hereabove, wherein at least the portion of the diffusing medium where the exposed material is distributed is made of heavy elements, so that multiple elastic neutron collisions result in a slowly decreasing energy of the neutrons originating from the source.

(1) Activation of (Short-Lived) Isotopes for Industrial and Medical Applications.

In this case, the Transmuter will be denominated as the Activator.

Radio-nuclides are extensively used for medical diagnosis applications and more generally in Industry and Research. As well known, these nuclides are used as "tracing" elements, i.e. they are directly detectable within the patient or material under study because of their spontaneous radioactive decays. In order to minimise the integrated radio-toxicity, the half-life of the chosen tracing isotope should be short, ideally not much longer than the examination time. As a consequence, its utilisation is limited to a period of a few half-lives from activation, since the radioactivity of the isotope is decaying exponentially from the moment of production.

Another application of growing interest for Radio-nuclides is the one of (cancer) Therapy, for which doses significantly larger than in the case of diagnosis are required. Most of these isotopes must have a relatively short half-life, since they are generally injected or implanted in the body of the patient. The main supplies for these isotopes are today from Nuclear Reactors and from particle accelerators in which a suitable target is irradiated with a charged particle beam.

The simplicity of the device proposed and its relatively modest cost and dimensions are intended to promote "local" production of short-lived radio-isotopes, thus eliminating costly, swift transportation and the consequent need of larger initial inventories and thus extending their practical utilisation. This is made possible by the high neutron capture efficiency as the result of the present method, which permits to produce the required amount of the radio-isotope with a relatively modest neutron generator.

The present method of neutron activation is intended to be a competitive alternative to Reactor-driven, neutron capture activation. In addition, several isotopes which are difficult to produce by activation with the (usually thermal) neutrons of an ordinary Reactor, can be produced using the broad energy spectrum of the neutrons in the Activator, extending to high energies and especially designed to make use of the large values of the cross-section in correspondence of resonances. This is the case for instance in the production of $^{99m}$Tc ($^{99}$Mo), widely used in medicine and which is nowadays generally chemically extracted from the Fission Fragments of spent Nuclear Fuel. According to the present method, this popular radio-isotope can be obtained, instead, by direct neutron resonant activation of a Molybdenum target, with the help of a much simpler and less costly Activator driven by small particle Accelerator. Incidentally, the total amount of additional, useless radioactive substances which have to be produced and handled in association with a given amount of this wanted radio-nuclide is also greatly reduced.

(2) Transmutation into Table Species of Offending, Long-Lived Radio-Isotopes, as an Alternatives to Geologic Storage.

In this case, the Transmuter will be denominated as the Waste Transmuter.

Since the totality of the sample should be ideally transmuted, a much stronger neutron source is required. Even for the strongest sources, the highest efficiency of neutron capture is crucial to the complete elimination. The present method of enhanced captures makes practical this technique of elimination.

Ordinary Nuclear Reactors. (Light Water Reactors, LWR) produce a considerable amount of radioactive waste. The radiotoxicity of such waste persists over very long periods of time, and it represents a major drawback of the Nuclear Technology. Fortunately, only a very small fraction of the waste resulting from a Reactor is responsible for the bulk of the long lasting radiotoxicity, and it is easily separable chemically.

In order of importance, the by far largest contribution comes from the Actinides other than Uranium (Transuranic elements, or TRU's), which represent about 1% of the waste by weight. These elements are fissionable under fast neutrons. Therefore, they may be eliminated with considerable extra recovered energy, for instance with the help of an Energy Amplifier (EA) as disclosed in International Patent Publication WO 95/12203(See C. Rubbia, "A High Gain Energy Amplifier Operated with Fast Neutrons", AIP Conference Proceedings 346, International Conference on Accelerator-Driven Transmutation Technologies and Applications, Las Vegas, July 1994). Next in importance for elimination are the Fission Fragments (FF), which are about 4% of the waste mass, and which divide into (1) stable elements (2) short-lived radio-nuclides and (3) long-lived radio-nuclides. The separation between short- and long-lived elements is naturally suggested by the 30 years half-life of $^{90}$Sr and $^{137}$Cs, which are dominating the FF activity at medium times (<500 years) after an initial cool-down of the fuel of a few years.

Finally, there are some activated materials, like the cladding of the fuel, which represent a much smaller problem, and which can be disposed without problems. Whilst the elimination of the TRU's is performed best by burning them in a fast neutron-driven EA, the present method of element transmutation can be used to transform the long-lived FF's into harmless, stable nuclear species (it is assumed that elements with half-life of less than 30 years may be left to decay naturally). The simultaneous elimination of the TRU's and of the long-lived FF's suggests the use of the core of the EA (in which TRU's are burnt) as the neutron source for the Transmuter, dedicated to the long-lived FF's. In this case, the Transmuter will surround the EA, using neutrons escaping from it.

The combination of the EA operated with TRU's and of the Transmuter as long-lived FF's Waste Transmuter is both environmentally very beneficial and economically advantageous, since (1) considerable additional energy is produced by the EA (>40% of the LWR) and (2) the simultaneous elimination of the FF's can be performed "parasitically", with the help of the extra neutrons available. However, as already pointed out, in order to eliminate completely the unwanted FF's with these extra neutrons, a very high neutron capture efficiency is required, as made possible with the present method.

1.3—Illustrative Procedures for an Activator

The method is first elucidated in some of the applications as Activator for medical and industrial applications. The procedures to be followed in order to prepare the radioactive sample are better illustrated by the following practical examples:

(1) A first procedure, suitable for medical examinations (e.g., for thyroid), consists of activating directly inside the Transmuter an already prepared, pharmacological Iodine compound. The element is initially available in the most appropriate chemical compound, such as Sodium, Iodide (NaI), made with natural Iodine (stable isotope $^{127}I$). Shortly before administration, the compound is introduced in the Activator driven by a small proton accelerator (23 MeV and 1 mA) and activated—for instance during a time of the order of one $^{128}I$ half-life (25 minutes=25 m) or correspondingly less for smaller activation strengths—with the help of the reaction $^{127}I+n \rightarrow {}^{128}I+\gamma$, which transforms natural Iodine into the tracing element $^{128}I$ which undergoes $\beta^-$-decay with a prominent $\gamma$-line at 443 keV. There is no chemical "preparation" between activation and examination. This very simple procedure is becoming practical with the present method because of the higher neutron capture efficiency, which produces the required source strength ($\leqq$1 GBq, with 1 GBq=$10^9$ disintegrations/s=27.0 mCie (milli-Curie). 1 Cie=1 Curie=$3.7\times10^{10}$ dis/s), starting from a tiny, initial amount of natural Iodine ($\leqq$1 gram), and using a conventional accelerator of the scale already in wide use within hospitals for other applications such as Positron-Electron-Tomography (PET). The present method makes practical the use of $^{128}I$ as a tracing element for thyroid diagnosis, with a much shorter half-life (25 m) than the one of currently used Iodine isotopes ($^{131}I$ and $^{123}I$), and the corresponding important advantage of a much smaller, dose to patients. The current methods of Iodine examinations are based on $^{131}I$, which has a relatively long half-life of 8 days, and which causes large, intake doses for the patients (roughly in the ratio of half-lives (461/1), and $^{123}I$ which has the shorter half-life of 13.2 hours (31.8 times the one of 128I), but which is of difficult, costly production since it is normally produced by 30 MeV protons and (p,2n) reaction on isotopically-separated $^{124}Te$ (natural abundance 4.79%). In order to use natural Xe, the reaction is (p, 5n) and the energy must be at least 60 MeV. The presently proposed method has therefore both a very simple applicability and leads to much smaller doses to the patient for a given disintegration rate during the examination. It is noted that the larger doses of the current methods generally hamper extensive applicability in the cases of young subjects and of pregnant women.

(2) A second example illustrates the case in which some (simple) chemical transformation is needed between (i) the activation and (ii) the use of the radioactive compound. We visualise this procedure in the case of a $^{99m}Tc$ medical examination, of which many millions are done annually world-wide (see for instance Table 9) In this case, the small sample to be irradiated consists of Molybdenum, for instance in the form of $MoO_3$. The isotopic content of $^{98}Mo$ in natural Molybdenum is 24%. Isotopic enrichment will be convenient, though not mandatory. The appropriate sample of $^{99}Mo$ ($\tau_{1/2}$=65 hours=65 h) is produced with the help of an Accelerator-driven Activator and the capture reaction $^{99}Mo+n \rightarrow {}^{99}Mo+\gamma$.

The activated Molybdenum sample is then handled according to a generally used procedure: transformed, for instance, in the form of an appropriate salt, it is captured in an Alumina absorber. The production of $^{99m}Tc$ proceeds inside the absorber through the subsequent decay reaction $$^{99}Mo \xrightarrow{\beta\text{-decay}} {}^{99m}Tc.$$

The $^{99m}Tc$ (which has a relatively short $\tau_{1/2}$=6.01 h) is extracted in the form of the ion $Tc^{4+}$, for instance by passing through the Mo sample in the Alumina (which remains insoluble) a solution of water with a small amount of NaCl. Since only a very small fraction of the compound is activated at each exposure, the Molybdenum "father" can be recycled, which is of economical importance if the Molybdenum is isotopically enriched, by flushing it from the Alumina absorber and repetitively re-introducing it in the Activator.

(3) Many radio-isotopes used in medicine and in industry are extracted from fragments of Uranium fission. The group of these elements is referred to herein under the generic name of "Fissium". The increased capture efficiency offered by the method works as well in the case of neutron captures leading to fission. Fissium can be produced in the Activator introducing a small target of Uranium, possibly enriched, which, as in the previous examples, is strongly activated by primarily resonance-driven captures. The system is not critical and a small amount of fissile target material is sufficient to obtain relatively large amounts of Fissium. In the case of activation of short-lived elements, the target must be frequently extracted and reprocessed. This is made extremely easy in the geometry and otherwise general conditions of the operation of an Activator, when compared with a nuclear Reactor. The amount of Plutonium produced by the captures in $^{238}U$ is negligibly small and it represents no proliferation concern.

(4) The present method may further be employed in order to dope pure Silicon crystals with Phosphorus, for use in the semiconductor industry. Neutron-driven doping is a very uniform doping which can be performed in the bulk of a large crystal. Natural Silicon is made of three isotopes $^{28}Si$ (92.23%) 29.Si(4.67%). and $^{30}Si$ (3.1%). Neutron captures transform the isotopes into the A+1 Silicon elements. $^{31}Si$ is unstable, ($\tau_{1/2}$=157 m),. and it decays into the stable $^{31}P$, which is the only stable isotope of Phosphorus. This method offers a simple way of doping the inside of relatively large crystals. A reasonable exposure can lead to an implantation of several parts per billion (p.p.b.=$10^{-9}$) of Phosphorus atoms inside a very pure crystal. The exact amount of the implantation can be precisely controlled by the parameters of the exposure.

These cases are examples of the potentialities of the Transmuter operated in the Activator mode. Obviously, a variety of scenarios are possible, depending on the type of radio-isotope and of the specific application.

More generally, and as described in more detail later on, one can achieve capture efficiencies $\eta$ which are of the order of $\eta=1.74\times10^{-6}\ g^{-1}$ of all produced neutrons for Mo activation ($^{99m}Tc$ production), and of the order of $\eta=2.61\times10^{-5}\ g^{-1}$ for activating $^{128}I$ in a pharmaceutical Iodine sample. If neutrons are produced by the source at constant rate $S_0$=dn/dt for the period T, the number of activated daughter nuclei $N_d(T)$ of decay constant $\tau$ (the decay constant $\tau$ is defined as the time for 1/e reduction of the sample. It is related to the half-life $\tau_{1/2}$ of the element by the relation $\tau=\tau_{1/2}/\ln(2)=1.4436\times\tau_{1/2}$) and from a mass $m_0$ of the father element, builds up as:

$$N_d(T) = m_0\eta\frac{dn}{dt}\tau(1-e^{-T/t});\ \frac{d\beta}{dt}(T) = \frac{N_d(T)}{\tau} = m_0\eta\frac{dn}{dt}(1-e^{-T/\tau}) \quad [1]$$

We have indicated with dβ/dt the corresponding decay rate. An equilibrium sets between production and decay of the daughter element for T>>τ, in which decay dβ/dt and neutron capture rates $m_0$ η dn/dt become equal. To produce, for instance, 0.1 GBq (dβ/dt=$10^8$ $sec^{-1}$) of activation in each gram of sample material ($m_0$=1 gram) at equilibrium, the neutron production rates required are then $10^8/(1.738\times10^{-6})=5.75\times10^{13}$ n/sec and $10^8/(2.61\times10^{-5})=3.8\times10^{12}$ n/sec in the above examples for $^{99m}$Tc and $^{128}$I, respectively.

In the case of element activation through Fissium, let us indicate with $\eta_f$ the efficiency for Fissium production (fission), and with λ the atomic fraction of the element in the Fissium. After an exposure time $t_{exp}$, and a reprocessing time $t_{rep}$ of a fissionable mass $m_0$, the activity of the extracted compound is given by:

$$\frac{d\beta}{dt} = e^{-t_{rep}/\tau}(1-e^{-t_{exp}/\tau})\frac{dn}{dt}m_0\lambda\eta_f \quad [2]$$

1.4—Illustrative Procedures for a Waste Transmuter

The method is elucidated in the case of the transmutation of the long-lived FF's of the waste (spent fuel) from a typical Light Water Nuclear Reactor (LWR) Chemical reprocessing of the spent Fuel can separate:

(1) the unburned Uranium (874.49 ton), which can be recycled, provided of sufficient purity;

(2) the TRU's (10.178 ton) which are destined to be incinerated in a Fast Breeder or in an Energy Amplifier (EA) . The actual breakdown of the TRU's, taken after a 15-year cool-down, is as follows: Np, 545.6 kg , Pu, 8761.8 kg.; Am, 852.37 kg ; and Cm, 18.92 kg.

(3) the FF (38.051 ton), which will be further considered, in view of selective transmutation.

Figures within parenthesis refer to standard LWR (≈1 $GWatt_{electric}$) and 40 years of calendar operation. Burn-up conditions and initial Fuel composition refer to the specific case of Spain after 15 years of preliminary cool-down (we express our thanks to the company ENRESA for kindly supplying all relevant information in this respect)

FF's are neutron-rich isotopes, since they are the product of fission. It is a fortunate circumstance that all truly long-lived element in the waste are such that adding another neutron is, in general, sufficient to transform them into unstable elements of much shorter life, ending up quickly into stable elements. If elimination is simultaneously performed both for the TRU's and the selected FF's, the surplus of neutrons produced by fission can be exploited to transmute the latter as well, of course provided that the transmutation method makes an efficient use of the surplus neutron flux.

The simultaneous combination of TRU incineration and of selective FF transmutation is environmentally highly beneficial, since then only those products which are either stable or with acceptable half-life (<30 years) will remain. Contrary to chemical waste, which is generally permanent, natural decay of these elements makes them "degradable". It is noted, for instance, that the elimination time of fluoro-carbons and of $CO_2$ in the atmosphere of the order of several centuries.

In the case of an EA, the proposed method is directly applicable on the site of the Reactor, provided that a suitable (pyro-electric) reprocessing technique is used. Therefore, the combination closes the Nuclear Cycle, producing at the end of a reasonable period only Low Level Waste (LLW) which can be stored on a surface, presumably on the site of the Reactor.

The list of the major long-lived FF's from the discharge of nuclear fuel is given in the first column of Table 1, for a standard LWR (≈1 $GWatt_{electric}$) and 40 years of calendar operation. The initial mass $m_i$ of each isotope and of the other isotopes of the same element are listed, as well as their half-lives $\tau_{1/2}$, expressed in years. Further separation of individual elements obviously requires isotopic separation technologies, which are not considered for the moment. Under irradiation, as will be shown later on, the rate of transmutation is, in a first approximation, proportional to the resonance integral, defined as $I_{res}=\int\sigma_{n,\gamma}(E)dE/E$ and measured in barns (1 barn=1 b=$10^{-24}$ $cm^2$), $\sigma_{n,\gamma}(E)$ being the cross-section of the (n,γ)-capture process for a neutron of energy E. As shown in Table 1, the daughter element (column "next") is normally either stable, hence harmless, or short-lived, quickly decaying into a stable species (column "last") The total activity ζ, in Cie, accumulated after the 40 years of operation is also shown. Since the lifetime of these elements is very long, unless they are transmuted, they must be safely stored without human surveillance.

TABLE 1

Stockpile of the most offending, long-lived FF's produced by a "standard" LWR after 40 years of operation.

| Isot. | Other isot. | $m_i$ (kg) | $\tau_{1/2}$ (y) | $I_{res}$ (b) | next | $\tau_{1/2}$ | last | ζ (Cie) | $\nu_{min}$ ($m^3$) |
|---|---|---|---|---|---|---|---|---|---|
| $^{99}$Tc | | 843 | 2.11E5 | 310. | $^{100}$Tc | 15.0 s | $^{100}$Ru | 14455. | 48181. |
| | All: | 843 | | | | | | | |
| $^{129}$I | | 196.02 | 1.57E7 | 26.5 | $^{130}$I | 12.36 h | $^{130}$Xe | 34.7 | 4327. |
| | $^{127}$I | 59.4 | stable | 149. | $^{128}$I | 25.0 m | $^{128}$Xe | | |
| | All: | 255.42 | | | | | | | |
| $^{93}$Zr | | 810.4 | 1.53E6 | 15.2 | $^{94}$Zr | stable | $^{94}$Zr | 2040.1 | 583. |
| | $^{90}$Zr | 257.8 | stable | 0.17 | $^{91}$Zr | stable | $^{91}$Zr | | |
| | $^{91}$Zr | 670.4 | stable | 6.8 | $^{92}$Zr | stable | $^{92}$Zr | | |
| | $^{92}$Zr | 724.6 | stable | 0.68 | $^{93}$Zr | 1.53E6 y | $^{94}$Zr | | |
| | $^{94}$Zr | 838.4 | stable | 15.4 | $^{95}$Zr | 64.02 d | $^{95}$Mo | | |
| | $^{96}$Zr | 896.8 | stable | 5.8 | $^{97}$Zr | 16.9 h | $^{97}$Mo | | |
| | All: | 4198.4 | | | | | | | |
| $^{135}$Cs | | 442.2 | 2.30E6 | 60.2 | $^{136}$Cs | 13.16 d | $^{136}$Ba | 510.1 | 510. |
| | $^{133}$Cs | 1228.4 | stable | 393. | $^{134}$Cs | 2.06 y | $^{134}$Ba | | |

TABLE 1-continued

Stockpile of the most offending, long-lived FF's produced by a "standard" LWR after 40 years of operation.

| Isot. | Other isot. | $m_i$ (kg) | $\tau_{1/2}$ (y) | $I_{res}$ (b) | next | $\tau_{1/2}$ | last | $\zeta$ (Cie) | $\nu_{min}$ ($m^3$) |
|---|---|---|---|---|---|---|---|---|---|
| | $^{137}Cs$ | 832.2 | 30.1 | 0.616 | $^{138}Cs$ | 32.2 m | $^{138}Ba$ | | |
| | All: | 2502.8 | | | | | | | |
| $^{126}Sn$ | | 29.48 | 1.0E5 | 0.139 | $^{127}Sn$ | 2.10 h | $^{127}I$ | 838.1 | 239. |
| | $^{116}Sn$ | 7.79 | stable | 12.4 | $^{117}Sn$ | stable | $^{117}Sn$ | | |
| | $^{117}Sn$ | 8.67 | stable | 17.8 | $^{118}Sn$ | stable | $^{118}Sn$ | | |
| | $^{118}Sn$ | 8.812 | stable | 5.32 | $^{119}Sn$ | stable | $^{119}Sn$ | | |
| | $^{119}Sn$ | 8.77 | stable | 5.14 | $^{120}Sn$ | stable | $^{120}Sn$ | | |
| | $^{120}Sn$ | 8.94 | stable | 1.21 | $^{121}Sn$ | stable | $^{121}Sn$ | | |
| | $^{122}Sn$ | 9.84 | stable | 0.916 | $^{123}Sn$ | 129.2 d | $^{123}Sb$ | | |
| | $^{124}Sn$ | 13.40 | stable | 7.84 | $^{125}Sn$ | 9.64 d | $^{125}Te$ | | |
| | All: | 95.70 | | | | | | | |
| $^{79}Se$ | | 6.57 | 6.5E4 | 56. | $^{80}Se$ | stable | $^{80}Se$ | 458.6 | 131. |
| | $^{77}Se$ | 1.15 | stable | 28.1 | $^{78}Se$ | stable | $^{78}Se$ | | |
| | $^{78}Se$ | 2.73 | stable | 4.7 | $^{79}Se$ | 6.5E4 y | $^{80}Se$ | | |
| | $^{80}Se$ | 15.02 | stable | 0.928 | $^{81}Se$ | 18.4 m | $^{81}Br$ | | |
| | $^{82}Se$ | 37.86 | stable | 0.795 | $^{83}Se$ | 22.3 m | $^{83}Kr$ | | |
| | All: | 63.33 | | | | | | | |

As a measure of the magnitude of the storage problem, we have indicated the minimum diluting volume $V_{min}$, in $m^3$, required by the US Regulations (U.S. Nuclear Regulatory Commission, "Licensing Requirements for Land Disposal of Radioactive Wastes", Code of Federal Regulations, 10 CFR Part 61.55, May 19, 1989) for Low Level Waste and surface or shallow depth permanent storage, Class A (which means without active surveillance and intrusion protection). We review each element of Table 1 in order of decreasing storage volume:

(1) Technetium ($^{99}Tc$, 843 kg, $535\times10^3$ GBq/reactor) is the most offending FF element, as evidenced by the large value of the storage volume, 48181 $m^3$/reactor. Technetium is also soluble in water as $Tc^{4+}$, and during its long half-life ($2.11\times10^5$ years) it will presumably drift out of the Repository into the environment, and hence into the biological cycle (see "Nuclear Wastes, Technologies for Separation and Transmutation", National Academy Press 1996). It is known that plants (algae; dataon Fucus Vescicolosous indicate a ratio of accumulation with respect to the surrounding water between 21000 and 89000—see F. Patti et al. ,"Activités du Technétium 99 mesurées dans les eaux résiduaires, l'eau de mer (Littoral de la Manche, 1983), in "Technetium and the Environment" edited by G. Desmet et al, Elsevier Publishers, 1984, p. 37—and of the order of 14000 and 50000. in the points more distant; in the Greenland waters, this ratio is from 250 to 2500), fresh water and marine organisms (in the Greenland water, the ratio with respect to surrounding waters is from 1000 to 1400 for lobsters, and from. 100 to 2.00 for red abalone) accumulate the element out of the surrounding waters, so that it may end up in the humans through food. Organic matter becomes a Geochemical sink for $^{99}Tc$ in soils and sediments.

The physiological effects of Technetium have been poorly studied (see K. E. Sheer et al, Nucl. Medicine, Vol. 3(214), 1962, and references therein). When Technetium is injected, it reaches almost all tissues of the organism, and it is retained by the stomach, blood, saliva and in particular by the thyroid gland (12 to 24%) (see K. V. Kotegov, Thesis, Leningrad LTI, 1965). Concentration of Technetium with a long life in the organism is very dangerous, since it may lead to lesions of the tissues by β-radiation. Its release in the Oceans is an irreversible process on the human time scale, and its long-term effects are largely unknown. The diffusion of $^{99}Tc$ in the sea water is evidenced by the discharges arising from the reprocessing plants of nuclear fuel, which amount to date to about $10^6$ GBq (the quantity due to nuclear weapon testing is about 10 to 15% of this value). Substantial amounts of animal and vegetal contamination, which are particularly strong in the immediate vicinity of the, reprocessing plants of Sellafield and La Hague (see E. Holm et al. "Technetium-99 in Algae from Temperate and Arctic Waters in the North Atlantic", in "Technetium and the Environment" edited by G. Desmet et al, Elsevier Publishers, 1984, p.52), have been discovered all the way to Greenland (see A. AArkrog et al. "Time trend of $^{99}Tc$ in Seaweed from Greenland Waters", in "Technetium and the Environment" edited by G. Desmet et al, Elsevier Publishers, 1984, p.52) (the transfer time from Sellafield to Greenland has been measured to be 7 years). Fortunately, Technetium is a pure isotope with a large resonant cross-section, leading to the stable $^{100}Ru$. Therefore, its elimination is the easiest, and for the above-mentioned reasons, it should be transmuted with the highest priority.

(2) Iodine activation is small ($^{129}I$, 196.2 kg, $1.28\times10^3$ GBq/reactor), only $2.40\times10^{-3}$ the one of Technetium, but Iodine is also soluble in water and, presumably (see "Nuclear Wastes, Technologies for Separation and Transmutation", National Academy Press 1996), will drift out of the Repository into the biological cycle. This is why, in spite of the small activity, Iodine requires, according to US regulations, a large diluting volume, i.e. 4327 $m^3$/reactor. Studies on $^{131}I$, which of course are also applicable for $^{129}I$, show for instance that the transfer to goat's milk from blood is for Iodine 100 times larger than for Technetium. The transfer from contaminated pasture to milk is 5600 times larger than for Technetium. Therefore, it is of importance that also Iodine be transmuted. Iodine is produced by the LWR as a two-isotope mixture, with 76.7% of $^{129}I$, the rest being stable $^{127}I$. The stable Iodine isotope transforms under neutron capture into $^{128}I$, which decays with a half life of 24.99 m to $^{128}Xe$ (Xenon gas can be easily periodically purged from the device) which is stable (93.1%), and to $^{129}Te$ (6.9%) which is decaying into $^{129}I$, adding slightly to the initial sample. Therefore, transmutation can be performed with Iodine chemically separated from the FFF's, though with a number of neutroncaptures slightly larger (+23%) than in the case of an isotopically pure $^{129}$I sample.

(3) Zirconium has large produced (chemical) mass (4.2 ton), with about $75.48\times10^3$ GBq/reactor of $^{93}$Zr (19.3% by weight). The Class A storage volume is small: 583 $m^3$, about 1.2% of the one of $^{99}$Tc. In addition, being a metal, it can be diluted for instance in Lead or Copper, and be kept out of the biological cycle essentially indefinitely. Notwithstanding, it would be possible to transmute it, but in practice only with prior isotopic separation. Since the other Zr isotopes are stable and the specific activity of $^{93}$Zr is small (0.00251 Cie/g), isotopic separation is costly but not difficult. In view of the small environmental impact of Zr, the necessity to transmute the element is questionable.

(4) Cesium ($^{135}$Cs, 442 kg, $18.87\times10^3$ GBq/reactor), is a rather delicate case, since it is mixed with $^{137}$Cs with a high specific activity (87 Cie/g) and which is one of the most intense components of the FF's activity at short times. Straight transmutation of the chemical isotopic mixture is possible, but it will not affect appreciably the $^{137}$Cs, which has a very small capture integral ($I_{res}$=0.616 b). But both the stable $^{133}$Cs (49% by weight) and the unwanted $^{135}$Cs (17.7%) have to be transmuted, with a correspondingly greater neutron expense, 2.78 times larger than if a prior isotopic separation is introduced in order to extract a pure $^{135}$Cs. The simultaneous transmutation of both isotopes, with large Ires is technically feasible, since they lead to short-lived elements which end up in a short time to stable Barium isotopes. However, handling large amounts of strongly active material (29 Cie/g for the chemical element) for the incineration procedure is not without problems and it should be discouraged. On the other hand, the Class A dilution volume is small, 510 $m^3$, but some concern has been expressed about the possibility that leaks may occur from the repository to the environment during the long life of the isotope. If those concerns were to be confirmed, transmutation of Cesium will become necessary. It could be performed in a few hundred years from now, when the $^{137}$Cs has sufficiently decayed and if deemed necessary at this point.

(5) Tin ($^{126}$Sn, 29.5 kg, $31.01\times10^3$ GBq/reactor) is a low-activity metal, for which a small volume, 239 $m^3$, class A storage is required. The resonance integral, $I_{res}$=0.139 b, is too small for a realistic transmutation rate. Hence, our method is not immediately applicable to this element. Fortunately, the nature of the element is such that it ensures good containment in an appropriate metallic matrix, and therefore it appears entirely safe to keep it as Class A indefinite storage.

(6) Selenium ($^{79}$Se, 6.57 kg, $16.97\times10^3$ GBq/reactor) is also a low-activity material, for which a small volume, 131 $m^3$, class A storage is required. The dominant $I_{res}$=56 b is the one of the element to be transmuted, the other isotopes being either of small concentration or of smaller $I_{res}$. Incineration could proceed with the chemical mixture, also taking into account the small size of the stockpile, 63.3 kg after 40 years of operation. Isotopic separation is also possible, since the specific activity of $^{79}$Se is 0.07 Cie/gr. Little is known on Selenium diffusion in the environment, though it may be significant, since it is similar to Sulfur. In case of doubt, transmutation is perfectly feasible.

For these reasons it would seem appropriate to give high priority to the transmutation of $^{99}$Tc and $^{129}$I. The residual Class A definitive storage volume is thus reduced from 53971 m3 to 1463 $m^3$, namely by a factor 37. Transmutation of $^{79}$Se may also be advisable, especially in view of the small quantities. Transmutation is not possible with $^{126}$Sn; for $^{135}$Cs, if needed at all, it must be delayed by several centuries in order to wait for the $^{137}$Cs to decay, unless an arduous, isotopic separation is performed.

1.5—The Neutron Source

The characteristics of the source are evidently application-dependent. We concentrate first on the requirements of the Activator mode of operation of the Transmuter. The requirements of the Transmuter operated to decontaminate waste will be considered next.

The Activator for medical and industrial purposes demands relatively small neutron intensities, though the required activity of the newly created radio-nuclide and the corresponding size of the initial sample to be activated depend strongly on the specific application and on the subsequent procedures of extraction and use. Many different types of compact neutron sources of adequate strength are commercially available, and may be relevant in various Activation applications with the present method. We list amongst them, in increasing function of the neutron intensity (1) Radioactive sources, like for instance Am—Be and similar, which produce currently about $2.1\times10^8$ neutrons for 100 Cie of α-source, or Actinide sources like $^{252}$Cf which have spontaneous fission probability and produce about $3.0\times10^9$ n/Cie. Though the neutron intensity generated with sources is more modest than the one achievable with Accelerators, the device is completely passive and offers much greater simplicity and consequently lower cost.

(2) High voltage sets based on D-T or D-D reactions, which produce up to $10^{10}$ n/sec for 100 μA of accelerated current to some 300 keV. .

(3) Small accelerators (Cyclotrons, RF-Q, LINAC's) with ultimate current capability of several mA, which produce typically $\geqq10^{13}$ n/sec with the help of accelerated currents of the order of 100 μA at several MeV, and which are already widely used in hospitals for isotope production, for instance for PET applications.

(4) Spallation sources from high energy proton beams hitting a Lead or Bismuth target block. As shown later on, the Activator target for large beam power has to be liquid to ensure appropriate cooling of the beam-dissipated power which, in the example, is of the order of several hundred kWatt. High energy protons are extremely prolific neutron sources. For a possible application of the Activator on a large industrial scale and as a dedicated machine, one might consider a 100-200 MeV LINAC or compact Cyclotron and an average current of a few mA. Neutron production rates well in excess of $S_0=10^{16}$ n/sec can be easily obtained with such arrangement. The corresponding neutron flux in which the activation sample is normally located, is of the order of $10^{14}$ n/cm$^2$/sec, quite comparable with the flux of the largest Power Reactors. Taking into account the fact that the capture process is-further enhanced by resonance crossing, it is evident that the present method becomes largely competitive with Reactor-driven activation. This is in particular valid for 99Mo ($^{99m}$Tc), which is plagued by a very small capture cross-section of 140 mb for thermal (reactor) neutrons, but with a large resonance cross-section, and for which a much more complicated extraction from the $^{235}$U-fission fragments obtained from spent reactor fuel is currently used.

(5) Leakage neutrons from the core of a critical (Reactor) or Sub-critical (Energy Amplifier) device. Since these devices produce vast amounts of power (GigaWatts), the residual neutron flux is very large. Because these neutrons are anyway lost from the Core, the Transmuter can be run "parasitically". The neutron energy spectrum must however be matched to the application. If, as most likely, resonance-driven captures are exploited in a Lead diffusing environment, the core must produce fast neutrons, with energies which are well above the resonances to be exploited.

The neutron source for a Waste Transmuter must be much stronger, since, as already mentioned, the sample must undergo a complete transformation. Neutrons may be directly produced by a Spallation source of the type (4) above or, even better, by a "leakage" source of type (5). In addition, neutrons must be efficiently captured by the elements to be transmuted. The minimal amount of captured neutrons required in ideal conditions is listed in Table 2, where neutron units are kilograms (1 kg of neutrons corresponds to $5.97\times10^{26}$ neutrons) and elements are the ones listed in Table 1. In reality, an even larger number is required since the capture and subsequent transmutation probability $\alpha_t$ is less than unity. The proposed scenario in which only $^{99}$Tc, 129I and $^{79}$Se are transmuted requires, according to Table 2, an ultimate $11.29/\alpha_t$ kg of neutrons dedicated to transmutation.

TABLE 2

Minimal neutron requirements for full transmutation of most offending, long-lived FF's of the full discharge (40 years) of a standard LWR.

| | Isotopic mass | | Chemical Mass | | Neutrons (kg) for full transmutation | |
|---|---|---|---|---|---|---|
| Element | kg | % all FF | kg | % all FF | Isotopic | Chemical |
| $^{99}$Tc | 843. | 2.215 | 843 | 2.215 | 8.51 | 8.51 |
| $^{129}$I | 196.2 | 0.515 | 255.42 | 0.671 | 1.52 | 1.98 |
| $^{93}$Zr | 810.4 | 2.129 | 4198.4 | 11.03 | 8.71 | 45.14 |
| $^{135}$Cs | 442.2 | 1.162 | 2502.8 | 6.577 | 3.27 | — |
| $^{126}$Sn | 29.48 | 0.077 | 95.70 | 0.251 | — | — |
| $^{79}$Se | 6.57 | 0.017 | 63.33 | 0.166 | 0.0832 | 0.802 |

In the case of a source of type (4) above, one needs generally a higher energy and higher current proton beam. For proton kinetic energies of the order of or larger than 1 GeV and a Lead Spallation Target, the neutron yield corresponds to 40 MeV/neutron, i.e. $6.4'10^{-12}$ Joule/n. One kg of neutrons will then require $1.061\times10^{9}$ kWh, or 3.029 MWatt of average beam power during the illustrative 40 years of operation. Assuming an acceleration efficiency of 0.5, this corresponds to 6.05 MWatt of actual electric power. The ultimate 11.29 kg of neutrons will therefore require 68.40 MWatt of electric power for the whole duration of the LWR operation, corresponding to 6.8% of the electricity produced by the plant. Including capture efficiency etc., the fraction of electric power produced by the LWR needed to produce an equivalent transmutation of the selected long-lived FF's is of the order of 10% of the produced power. Evidently, off-peak energy production could be used.

This installed power and the associated large scale Accelerator represents a considerable investment and running costs. It would be more profitable to make direct use of fission-driven neutron multiplication intrinsic in the necessary parallel elimination of the TRU's (which has the additional advantage of being eso-energetic) i.e. choosing a source of the type (5) above. The simultaneous, complete incineration of the TRU's (10.178 ton) will produce a number of neutrons of the order of $106.02\times\alpha_f$ kg, where $\alpha_f$ is the fraction of neutrons generated per fission (in these indicative considerations, we have assumed that the average neutron multiplicity/fission is 2.5) which is made available to transmutation of FF's. We conclude that, in order to proceed concurrently with the TRU (the complete fission of the TRU's will produce an additional amount, of FF's (10.178 ton), which will have to be transmuted as well, in addition to the 38.051 ton of FF's from the waste of the LWR's ; this will be discussed in more detail later on) and FF elimination, $\alpha_t\times\alpha_f=0.106$, implying a very efficient utilisation of surplus neutrons from the TRU's incineration process. It will be shown, however, that, it can be attained thanks to the present method.

1.6.—Conclusions

With the help of the method here described, high rate of neutron captures can be achieved with relatively modest neutron fluxes. As a consequence, a practical, neutron-driven Activator can be achieved with simple and relatively cheap, small Accelerators which do not require large installations, like for instance is the case for Nuclear Reactors. The environmental impact and safety are far easier, since the Activator is not critical and it produces little extra activity apart from the one in the sample. The activation of the Lead block is limited mainly to the $^{209}$Pb isotope, which decays with a half-life of 3.2 hours into the stable $^{209}$Bi. Activation of the Graphite and of the Steel structures are also equally modest. The large Lead block constitutes a natural shielding to this activity, mostly concentrated in the centre of the Activator. All activated materials at the end of the Life of the installation qualify for direct LLW-Class A for surface storage, which is not the case for the Nuclear Reactor spent fuel. Licensing and operation of a low energy accelerator are infinitely easier than in the case of a Reactor.

In view of these considerations, of the growing need for radio-isotopes for medical and industrial applications and of the comparable efficiency of activation, the accelerator-driven neutron Activator based on the proposed flux enhancement method constitutes a valid alternative to the current radio-isotope production processes. Considering the variety of short-lived isotopes needed, for instance, for medical applications (see Tables 7, 8 and 9), a general-purpose accelerator can simultaneously produce those radio-isotopes for which charged particle activation is best suited and also those isotopes for which neutron capture is most convenient by means of an Activator as disclosed herein, thereby eliminating the need to rely on Nuclear Reactors in a general-purpose (local or regional) facility. This can be realised with relatively modest means and smaller environmental impact.

In the case of a Waste Transmuter, more powerful neutron sources are needed for the complete transmutation into stable elements of unwanted, long-lived radioactive waste. This can be achieved in principle with larger Accelerators and Spallation sources. In the case of the spent fuel from LWR's, since these elements have in general to be eliminated concurrently with the fissionable TRU waste, one can use the extra neutrons produced by their fission as a source for the Waste Transmuter, adding the Waste Transmuter to a fast Energy Amplifier or a Fast Reactor dedicated to the burning of the TRU's. The high efficiency of the present method ensures that both unwanted stockpiles can be effectively and simultaneously eliminated in the process.

1.7.—BRIEF DESCRIPTION OF THE DRAWINGS

FIGS. 3*a-c* illustrate the captures in metallic Tellurium. FIG. 3*a* shows the energy spectrum in the Activator; FIG. 3*b* shows the differential spectrum and the integrated probability for the leading element $^{123}$Te ; FIG. 3*c* is similar to FIG. 3*b*, but for $^{130}$Te.

Figure 4:
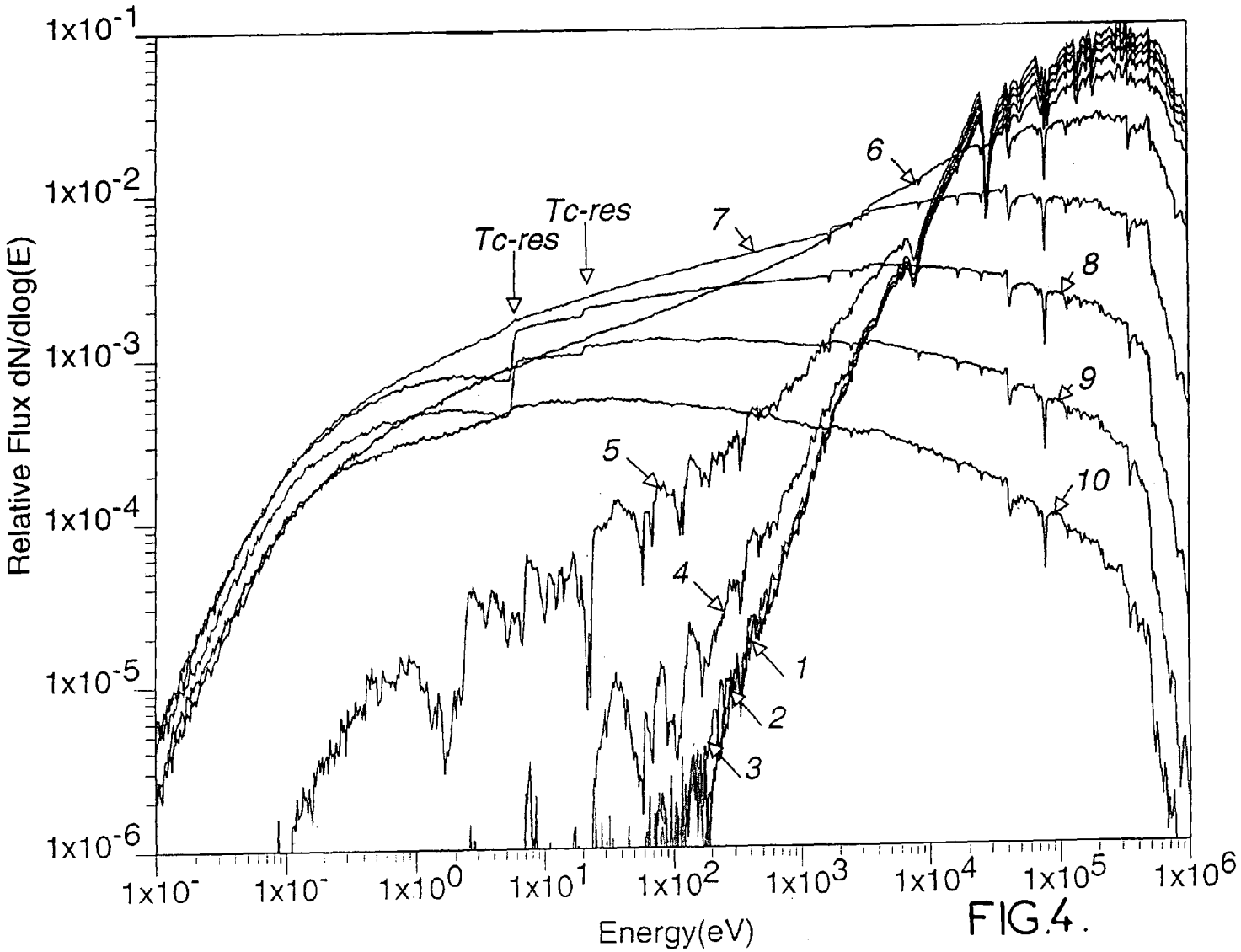

FIG. 4 is a graph showing the neutron spectrum plotted at various distances above the core of a Waste Transmuter for a small cylindrical volume coaxial to the core centre and about 1 metre from the axis.

Figure 5:
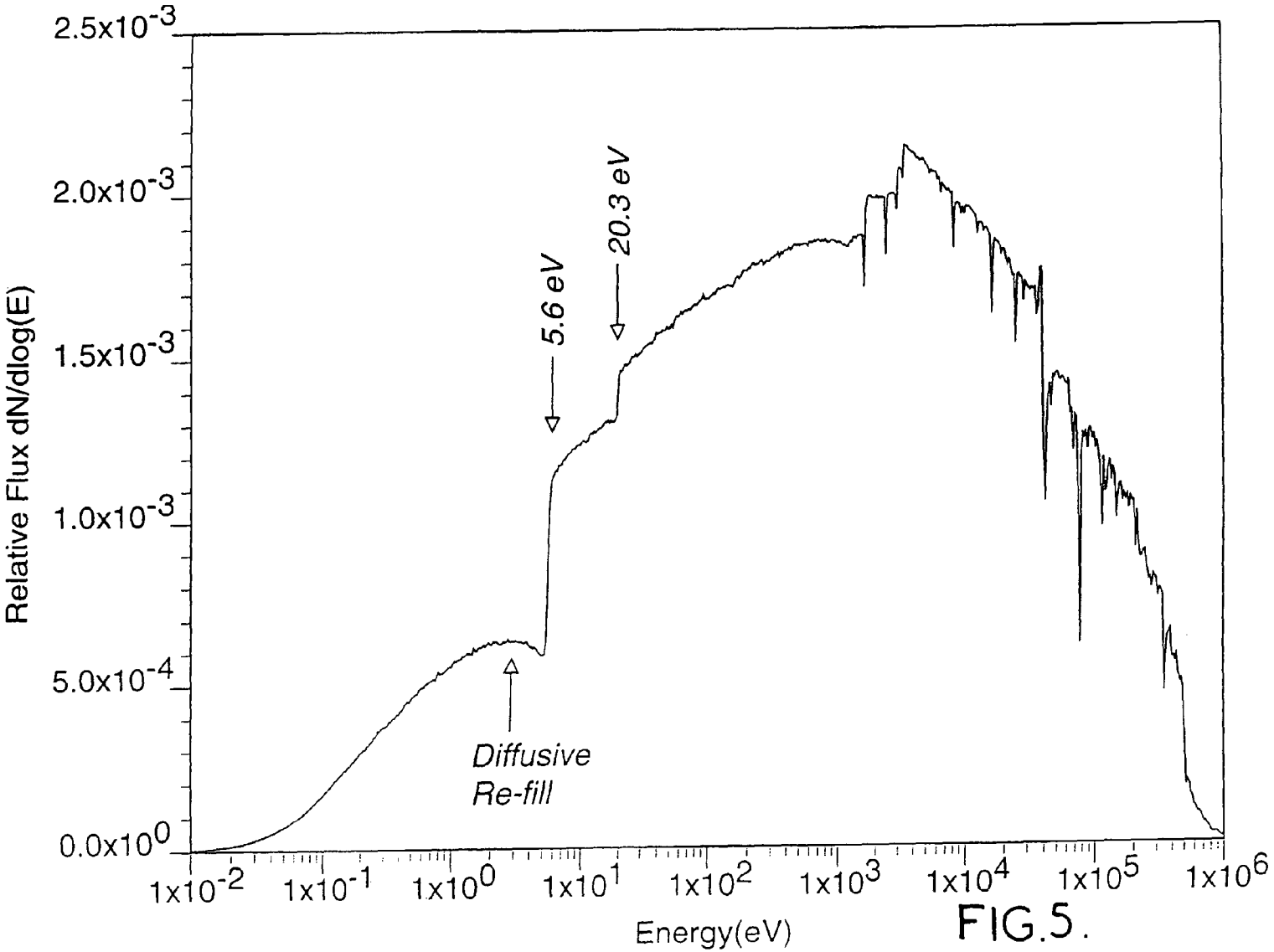

FIG. 5 shows the spectrum of segment 8 of FIG. 4, but plotted in linear scale.

Figure 6:
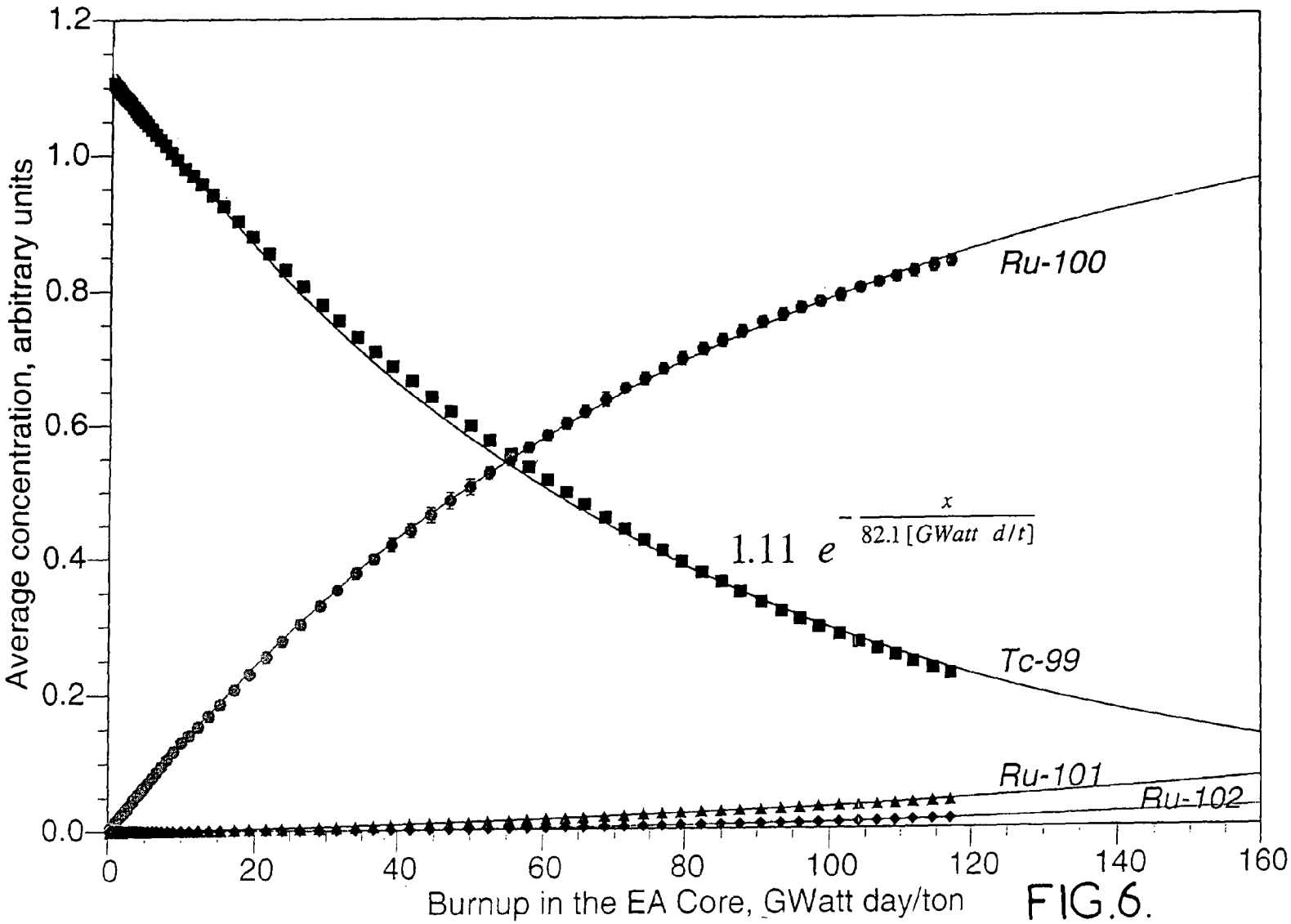

FIG. 6 is a graph showing the concentration of relevant elements as a function of the burn-up in segment 8 of FIG. 4.

Figure 7A:
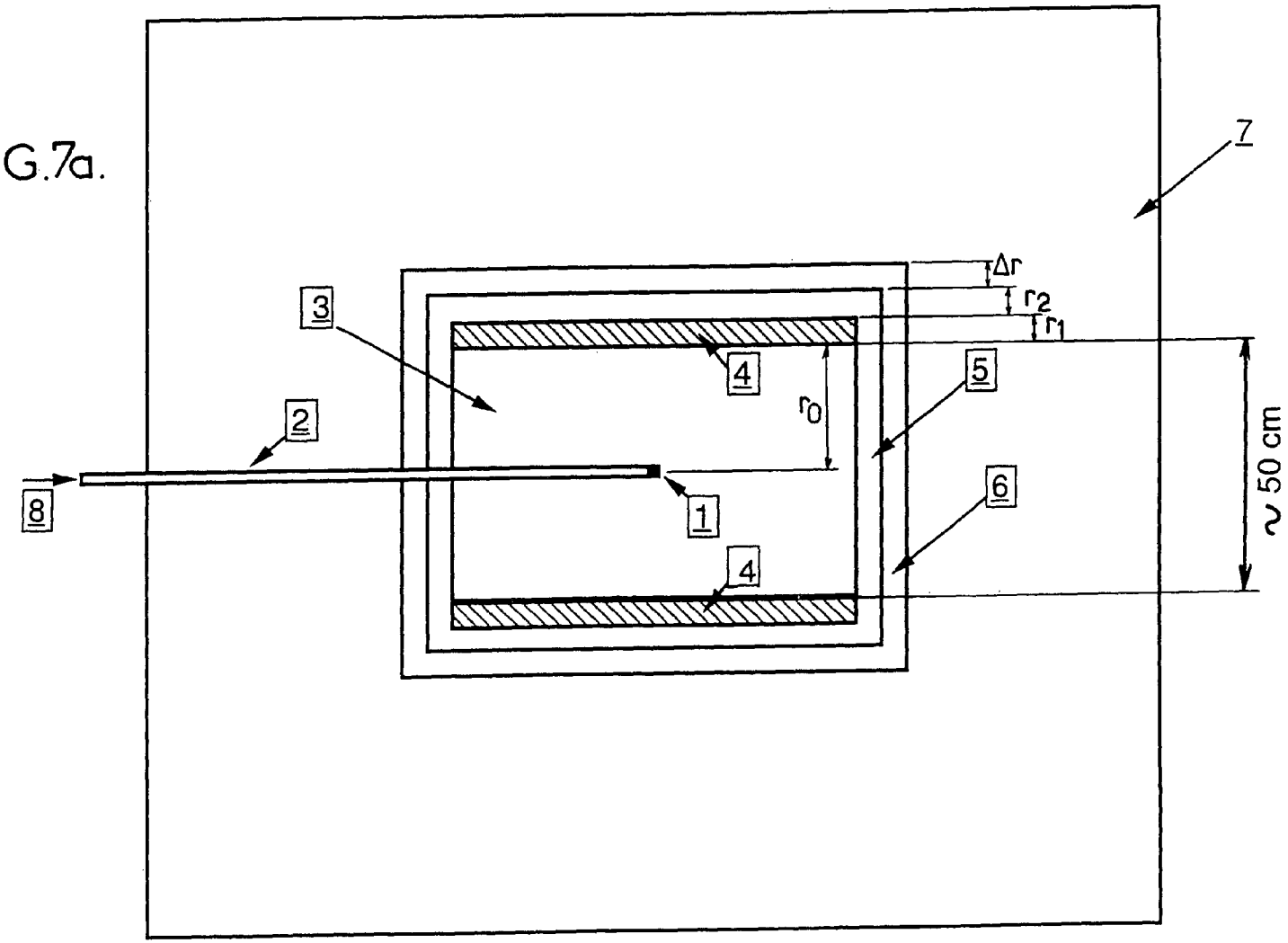

FIG. 7*a* is a general diagram of the Activator for a small target and low energy beam or radioactive target.

Figure 7B:
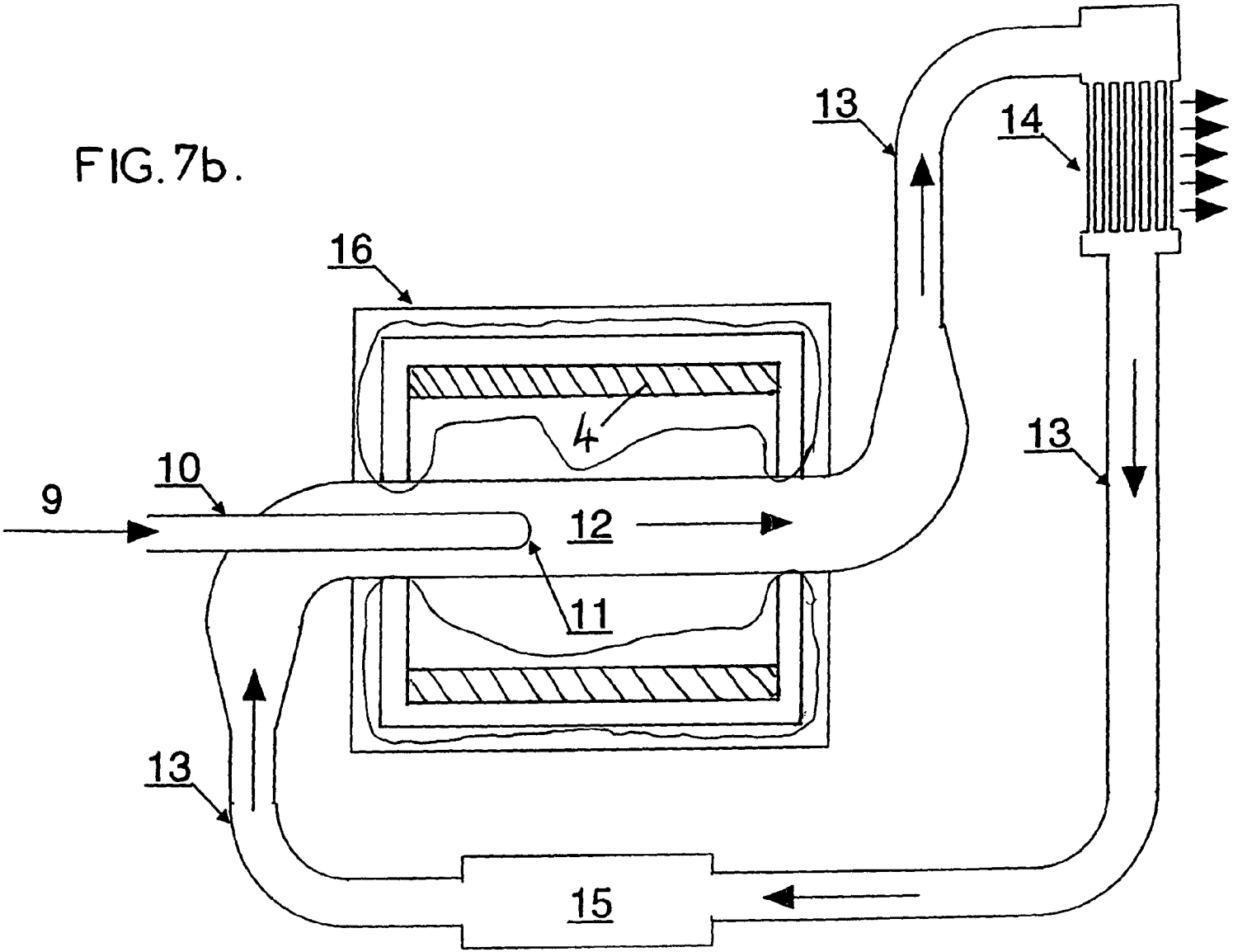

FIG. 7*b* is a general diagram of the Activator for a high energy beam and spallation neutrons.

Figure 8:
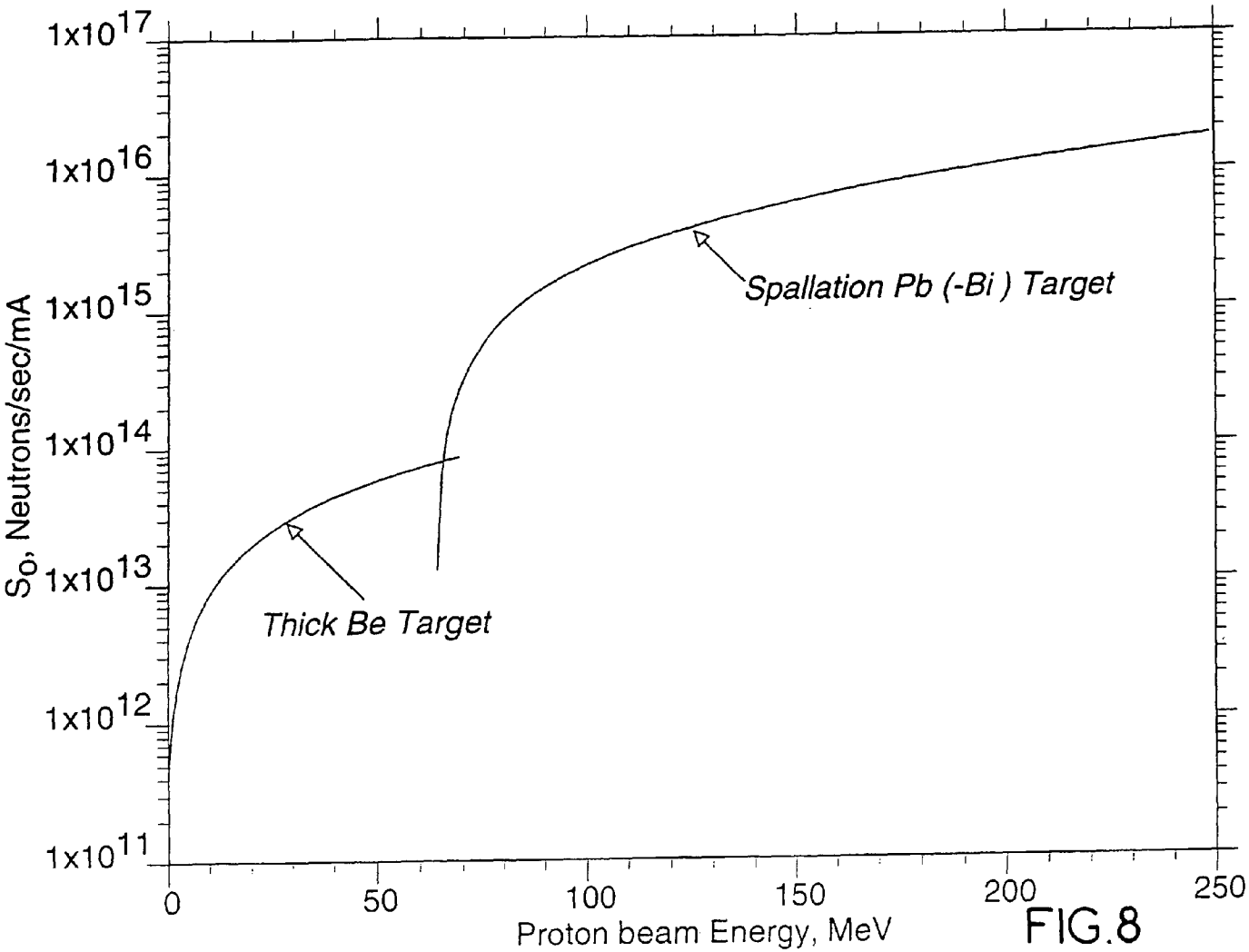

FIG. 8 is a graph showing the neutron yield, $S_0$, of a beam-driven source for 1 mA proton current, as a function of the kinetic energy of the proton beam.

Figure 9:
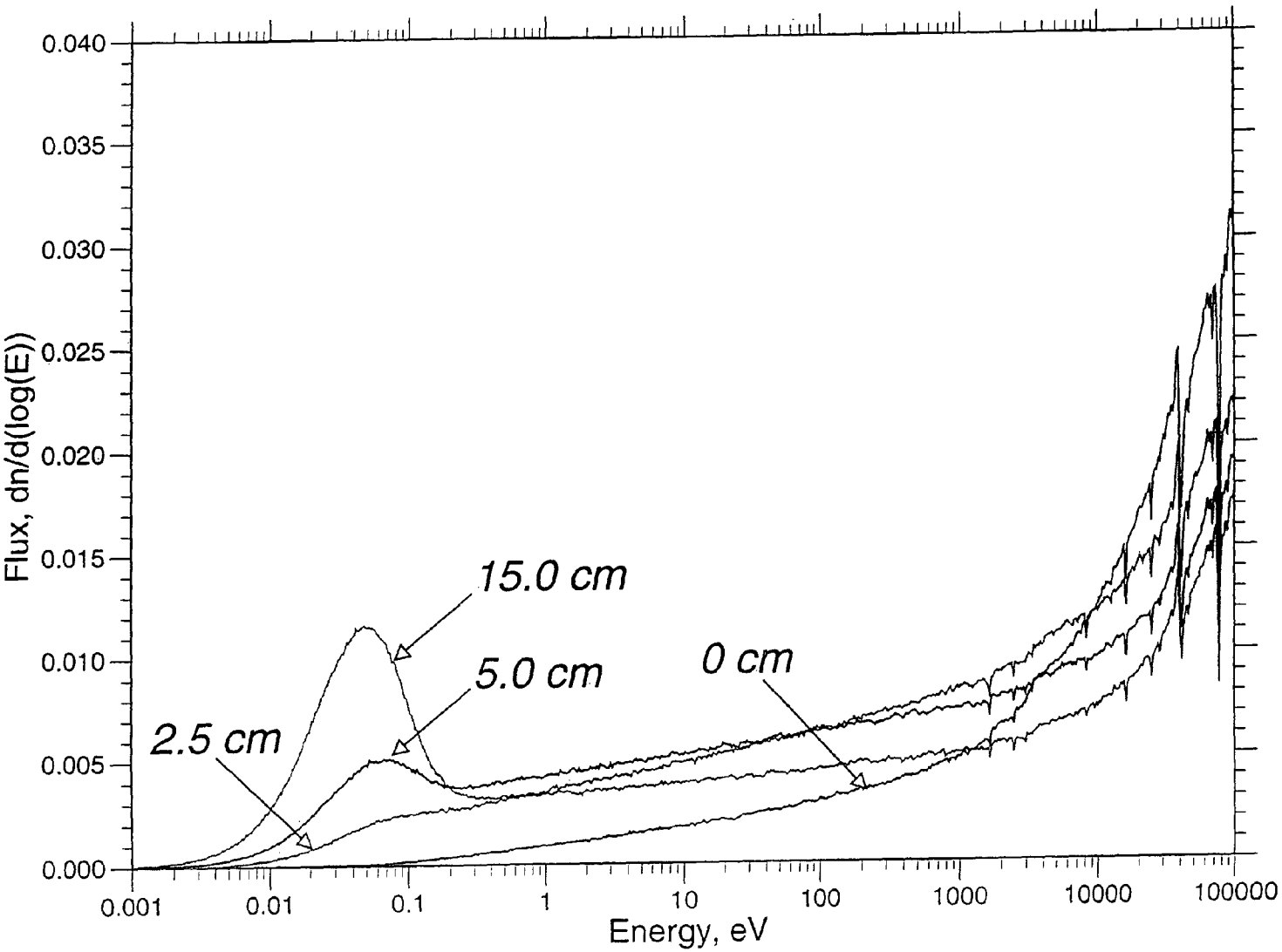

FIG. 9 is a graph showing the spectra in the Activator region for different thicknesses of a Carbon Moderator, and illustrating the build-up of the thermal peak and the flux improvement in the resonance region due to the presence of a Carbon Moderator.

Figure 10:
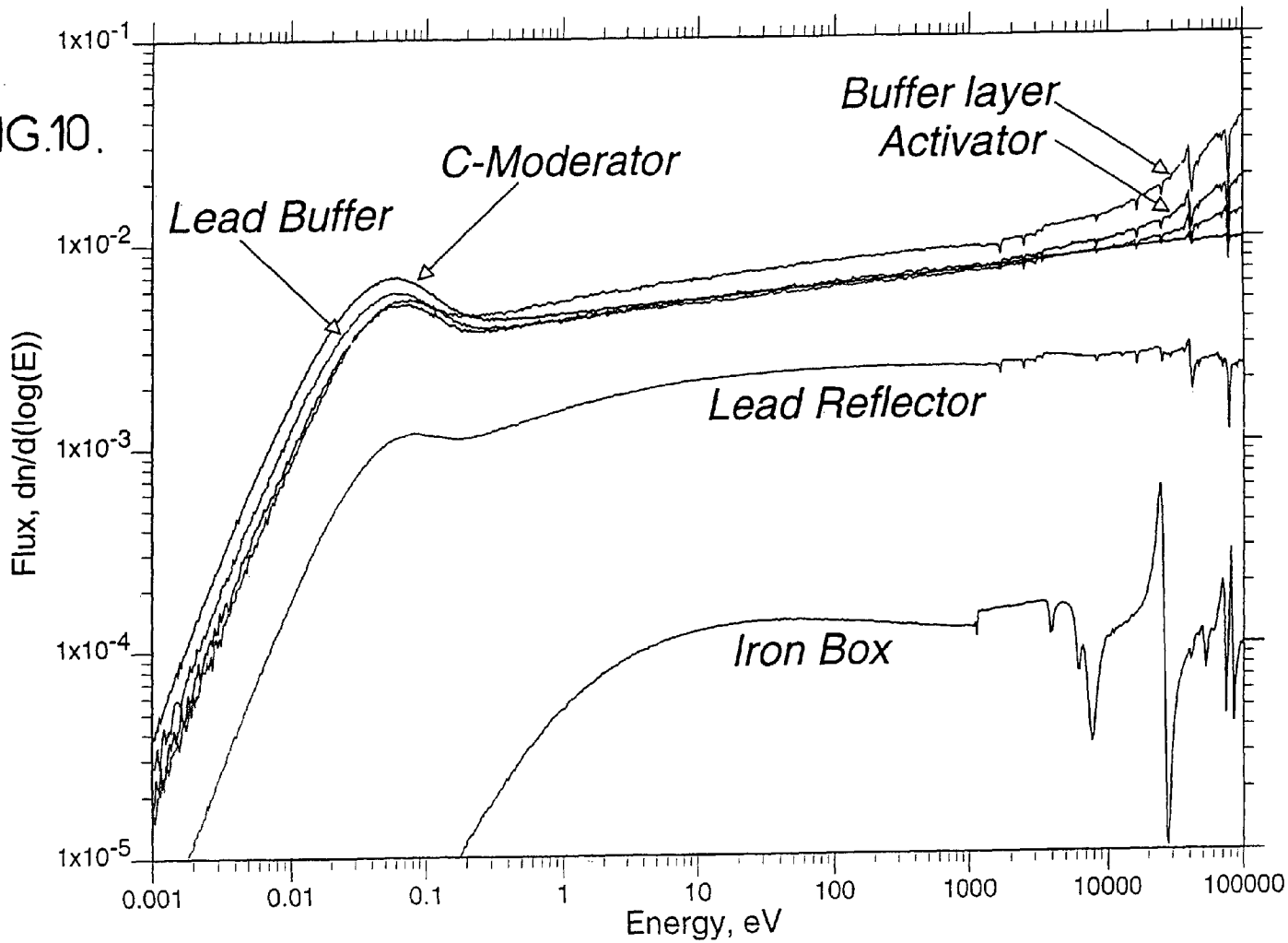

FIG. 10 is a graph showing the neutron spectra in the various elements of the Activator.

Figure 11:
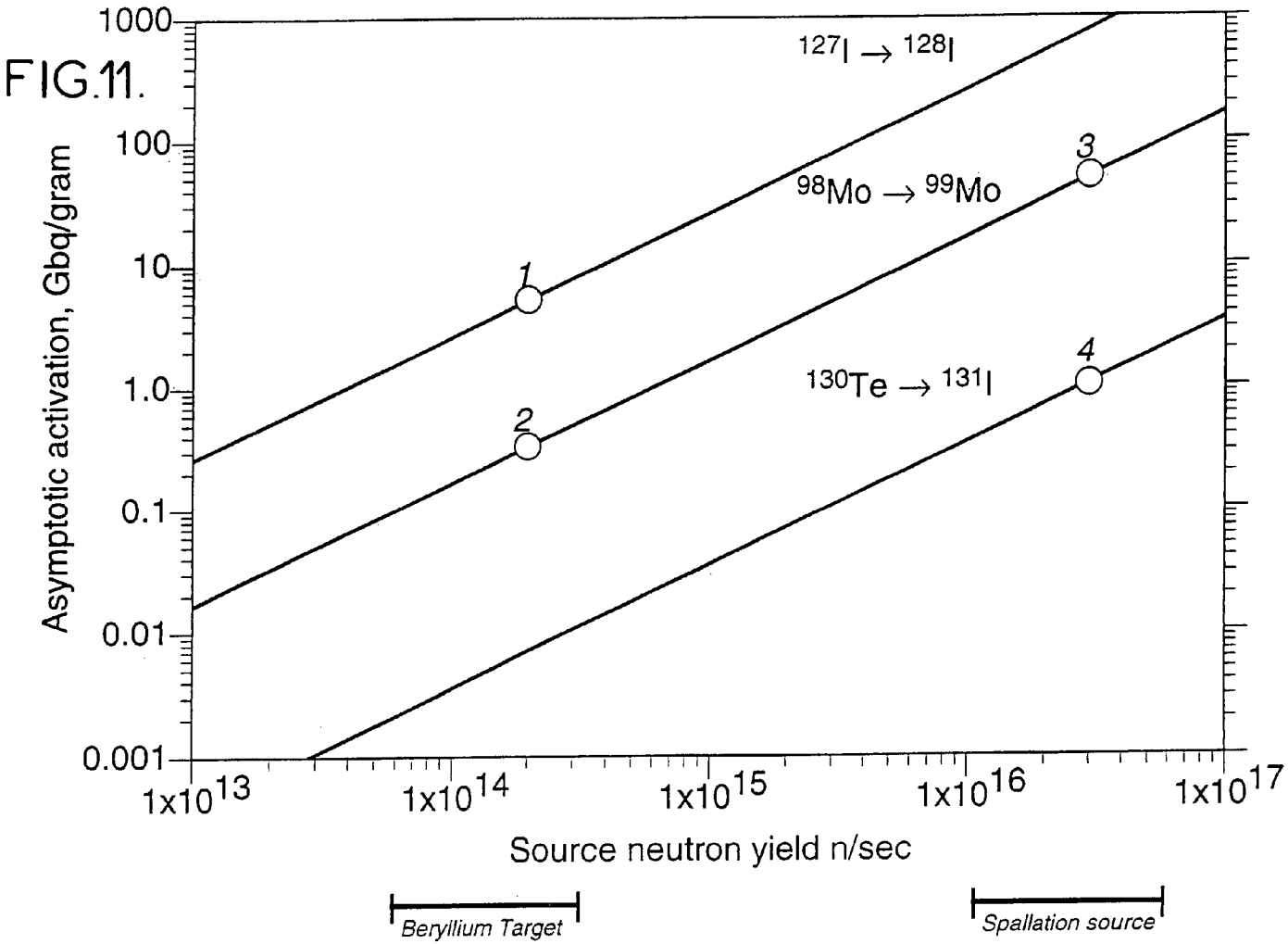

FIG. 11 is a graph showing the asymptotic activated yield for different elements, as a function of he strength $S_0$ of the neutron source.

Figure 2:
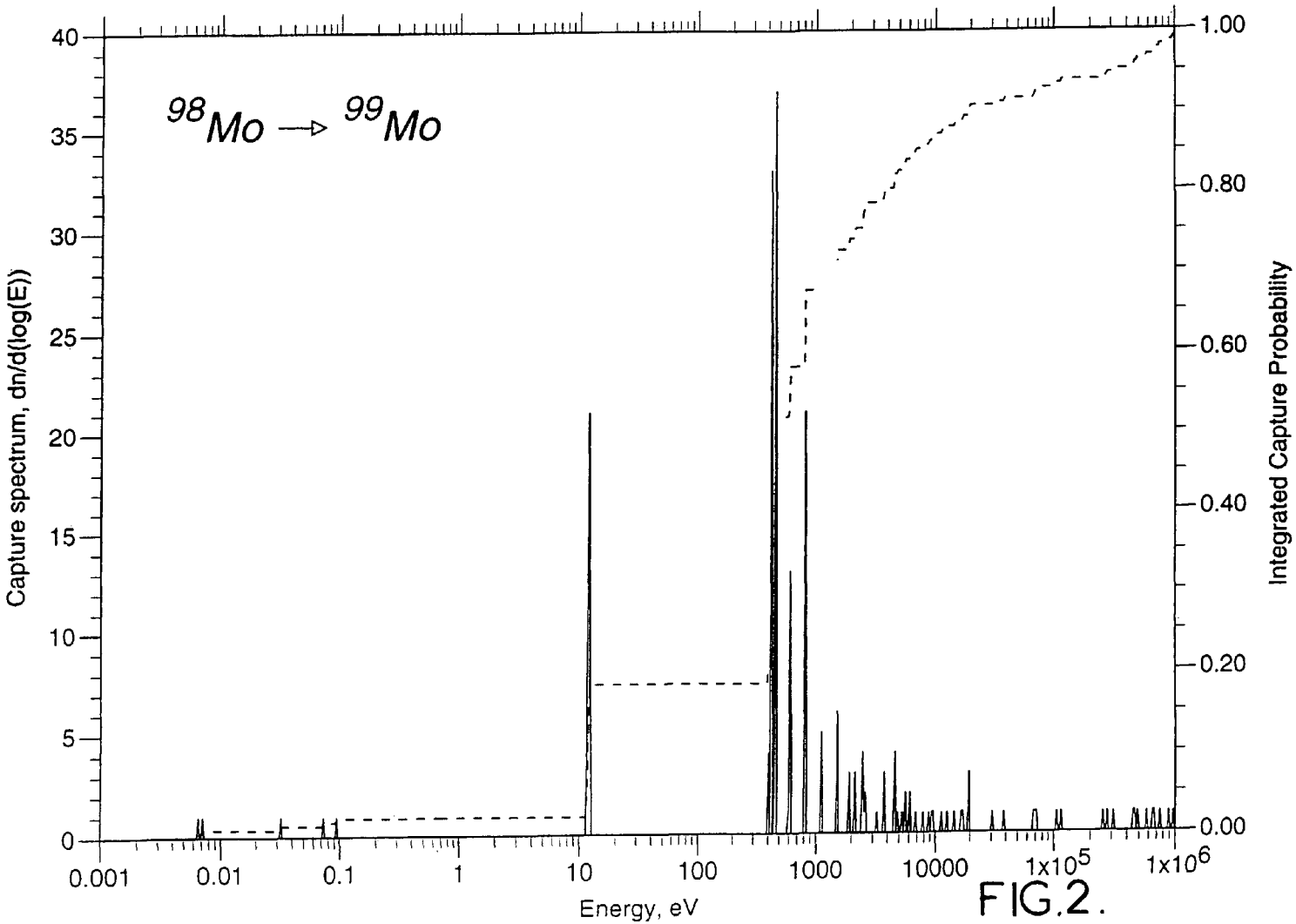
FIG. 2 is a graph showing the energy spectrum of captures in $^{98}$Mo leading to $^{99}$Mo in the Activator geometry of Table 6.
Figure 12:
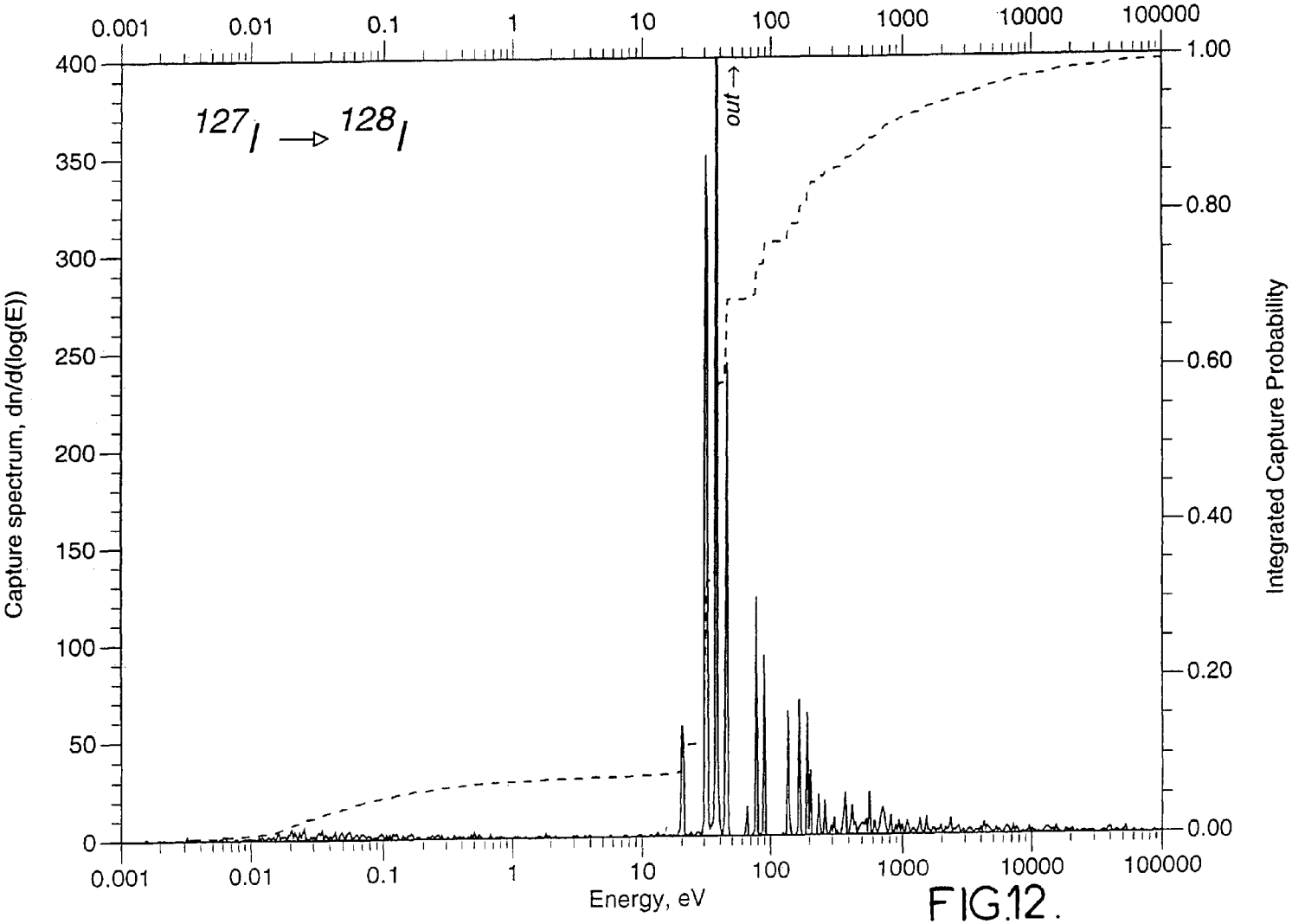

FIG. 12 is a graph similar to FIG. 2, plotted for $^{127}$I leading to $^{128}$I.

FIGS. 13*a-b* illustrate captures in 100 litres of $^{124}$Xe gas at n.p.t. FIG. 13*a* shows the energy spectrum in the Activator; FIG. 13*b* shows the differential spectrum and the integrated probability for the $^{124}$Xe isotope.

Figure 14A:
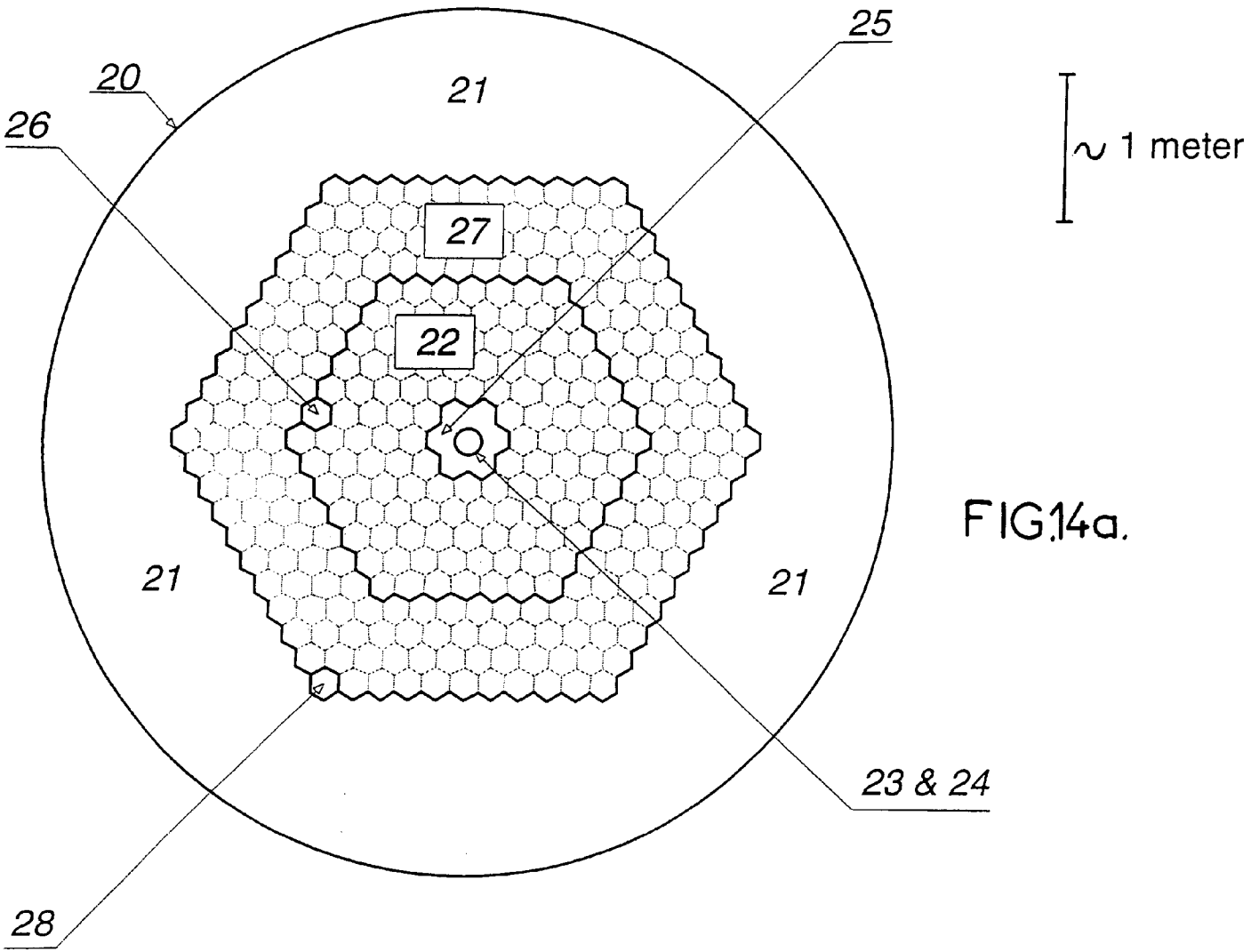
Figure 14B:
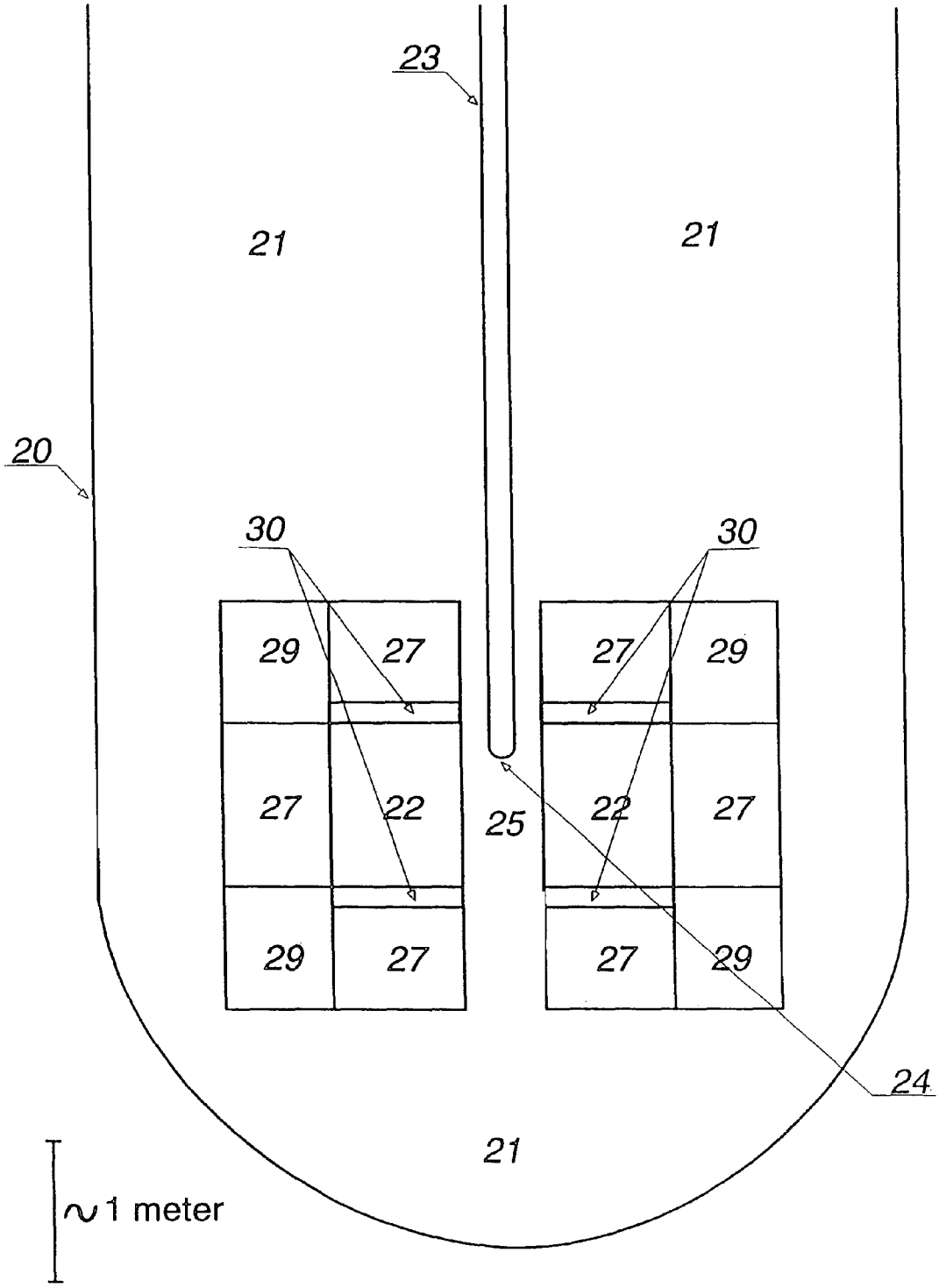

FIGS. 14*a-b* are diagrammatic views of a Waste Transmuter configuration coupled to the EA: FIG. 14*a* is a cross-section through the medium plane of the Core, and FIG. 14*b* is a vertical cross-section along the medium plane.

Figure 15:
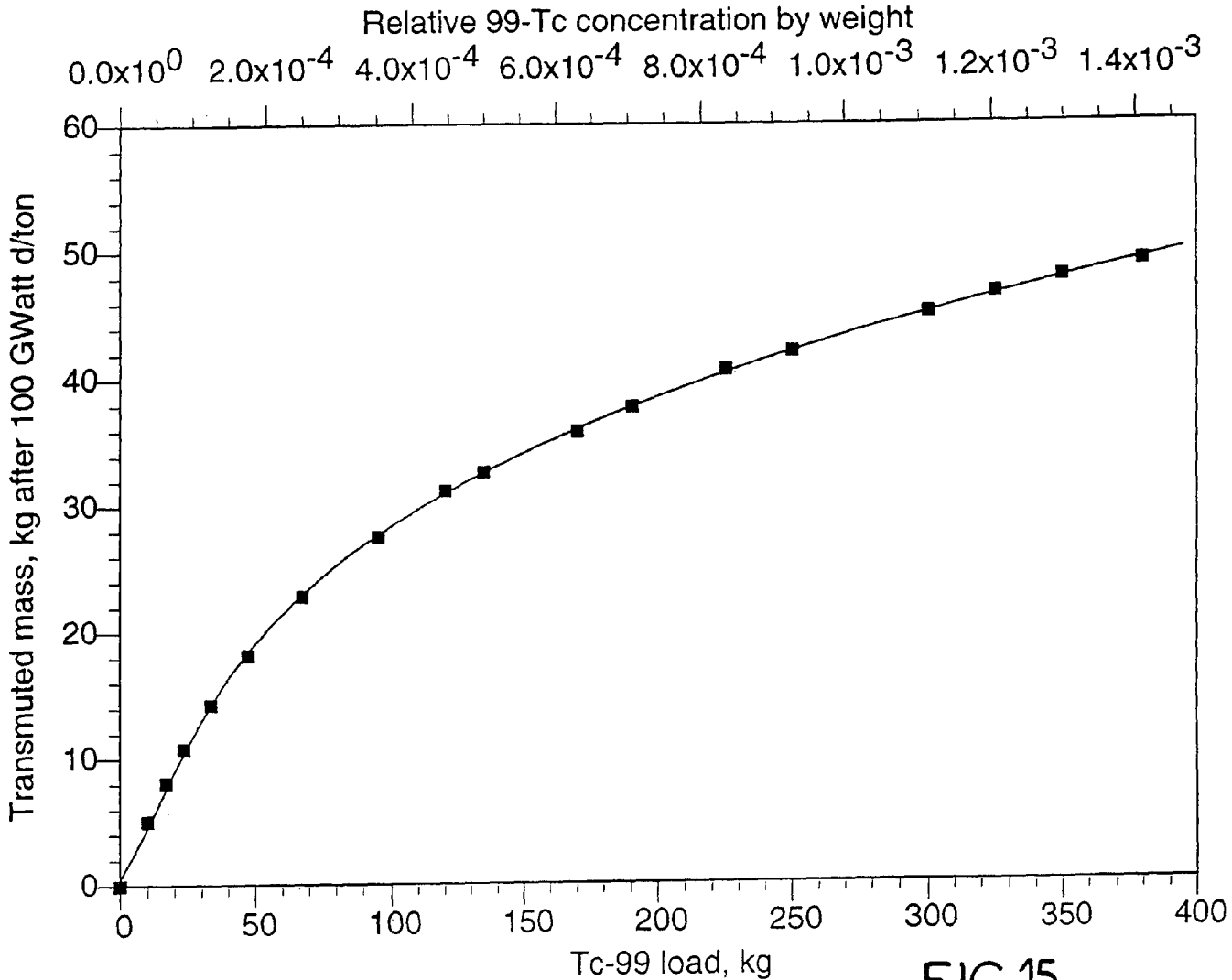

FIG. 15 is a graph showing the transmuted $^{99}$Tc mass after 100 GWatt day/ton, in kg, as a function of the concentration in kg (lower scale), and relative to the Lead by weight (upper scale) in the volume 27 of FIGS. 14*a-b*.

Figure 16:
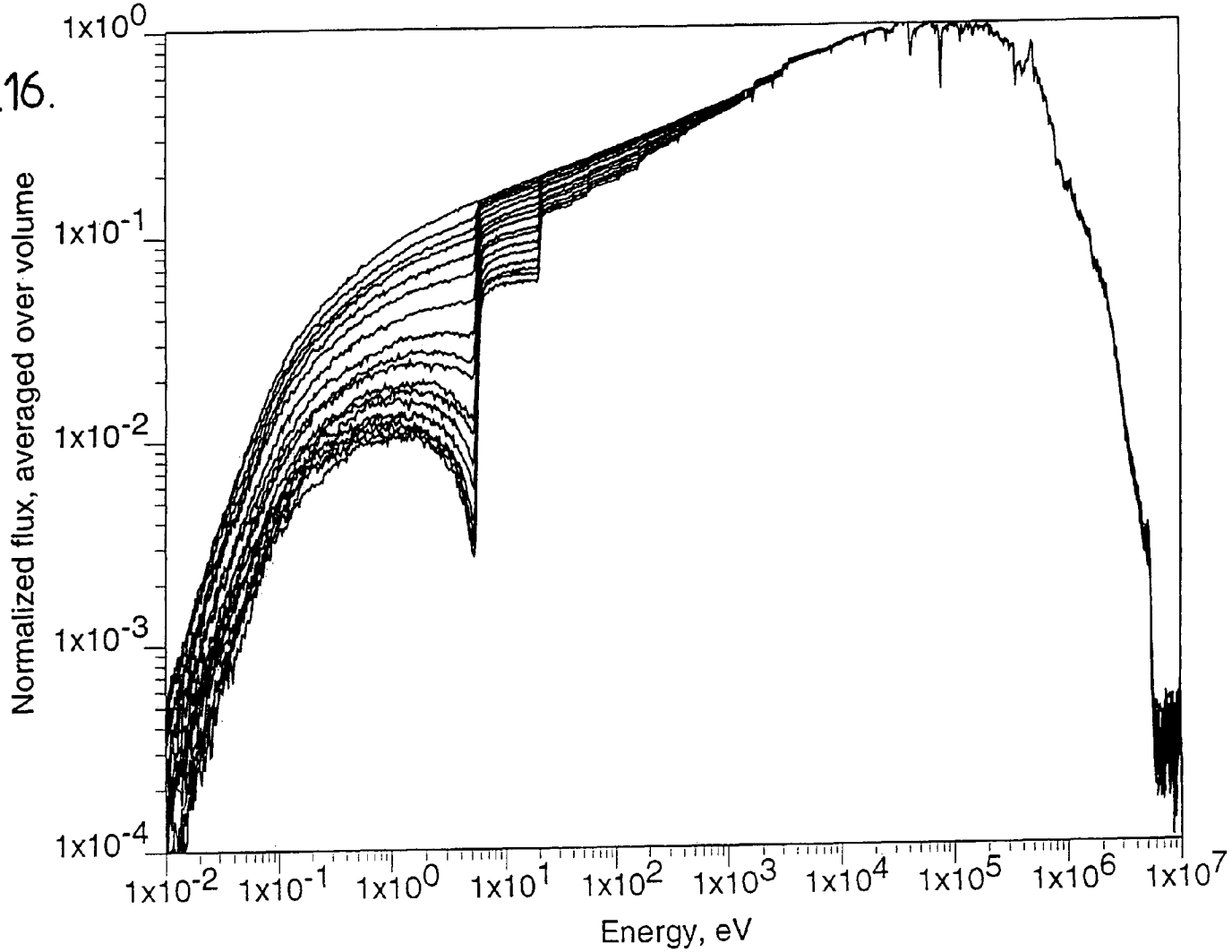

FIG. 16 is a graph showing the neutron spectra, averaged over volume 27 of FIGS. 14*a-b* for a variety of $^{99}$Tc loads in the Transmuter. From the top curve to the bottom curve, the $^{99}$Tc concentrations are 0, 10, 16.84, 23.7, 33.67, 47.41, 67.33, 95.12, 120, 134.7, 170, 190.5, 225, 250.1, 300.2, 325, 350, and 379.9 kg.

Figure 17:
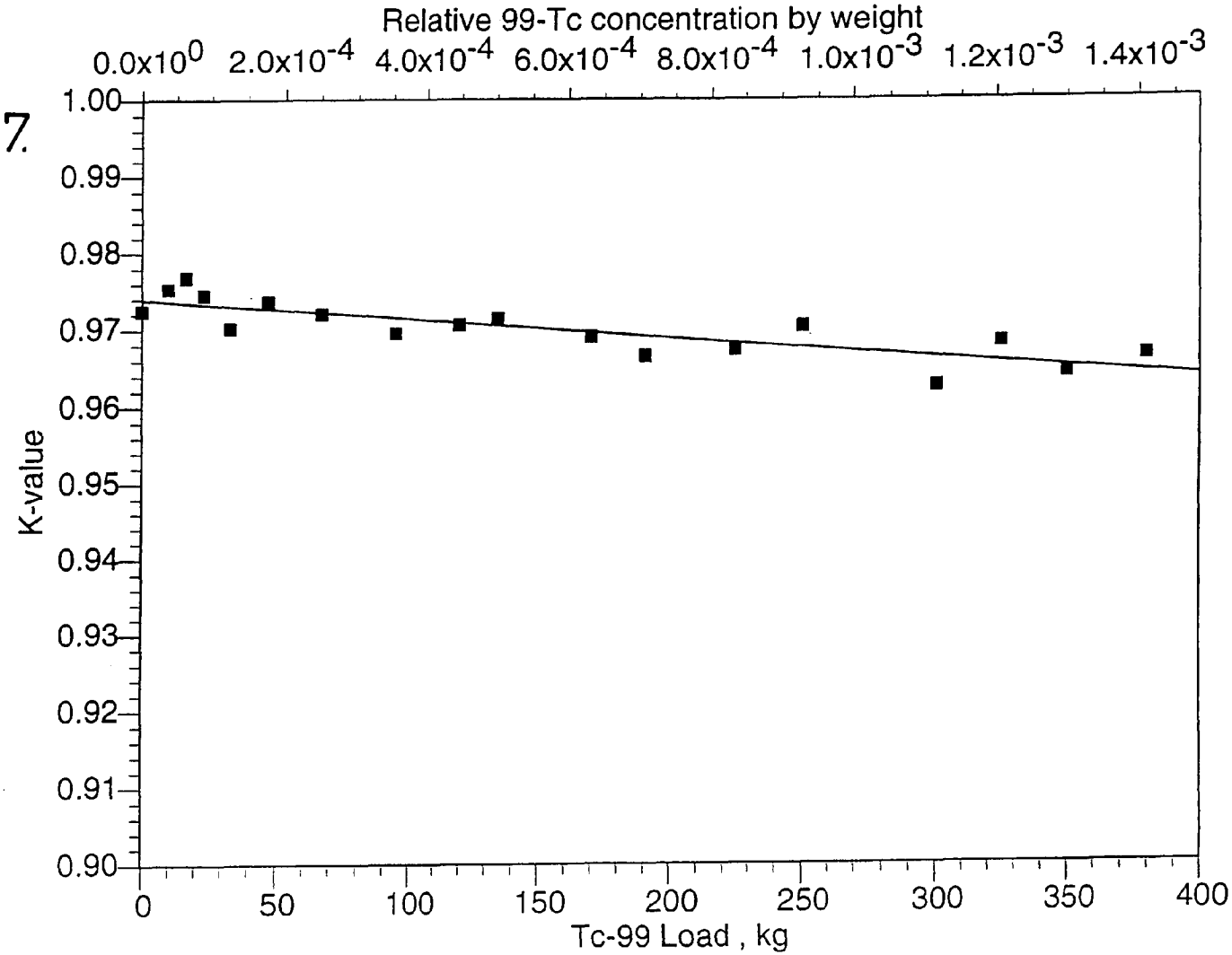

FIG. 17 is a graph showing the parasitic variation of the multiplication coefficient k of the EA as a function of the $^{99}$Tc concentration in kg (lower scale), and relative to the Lead by weight (upper scale) in the volume 27 of FIGS. 14*a-b*.

Figure 18:
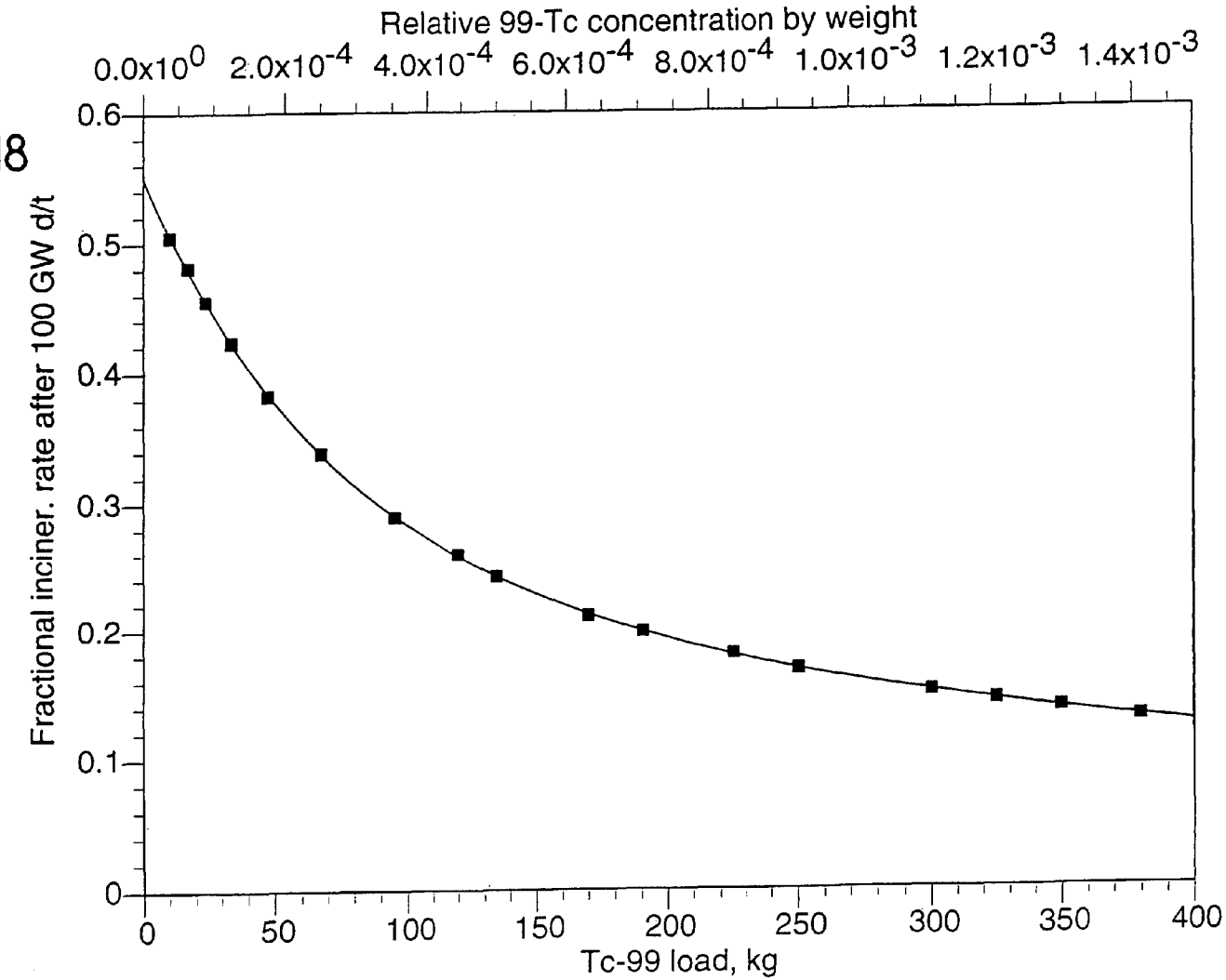

FIG. 18 is a graph showing the fractional transmutation rate as a function of the $^{99}$Tc concentration in kg (lower scale) and relative to the Lead by weight (upper scale) in the volume 27 of FIGS. 14*a-b*.

Figure 19:
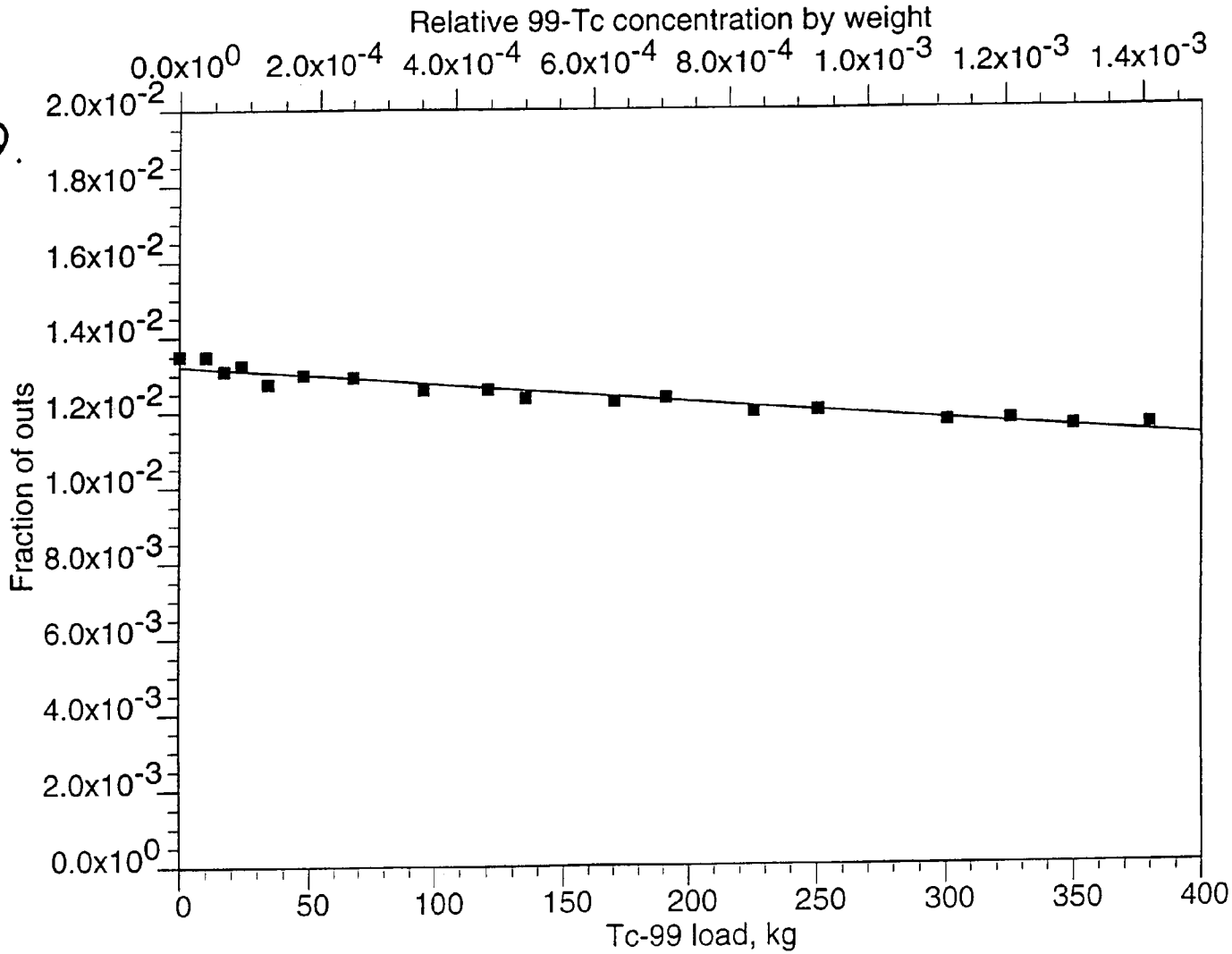

FIG. 19 is a graph showing the fraction of neutrons escaping from the vessel 20 of FIGS. 14*a-b* as a function of the $^{99}$Tc concentration in kg (lower scale), and relative to the Lead by weight (upper scale) in the volume 27 of FIGS. 14*a-b*.

2. Neutron Dynamics

2.1.—Diffusion Equations

In order to illustrate the method, we present first some simple, analytic considerations. These qualitative results are approximate. However, they provide some insight in the dynamics of the method. More detailed computer simulations will be reported further on.

Assume a large volume of transparent, diffusing medium, large enough in order to contain the neutron evolution. The source, assumed point-like, is located at its centre. Consider a neutron population in a large, uniform medium of N scattering centres per unit volume, with very small absorption cross-section cabs and a large scattering cross-section $\sigma_{sc}$. All other cross-sections are assumed to be negligible, as it is generally the case for neutrons of energy substantially smaller than 1 MeV. Since the angular distribution of these collisions is almost isotropic, they also have the important function of making the propagation of neutrons diffusive, and therefore maintain the neutrons "cloud" within a smaller containment volume.

The neutron flux $\phi(x,y,z)$ in such a volume is defined as the number of neutrons crossing the unit-area from all directions per unit time. At this point, the energy spectrum of the neutrons is not considered, namely the flux (and the corresponding cross-sections) are averaged over the energy spectrum. The reaction rate $\rho_x$, defined as the number of events per unit time and unit volume, for a process of cross-section $\sigma_x$ is given by $\rho_x=\phi N\sigma_x=\phi\Sigma_x$, where $\Sigma_x=N\sigma_x$ stands for the macroscopic cross-section for the process x (x=sc for neutron elastic scattering, x=abs for neutron absorption, x=capt for neutron capture). For a steady state, Fick's law leads to the well-known differential equation:

$$\nabla^2\phi - \frac{\Sigma_{abs}}{D}\phi = -\frac{S}{D} \qquad [3]$$

where S is the neutron source strength, defined as the number of neutrons per unit volume and time, and $D=1/(3\epsilon_{sc})$ is the diffusion coefficient for isotropic scattering. For anisotropic scattering, a correction must be introduced, i.e. $D=1/[^3\Sigma_{sc}(1-\mu)]$, where $\mu=\langle\cos\theta\rangle$ is the mean value of the cosine of the diffusion angle (note that for relatively slow neutrons and high A, $\mu\approx 0$). As already pointed out in Paragraph 1.1, two indicative materials—amongst many—can be exemplified as practical diffusing media for the present method, namely Carbon (using the density of reactor-grade graphite, d=1.70 g/cm$^3$ and thermal neutrons cross-sections), for which D=8.6 mm and Lead, for which D=10.1 mm. These media exemplify the alternatives of quickly and slowly thermalising media, respectively.

2.2.—Flux Enhancement

In order to achieve an effective rate of activation, the neutron flux must be as high as possible. If we place a point source at the origin of the coordinate system, Equation [3] will hold everywhere with S=0, except at the source. The approximate solution of the differential equation is:

$$\phi(r) = S_0\frac{e^{-\kappa r}}{4\pi D r};\ \kappa = \sqrt{\frac{\Sigma_{abs}}{D}} = \sqrt{3\Sigma_{SC}(1-\mu)\Sigma_{abs}} \qquad [4]$$

where $S_0$ is the rate of neutrons from the source per unit of time (n/sec). The elastic scattering cross-section being large and the absorption cross section very small, D is a small number (of the order of the centimetre), while $1/\kappa$ is large (of the order of meters). For a region close to the source, namely $\kappa r<<1$, the flux is given by $\phi(r)\approx S_0/(4\pi Dr)$, namely is considerably enhanced with respect to the flux in absence of diffuser $\phi_0(r)\approx S_0/(4\pi r^2)$. For a typical sample distance of r=30 cm, the enhancement factor $F=\phi(r)/\phi_0(r)=r/D$ is very, substantial for instance for Carbon where F=30/0.86=34.88 and for Lead where F=30/1.01=29.7. The diffusing medium is acting as a powerful flux enhancer, due to multiple traversals.

2.3.—Energy Tuning

In addition, the energy spectrum of neutrons is preferably matched to the largest values of the capture cross-section of the relevant isotope. The energy spectrum of a bare source is not optimal because its energy is generally too high to produce an effective capture rate. Therefore, an energy matching (moderation) must be performed before utilisation. Examples already given in which the interesting cross-sections lay in the resonance region are the cases of Iodine activation and the production of $^{99}$Mo($^{99m}$Tc) from a Molybdenum target. As already pointed out, in this case the transparent, diffusing material must have in addition a large atomic number. The energy E of the neutrons is then progressively shifted in a multitude of small steps by a large number of multiple, elastic collisions (as already pointed out, below a few hundred keV and in a transparent medium, the only dominant process is elastic scattering). The minimum emerging kinetic energy T' min (i.e. for a maximum energy loss) of a neutron of energy $T_0$ in collision with a nucleus of atomic number A is given by $$T'_{min} = T_0\left(\frac{A-1}{A+1}\right)^2 \quad [6]$$

which evidently suggests the largest possible A to minimise the rate of energy loss. For large A, isotropic scattering is an excellent approximation. The average, logarithmic energy decrement $\xi$ is then $$\xi = -\ln\frac{\langle T'\rangle}{T_0} = 1 - \frac{(A-1)^2}{2A}\ln\left(\frac{A+1}{A-1}\right) \quad [7]$$

The logarithmic energy decrement for Lead is very small $\xi=9.54\times10^{-3}$. The average number $n_{coll}$ of collisions to slow down from 0.5 MeV to 0.025 eV (thermal energies) os $m_{coll}$=lm (0.5 MeV/0.025 eV)/$\xi$=$1.76\times10^3$. The elastic cross-section, away from the resonances, is about constant down to thermal energies and large ($\sigma_{sc}$=11 b). The total path length $l_{coll}$ to accumulate $n_{coll}$ collisions is then the enormous path of 53.4 meters. The actual displacement is of course much shorter, since the process is diffusive. As a consequence of the property that neutrons loose at each step a constant fraction of their energy, the energy spectrum, generated by a high energy neutron injected in the diffuser is flat when plotted in the variable dE/E=d(log(E)). Neutrons scan progressively the full energy interval down to thermal energies, "seeking" for large values of the capture cross-section of the added impurities due to strong resonances. This method is evidently profitable provided that strong resonances exist elsewhere than at thermal energies. It is a fortunate circumstance that this is the case for several of the isotopes of practical interest.

If a small amount of impurity to be activated is added to the transparent medium, it will capture some neutrons. In general the absorbing cross-section has a complicated behaviour and it varies rapidly as a function of the neutron energy, due to the presence of resonances.

We introduce the survival probability $P_{surv}(E_1,E_2)$, defined as the probability that the neutron moderated through the energy interval $E_1\rightarrow E_2$ is not captured. The probability that a neutron does not get captured while in the energy interval between. E and E+dE is $[1-(\Sigma_{abs}/\Sigma_{abs}+\Sigma_{sc}))(dE/E\xi)]$ where $\Sigma_{sc}$ and $\Sigma_{abs}$ are respectively the macroscopic elastic scattering and absorption cross-sections. Such probability is defined for a large number of neutrons in which the actual succession of energies is averaged. Combining the (independent) probabilities that it survives capture in each of the infinitesimal intervals, $P_{surv}(E_1,E_2)$ is equal to the product over the energy range:

$$\begin{aligned} P_{surv}(E_1, E_2) &\cong \prod_{E_1}^{E_2}\left(1 - \frac{\Sigma_{abs}}{\Sigma_{sc}+\Sigma_{abs}}\frac{dE}{\xi E}\right) \\ &= \exp\left[-\frac{1}{\xi}\int_{E_2}^{E_1}\frac{\Sigma_{abs}}{\Sigma_{sc}+\Sigma_{abs}}\frac{dE}{E}\right] \\ &\approx \exp\left[\frac{-1}{\sigma_{sc}^{Pb}\xi}\left(\frac{N_{imp}}{N_{Pb}}I_{res}^{(imp)}(E_1, E_2) + I_{res}^{(Pb)}(E_1, E_2)\right)\right] \end{aligned} \quad [8]$$

where $N_{Pb}$ and $N_{imp}$ are the number of nuclei per unit volume for Lead and the added impurity, respectively, and in the good approximation that the elastic scattering on Lead is dominant and approximately constant, namely $\Sigma_{sc}\approx\sigma_{sc}^{Pb}N_{Pb}$=const>>$\Sigma_{abs}$. The resonance integrals $I_{res}$ ($E_1$, $E_2$) for Lead and the added impurity are defined as $$I_{res}^{(x)}(E_1, E_2) = \int_{E_2}^{E_1}\sigma_{abs}^{(x)}\frac{dE}{E};\ x = Pb,\ imp \quad [9]$$

The (small) probability of absorption in the same energy interval is given by $$P_{abs}(E_1, E_2) = 1 - P_{surv}(E_1, E_2) \approx \frac{1}{\sigma_{sc}^{Pb}\xi}\left(\frac{N_{imp}}{N_{Pb}}I_{res}^{(imp)}(E_1, E_2) + I_{res}^{(Pb)}(E_1, E_2)\right) \quad [10]$$

which exhibits the separate contributions to capture of the diffusing medium and of the added impurity, weighted according to their respective resonance integrals. The value of the normalizing cross-section in the denominator is $\sigma_{sc}^{Pb}\xi$=0.105 b, to be compared with the integral over the resonances $I_{res}$=150 b for $^{127}$I, $I_{res}$=310 b for $^{99}$Tc and $I_{res}$=0.115 b for natural Lead.

For instance, in the case of the $^{99}$Tc Waste Transmutation, the capture probability will be enhanced over the fractional atomic concentration of the impurity N $N_{imp}/N_{Pb}$ by a factor (310 b)/(0.105 b)=$2.95\times10^3$. In order to reach equal capture probabilities, in $^{99}$Tc and Lead, the diffused impurity atomic concentration needed is only $N_{imp}/N_{pb}$=(0.115 b)/(310 b)=$3.70\times10^{-4}$, namely $1.76\times10^{-4}$ by weight.

Figure 1:
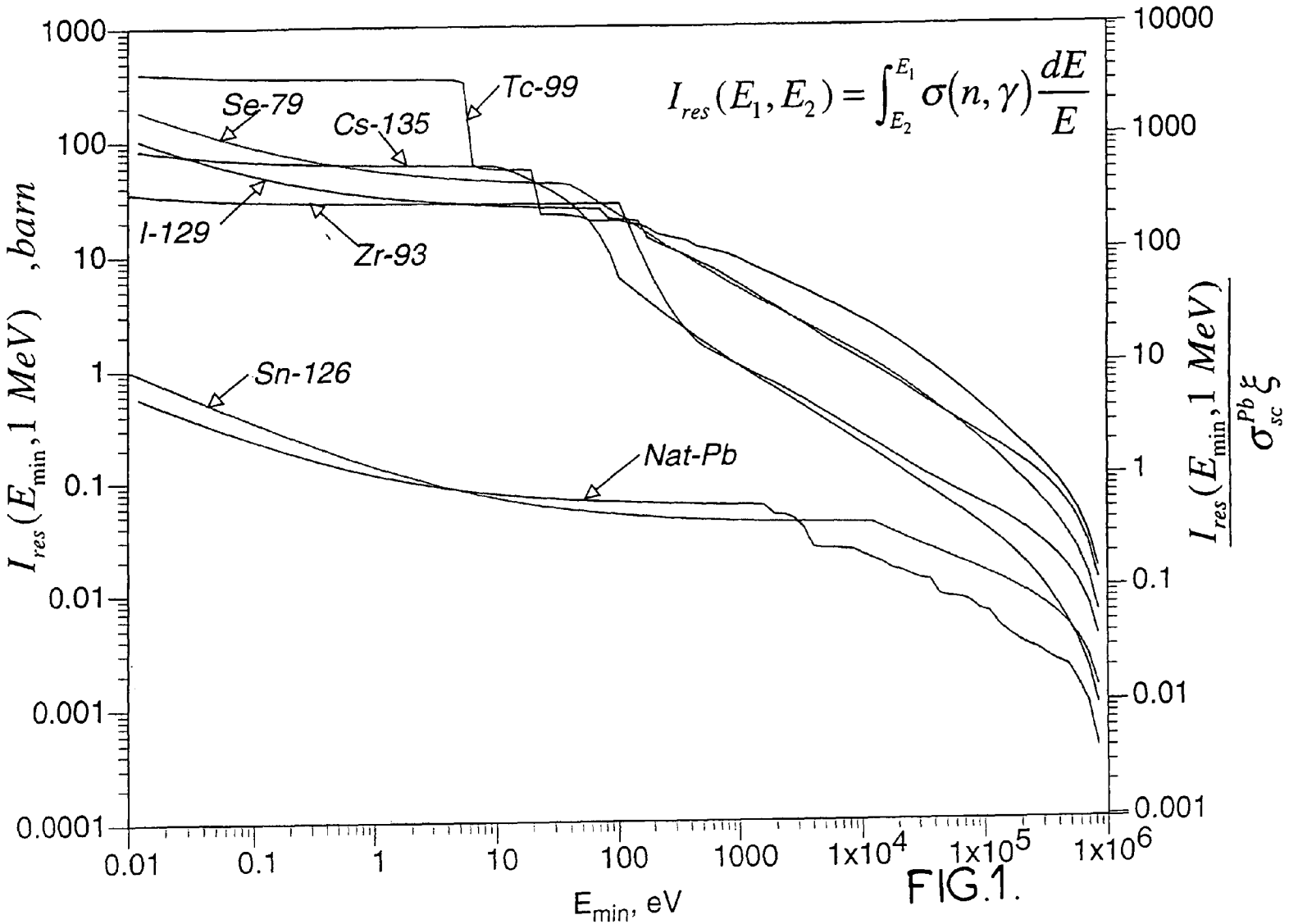
FIG. 1 is a graph showing the resonance integral $I_{res}(E_{min}$, 1 MeV) for elements of Table 1.

The resonance integral as a function of the energy interval for the main elements of Table 1 and relevant to the application as Waste Transmuter is given in FIG. 1, where the quantity $I_{res}^{(x)}(E_{min}$, 1 MeV) is plotted as a function of the lower energy limit $E_{min}$. The value for any energy interval can be easily worked out through the obvious formula $I_{res}^{(x)}(E_1, E_2)=I_{res}^{(x)}(E_1$, 1 MeV)$-I_{res}^{(x)}(E_2$, 1 MeV). The Figure evidences the large values of the resonance integrals for all relevant elements, with the exceptions of $^{126}$Sn (this confirms the unsuitability of $^{126}Sn$ for the present transmutation method) and of natural Lead. It is also apparent that, while the main contribution to the integral in the case of Lead comes for energies >1 keV, the elements to be transmuted have dominant resonance captures (steps in the graph) which are dominant at lower energies. FIG. 1 also displays the values of $I_{res}(E_{min}, 1\ MeV)/\sigma_{sc}^{Pb}\xi$, a dimensionless quantity (see Formula [10]) which gives the capture probability once multiplied by $N_{imp}/N_{Pb}$.

2.4.—Captures in Complex Chemical Compounds

For instance, the Iodine preparation for medical analysis to be irradiated in the Activator is likely to be a specific chemical compound with a variety of other elements in it (see Tables 7 and 8). In compounds made of several elements, a simple generalisation of Formula [10] indicates that the capture probabilities will be proportional to the values of the resonance integrals given in Appendix 1, weighted according to the atomic concentrations of each element.

The compound to be exposed in the mentioned example is most likely Sodium Iodide (NaI). Fortunately, the Na resonance integral, $I_{res}$=0.26 b is much smaller than the one of Iodine, $I_{res}$=150 b. The activation ($^{24}Na$) of Sodium will therefore be only $1.73\times10^{-3}$ of the one of Iodine. The additional dose given to the patient is completely negligible. In addition, the half-lives of the two compounds, the wanted $^{128}I$ and the unwanted $^{24}Na$, are 24.99 m and 14.96 h, respectively, i.e. in the ratio $2.78\times10^{-2}$. The activity of the latter will then be $1.73\times10^{-3}\times2.78\times10^{-2}=4.83\times10^{-5}$ that of the former, of no effect for the measuring devices.

In the case of Molybdenum ($^{98}Mo$, $I_{res}$=7.0 b), in the form of a salt, for instance $Na_2MoO_4$, some captures occur in $^{23}Na$, leading to the unstable $^{24}Na$. The resonance integral of $^{23}Na$ is more significant than in the previous example, since the $^{98}Mo$ resonance integral is smaller ($I_{res}$=6.54 b), and it may constitute a problem, though the half-life of $^{24}Na$ is of 14.96 h, i.e. shorter than the one of $^{99}Mo$. However, in the separation of the decay product $^{99m}Tc$, the Na is generally retained. Some care must be exercised in order to ensure that a sufficiently small amount of $^{24}Na$ is ending up in the patient, as a leakage through the dissolution process and subsequent preparation of the clinical sample. If the irradiated sample is either metallic Mo or $MoO_3$, such a problem does not arise, at the cost however of some additional chemical handling at the end of the exposure.

Other most likely elements in chemical compounds are Carbon ($I_{res}$=0.0016 b) (this is valid both for the leading isotope $^{12}C$ and the tiny, natural concentration (1.1%) of $^{13}C$ ; the small, natural concentration of $^{13}C$ produces through capture radioactive $^{14}C$, though in very small amounts since its resonance integral is small), Oxygen ($I_{res}$=0.0004 b), Nitrogen ($I_{res}$=0.85 b) and Hydrogen ($I_{res}$=0.150 b). Small amounts of captures in these elements fortunately with small $I_{res}$—are harmless. In particular, $^{14}N$ produces $^{15}N$, $^{12}C$ produces $^{13}C$ and Hydrogen produces Deuterium, which are all stable elements. The Deuterium contamination in natural Hydrogen (0.015%) can produce Tritium, but fortunately the resonance integral of Deuterium is extremely small, $I_{res}=2.3\times10^{-4}$ b. The small isotopic concentration (0.37%) of $^{15}N$ in natural Nitrogen has a extremely small resonance integral, and is β-decaying to $^{16}O$ with a half-life of 7.13 s, too short to reach the patient.

Another element which could be present is Phosphorus. Its resonance integral is extremely small, $I_{res}$=0.0712 b. It leads to the 14.26 d isotope $^{32}P$, which is a pure β-emitter, with <Eβ>=695 keV and no γ-emission.

Finally, we mention the case of Chlorine. Captures in $^{35}Cl$ (75.77%, $I_{res}$=12.7 b) lead to the very long-lived $^{36}Cl$ ($\tau_{1/2}=3.01\times10^5$ y, β-, no γ) element which is completely harmless, and $^{37}Cl$ (24.23%, $I_{res}\approx2.47$ mb) has an extremely low production cross-section for $^{38}Cl$ ($\tau_{1/2}$=37.24 m).

Other chemicals which may be deemed necessary must be separately examined in view of their capture probability and the possibility of introducing harmful radioactive isotopes in the patient.

2.5.—Montecarlo Computer Simulations

The above formulae are only very approximately valid, and give only the qualitative features of the, phenomena. For instance, in such linear approximation, each element is contributing, so to say, independently. However, if a resonance is strong enough to absorb a major fraction of neutrons, it may "shield" other resonances occurring at lower energy. Then, the element which has a dominating resonance group at higher energies can void the captures of the elements "downstream". This effect may be very important. The lethargy is modified by the elastic part of the resonance. The flux is locally decreased (dip) due to the shorter path needed to make the collision. Finally, the complexity of the geometry of a realistic device cannot be easily accounted for anlytically.

In practice, computer simulations with the appropriate time evolution, are the only valid methods to predict with precision the performance of the device. These calculations use a Montecarlo method and the actual cross-sections for the interactions of particles inside the medium to simulate the propagation of the neutrons in the actual geometry of the Transmuter. A complete simulation programme has been developed in which the best known nuclear cross-sections have been used to follow the evolution of initially injected neutrons in a medium made of the appropriate mixture of isotopes and a definite geometrical configuration. Thermalization is taken into account, introducing the Maxwellian distribution of velocity for the target nuclei. Cross-sections from Nuclear Data bases have been used, and secondary decays have been included. A large number of neutrons are thus followed in their fate inside the device. The validity of the programme has been verified by comparing its predictions with a large number of different experimental data. These simulations have been found in excellent agreement (to better than the present uncertainties, of the order of ±15%) with experimental results obtained at the CERN-PS (Experiment TARC-P211).

We consider first the application of the Transmuter as Activator. In Table 3, we exemplify some of the results of such computer simulations, normalised to $10^{13}$ neutrons produced by the source (23 MeV protons on a thick Beryllium target) and injected in the Activator with the geometry described in Table 6. We have chosen a Molybdenum salt $Na_2MoO_4$ (other salts may be used instead, for instance derived from the Molybdic Phosphoric Acid $H_7[P(Mo_2O_7)_6]\ nH_2O$; see Paragraph 5.3 herebelow for more details) in order to evaluate the effects of the other chemical elements and their activation.

Out of the injected neutrons, 91.5% are captured inside the device and 8.5% escape. These neutrons are absorbed in the surrounding shielding materials. The bulk of the captures occur in the Iron box (36.0%) and in the Lead (46.8%). Most of these captures produce stable elements, with the exception of captures in $^{54}Fe$ (2.40%) which give origin to $^{55}Fe$ with a half-life of 2.73 years and in $^{208}Pb$ (0.43%) which produces $^{209}Pb$, which decays with a half-life of 3.25 hours into the stable $^{209}Bi$. The captures in the graphite Moderator are small (0.51%) and produce a tiny amount of $^{14}C$ through captures of the natural isotope $^{13}C$ ($3.25\times10^{-4}$).

TABLE 3

Example of computer simulation for the Activator loaded with $Na_2MoO_4$. Captures are given for $10^{13}$ neutrons produced. Only radio-isotopes with a half-life longer than 1000 s are listed.

| Element | Mass (kg) | Captures | Capt/gram | Daughter | element |
|---|---|---|---|---|---|
| $12_C$ | 347.5 | 5.181E10 | 1.491E5 | $13_C$ | stable |
| $13_C$ | 4.1880 | 3.250E9 | 7.760E5 | $14_C$ | 5730 y |
| $16_O$ | 0.2213 | — | — | $17_O$ | stable |
| $23_{Na}$ | 0.1594 | 1.690E9 | 1.060E7 | $24_{Na}$ | 14.95 h |
| $54_{Fe}$ | 3739.0 | 2.397E11 | 6.411E4 | $55_{Fe}$ | 2.73 y |
| $56_{Fe}$ | 61330.0 | 3.48812 | 5.688E4 | $57_{Fe}$ | stable |
| $57_{Fe}$ | 1497.0 | 1.015E11 | 6.780E4 | $58_{Fe}$ | stable |
| $58_{Fe}$ | 193.9 | 1.459E10 | 7.524E4 | $59_{Fe}$ | 44.5 d |
| $92_{Mo}$ | 0.0473 | 1.536E8 | 3.247E6 | $93_{Mo}$ | 4.9E3 y |
| $92_{Mo}$ | 0.0473 | <<1.0E5 | <<2.0E3 | $93m_{Mo}$ | 6.85 h |
| $94_{Mo}$ | 0.0301 | 1.100E8 | 3.652E6 | $95_{Mo}$ | stable |
| $95_{Mo}$ | 0.0524 | 1.485E10 | 2.835E8 | $96_{Mo}$ | stable |
| $96_{Mo}$ | 0.0555 | 2.150E9 | 3.874E7 | $97_{Mo}$ | stable |
| $97_{Mo}$ | 0.0321 | 1.650E9 | 5.142E7 | $98_{Mo}$ | stable |
| $98_{Mo}$ | 0.0819 | 1.360E9 | 1.660E7 | $99_{Mo}$ | 65.94 h |
| $100_{Mo}$ | 0.0334 | 4.100E8 | 1.229E7 | $101_{Mo}$ | 14.61 m |
| $204_{Pb}$ | 702.3 | 5.539E11 | 7.887E5 | $205_{Pb}$ | stable |
| $206_{Pb}$ | 12210.0 | 5.348E11 | 4.380E4 | $207_{Pb}$ | stable |
| $207_{Pb}$ | 11250.0 | 4.102E12 | 3.646E5 | $208_{Pb}$ | stable |
| $208_{Pb}$ | 26800.0 | 4.284E10 | 1.599E3 | $209_{Pb}$ | 3.25 h |
| $205_{Pb}$ | 0.0031 | 1.000E7 | 3.270E6 | $206_{Pb}$ | stable |
| Totals | 118074.0 | 9.155E12 | | | |

Therefore, the activation of the structures is modest and leads to no specific problem even after long exposures. As expected, the activation of a complex chemical sample produces several undesirable, unstable elements which will be reviewed in more detail later on for specific examples.

The energy spectrum of the neutrons captured in $^{98}$Mo is shown as a solid line (left-hand ordinate scale) in FIG. 2. The integrated capture probability (dotted line, right-hand ordinate scale) is further displayed as a function of the upper energy value of the integration. The thermal neutron contribution is very small, and resonant capture dominates, extending all the way to the highest energies.

The phenomenology of the neutron capture process is nicely visualised by the behaviour of the energy spectrum near a strong resonant absorption (FIG. 3*a*). Calculations refer to the activation of a block of metallic Tellurium in the Activation Volume of the Activator of Table 6. Capture probabilities in the body of the Activator (Pb, Fe, etc.) are, as expected, essentially unchanged with respect to the previous example. The specific capture rate in $^{130}$Te, leading to $^{131}$I, is $\eta=3.54\times10^{-5}$ kg$^{-1}$ of natural Tellurium. A dip (indicated with an arrow, at 23 eV) occurs due to local depletion due to the main $^{123}$Te isotope: neutrons from neighbouring regions rush in, but only after a number of scattering events which are needed to displace the flux, and which induce a significant energy shift because of the lethargy of the material. After recovery from the dip, the spectral level is lower, due to depletion of the neutrons due to captures. The energy spectrum of captures in $^{123}$Te (solid line, left-hand ordinate scale), and the integrated capture probability (dotted line, right-hand ordinate scale) are shown in FIG. 3*b*. The presence of the prominent peak at 23 eV and of other satellite peaks is evident. Finally, in FIG. 3*c*, we display the same quantities, but for the captures in $^{130}$Te. The capture rate is suppressed in correspondence of the dominant peak of $^{123}$Te, but the flux is later recovered and captures can occur also at thermal energies. Resonant captures of $^{130}$Te occur at relatively high energies, prior to the $^{123}$Te absorbing action. These captures will be preserved even if, because of larger Tellurium samples, the flux will be more significantly depleted. This example shows the delicate interplay in the succession of resonant captures in different elements of a compound.

Finally, we briefly discuss the application as a Waste Transmuter. The computer programme has been used to describe the time evolution of the neutron fluxes and of the element compositions in the EA (see C. Rubbia, "A High Gain Energy Amplifier Operated with Fast Neutrons", AIP Conference, Proceedings 346, International Conference on Accelerator-Driven Transmutation Technologies and Applications, Las Vegas, July 1994) The coupling between these two, models is essential to understand the operation of the Waste Transmutation, coupled with the EA.

The EA is cooled with molten Lead, which surrounds the core. In this otherwise empty volume, the conditions described for the Transmuter develop naturally. This is evidenced by the neutron spectrum shown in FIG. 4, plotted at various distances above the core for a small cylindrical volume coaxial to the core cetre and about 1 metre from the axis. The first 5 spectra (labeled 1-5) correspond to different vertical segmented levels of the core, starting from the medium plane and rising each time by 15 cm. One can observe a very hard spectrum, which is required for instance in order to fission the TRU's. The subsequent five spectra (6-10), correspond to different vertical segmented levels in the Lead surrounding the core, in steps of 40 cm. All spectra are average spectra over the vertical bin. The spectra in the surrounding Lead show the characteristic flattening due to the iso-lethargic condition, and enrich dramatically the part of the spectrum which is relevant to transmutation (1 to 1000 eV). In segments 8 and 9, we have introduced a small, diffused contamination of $^{99}$Tc at the density of 2.686 mg/cm$^3$, equivalent to a mass concentration of only 260 p.p.m. with respect to the Lead.

The capture lines corresponding to the leading $^{99}$Tc resonances are prominent, corresponding to a strong absorption as indicated by the large drop of the flux in the resonance crossing. This is better evidenced in FIG. 5, where the spectrum in segment 8 (volume 0.409 m$^3$) is plotted in linear scale. In particular, one can see the diffusive refill of the spectrum, due to the rushing in of the neutrons from the region with no. $^{99}$Tc doping.

The programme can be used to study both the time evolution of the burning inside the EA and the subsequent reactions in the Transmuter. This is evidenced in FIG. 6, where the concentration of relevant elements as a function of the burn-up in the EA is shown for segment 8 (0.409 m$^3$) in which the $^{99}$Tc doping is inserted initially. While the $^{99}$Tc, initially with a density of 2.686 mg/cm$^3$, is rapidly transmuted with a 1/e constant of 82 GWatt day/ton, the daughter element $^{100}$Ru builds up correspondingly. The large transformation rate of the $^{99}$Tc into the stable element $^{100}$Ru is followed by small capture rates to form $^{101}$Ru, and possibly some $^{102}$Ru. It is noted that all the indicated Ruthenium isotopes are stable The subsequent elements which may be produced by successive captures are also favourable: $^{103}$Ru and $^{104}$Ru are stable, while $^{105}$Ru quickly decays into the stable $^{105}$Pd. Also, $^{106}$Pd is stable, the first long-lived isotope being $^{107}$Pd, which has a half-life of $6.5\times10^6$ years. However, its production rate is truly negligible, taking into account that as many as eight successive neutron captures must occur in the same nucleus.

The decay constant for transmutation of $^{99}$Tc is about 82.1 GWatt day/ton, corresponding to less than 3 years for the nominal EA power (1.0 GWatt, thermal). These curves evidence the feasibility of complete elimination of Technetium in the periphery of an EA with a reasonable time constant. More detailed configurations and actual rates of transmutation will be discussed later on.

Incidentally, we also remark that if the materials to be transmuted were directly inserted in the core, the transmutation rate would be much smaller, since there the neutron flux is concentrated at energies in which the captures by the long-lived FF's have a very tiny cross-section.

3. The Neutron Supply

3.1.—General Consideration

The size and the kind of the neutron source are clearly related to the application. We consider first the case of the Activator.

The main parameter is the angularly integrated neutron production rate $S_0$, since the actual angular distribution at the source is quickly made isotropic by the Lead Diffuser (see Chapter 4 herebelow for more details). Likewise, the energy spectrum of the initially produced neutrons is relatively unimportant since, as already explained, the inelastic processes in the Diffuser quickly damp the neutron energy down to about 1 MeV, where the lethargic slow-down of the neutrons is taking over. Therefore, the neutron capture efficiency for activation $\eta$ and, more generally, the geometry of the Activator are relatively independent of the details of the realisation of the source.

In the case of the activation of natural Iodine, it is likely that a small sample—of the order of a fraction of a gram—must be activated for each exposure to a level requiring a cyclotron or similar accelerator with a neutron production rate of few times $10^{13}$ neutrons over the full solid angle. This can be obtained with an energy of the order of 10 to 30 MeV and a beam current of the order of mA's, which is also suited for production of isotopes for PET examinations. Therefore, a combined facility may be envisioned.

In the case of a large industrial production of radio-nuclides, like for instance $^{99}$Mo ($^{99m}$Tc), $^{131}$I or of Fissium from Uranium fissions it may be worth considering similar currents but higher proton energies, in the region of a few hundred MeV, with a correspondingly larger $S_0$. Activation, which is proportional to $S_0$, can then be performed within much smaller samples, which is, as will be seen, a considerable advantage especially in the case of portable $^{99}$Mo ($^{99m}$Tc) dispensers.

At the other end of the scale, the production of small activation with a simple device using a neutron-emitting radioactive source is worth mentioning, since it might be of interest for applications which require a very weak source (<<mCie) of radio-isotopes, but at low cost and operational simplicity.

3.2.—Neutron Yield from Intermediate Energy Particles

The overall neutron yield from a thick Be target bombarded with a beam of protons of energy $E_p$=23 MeV is reported in the literature (see H. J. Brede et al, Nucl. Instr. & Methods, A274, (332), 1989 and references therein). Integration over the angular distribution (M. A. Lone et al, Nucl. Instr. & Methods 143, (331), 1977 ; see also M. A. Lone et al, Nucl. Instr. & Methods 189, (515), 1981) gives the total neutron yield $S_0=1.66\times10^{14}$ n/sec/mA (for energies greater than 0.4 MeV', corresponding to a neutron flux $\phi(r)=0.654\times10^{12}$ cm$^{-2}$ s mA$^{-1}$ at r=20 cm from the source, according to the formula $\phi(r)\approx S_0/(4\pi Dr)$, which exhibits the Lead enhancement factor (D=1.01 cm). It is also noted that the flux is fallina like the inverse of the distance (1/r), i.e. more slowly than in empty space where the flux is proportional to the solid angle from the source (1/r$^2$) . Already for a current of 10 mA, which can be generated by modern cyclotrons, our system leads to the remarkable flux $\phi(r)=6.5\times^{12}$ cm$^{-2}$.s$^{-1}$, typical of a Reactor.

TABLE 4

Neutron yield for energies >0.3 MeV, integrated over all angles.

| Reaction | Energy (MeV) | Integrated flux, $S_0$ ($10^{13}$ n/sec/mA) |
|---|---|---|
| $^9Be(p, n)$ | 14.8 | 6.8 |
| | 18.0 | 10.2 |
| | 23.0 | 16.6 |
| $^9Be(d, n)$ | 8.0 | 1.5 |
| | 14.8 | 8.6 |
| | 18.0 | 12.3 |
| | 23.0 | 19.6 |
| $^7Li(p, n)$ | 14.8 | 5.1 |
| | 18.0 | 8.1 |
| | 23.0 | 10.3 |
| $^7Li(d, n)$ | 8.0 | 1.0 |
| | 14.8 | 7.7 |
| | 18.0 | 12.1 |
| | 23.0 | 19.5 |

Other target materials can be used, in particular $^7$Li, with comparable yields. However, in view of the lower melting point, Lithium targets are more complicated. A summary of yields for different beams and (thick) targets is given in Table 4.

The neutron yield is a growing function of the proton kinetic energy $E_p$. Fitting of measurements at different energies leads to the simple empirical formula $S_0(E_p)=4.476\times10^{11}\times E_p^{1.8866}$ valid for neutrons of energy greater than 0.4 MeV. For instance, for a proton kinetic energy $E_p$=50 (15) MeV, the neutron yield is increased (decreased) by a factor 4.33 (0.45) when compared to $E_p$=23 MeV. Since the beam power $E_0$ for a current $i_p$ is $i_pE_p$, the neutron yield for a given beam power is rising proportionally to $E_0^{0.886}$.

Neutrons can be produced also with other incident particles, in particular deuterons and alpha particles. For a given incident energy, the forward neutron yield of deuterons is substantially higher than for protons, but as relevant in our application, the angle integrated flux is comparable to the one of protons, as shown in Table 4. For instance, at $E_d$=23 MeV, the integrated, yield is $S_0=1.96\times10^{14}$ n/sec/mA. The yield for incident α-particles is substantially lower. In view of the associated simplicity and their high neutron yield, proton beams seem to be optimal for the present application.

An important technical element is the beam power to be dissipated in the target. The many different types of targets which are commonly used in association with particle beams of the characteristics considered here are generally applicable to our case. The effective beam area is typically of the order of several squared, centimetres. We note that the target thickness required to stop the beam is relatively small, i.e. of the order of 4 mm for $E_p$=25 MeV. The thermal conductivity of Beryllium is large (k=2.18 $W.cm^{-1}.°\ C.^{-1}$) and its melting point conveniently high (1278° C.). Over the thickness L chosen equal to the particle range, the temperature drop ΔT due to conductivity, for a surface power density q due to the beam ($W/cm^2$), is given by ΔT=qL/2k, neglecting the variation of the ionisation losses due to the Bragg peak (including this small effect will actually improve the situation since the energy losses are largest at the end of range, which is closer to the cooling region). Setting $q=5\times10^3$ $W/cm^2$ and L=0.4 cm, we find ΔT=458° C., which is adequate. Cooling of the face of the target opposite to the beam can be performed in a variety of ways. Assuming water circulation (it has been verified that the presence of the water coolant has negligible effects on the neutronics of the device), the required water mass flow w is $w=W_{beam}/\Delta T_c\rho_c$, where $W_{beam}$ is the beam power (Watt), $\Delta T_c$ is the allowed temperature change of the coolant and $\rho_c$ (4.18 $Joules/cm^3/°$ C.) the heat capacity of the water coolant. Setting $W_{beam}$=25 kWatt (1 mA @ 25 MeV), $\Delta T_c$=70° C., we find w=0.085 litre/sec, which is a modest value.

For higher beam powers, it is convenient to tilt the target face with respect to the beam direction. If ϕ is the incidence angle of the beam on the target plane (ϕ=90° for normal incidence), the actual target thickness is reduced by a factor L×sinϕ, and the beam surface power density by a factor q×sinϕ, with consequent advantages in the target heat conductivity and cooling surface.

3.3.—Neutron Emitting Radioactive Sources

Two types of standard neutron sources appear interesting. In the first type of sources, the neutrons are produced by the (α,n) reaction on Beryllium mixed as powder with a pure α-emitter, like for instance $^{241}$Am, $^{238}$Pu, $^{244}$Cm and so on. The main disadvantage of this source is the small neutron yield, typically $2.1\times10^6$ neutrons/s for 1 Curie of α-source. Therefore, a pure α-emitter of as much as 500 Cie is required to achieve the flux of $10^9$ n/sec. The decay heat generated by such a source is 17.8 Watt.

Another attractive type of source is an Actinide with high probability of spontaneous fission, like for instance $^{252}$Cf, which is an α-emitter with 3.1% probability of spontaneous fission, thus generating 0.031×2.8=0.087 fission neutrons at each disintegration. The above-quoted flux is then obtained with a much smaller source, of $10^9/(3.7\times10^{10}\times0.087)$=0.311 Cie. The half-life of the source is 2.64 years. For instance, a 10 Cie source of $^{252}$Cf produces $3.2\times10^{10}$ neutrons/s, which has sufficient intensity to produce 0.01 GBq samples of $^{99m}$Tc with a natural Molybdenum activator of 20 gram. In some diagnostic applications (see Table 9), smaller activities may be sufficient.

Intermediate between the performance of the Accelerators and of the sources are the D-T high voltage columns, which produce 14 MeV neutrons at some 300 keV, with the reaction (d,n) on a Tritium-enriched target.

3.4.—High Energy Accelerators

Much higher neutron fluxes are possible with proton beams of high energy impinging a Spallation target. High energy protons will simply be absorbed in the Lead Buffer Layer, which will also act as spallation target. In view of the large power deposited by the beam on a relatively large volume of the spallation target, appropriate design is required. For high-beam powers $E_0$, the best arrangement is the one of liquid metal target. This technology and. associated geometry will be discussed later on. The spallation neutron yield produced by a high energy proton in a Lead Block of the indicated size is listed in Table 5, as a function of the incident proton kinetic energy $E_p$.

TABLE 5

Neutron yield with energies >1.0 MeV, integrated over all angles for the spallation process in Lead induced by a high-energy proton

| $E_p$ (MeV) | $n_0$ | $S_0$ (n/sec/mA) | $E_0$ (kWatt) for $3\ 10^{16}$ n/s | $i_p$ (mA) for $3\ 10^{16}$ n/s | Φ ($cm^{-2}s^{-1}mA^{-1}$) (r = 30 cm) |
|---|---|---|---|---|---|
| 100.0 | 0.399 | 2.49E15 | 1203.0 | 12.03 | 6.55E12 |
| 150.0 | 0.898 | 5.61E15 | 801.8 | 5.35 | 1.47E13 |
| 200.0 | 1.788 | 1.12E16 | 536.9 | 2.68 | 2.93E13 |
| 250.0 | 2.763 | 1.73E16 | 434.3 | 1.74 | 4.54E13 |
| 300.0 | 4.156 | 2.60E16 | 346.5 | 1.15 | 6.82E13 |
| 350.0 | 5.291 | 3.31E16 | 317.5 | 0.91 | 8.68E13 |
| 400.0 | 6.939 | 4.34E16 | 276.7 | 0.69 | 1.14E14 |

The neutron multiplicity $n_0$, defined as the average number of neutrons produced for each incident proton of kinetic energy $E_p$, is a rapidly rising function of the proton energy, which can be fitted above 100 MeV with an approximate empirical formula $n_0 3.717\times10^{-5}\times E_p^2+3.396\times10^{-3}\times E_p$ with $E_p$ in MeV. The integrated specific neutron yield $S_0$ is a correspondingly fast rising function of $E_p$, of the order of $1.12\times10^{16}$ n/sec/mA at $E_p$=200 MeV. At this energy, a beam current $i_p$ of the order of $i_p$=2.68 mA is required for a neutron yield of the order of $S_0=3.0\times10^{16}$ n/sec.

It is therefore possible to achieve fluxes which are at least two orders of magnitude higher than the ones of the intermediate energy accelerator. The neutron flux ϕ at r=30 cm from the centre, where the activation sample is normally located, is of the order of $0.78\times10^{14}$ $n/cm^2/sec$, quite comparable with the flux of a large Power Reactor. Taking into account the fact that the capture process is greatly enhanced by resonance crossing (see Formula [10]), it is evident that our method becomes largely competitive with Reactor-driven activation. This is in particular valid for $^{99}$Mo ($^{99m}$Tc), which is plagued by a very small capture cross-section of 140 mb for thermal (reactor) neutrons, and for which the alternative but much more complicated extraction from the $^{235}$U-fission fragments from a Reactor is currently used.

Evidently, these currents and energies are appropriate for an industrial implantation for large scale production of radioisotopes, and in particular of $^{99}$Mo ($^{99m}$Tc), for which a large market exists. The activated Molybdenum (half-life of 65 hours), as described later on, is transported to the point of use (Hospital) with the help of an Alumina container, from which the $^{99m}$Tc is extracted whenever needed.

An industrial Accelerator capable of producing a beam energy of the order of several mA at an energy of the order of 150 to 200 may consist in a compact cyclotron of modest size (radius=few meters) fed with a High Voltage column of about 250 keV, as suggested by P. Mandrillon. Negative ions ($H^-$) are accelerated instead of protons, since the extraction can be easily performed with a stripper. An alternative Accelerator design, proposed by LINAC SYSTEMS (2167 N. Highway 77 Waxahachie, Tex. 75165, USA), foresees a compact (average gradient 2 MeV/m) LINAC which is capable of currents of the order of 10 to 15 mA at energies in excess of 100 MeV.

As already pointed out, the considerable beam power to be dissipated in the Spallation-Target diffuser suggests the possibility of using molten Lead (melting point 327° C.) or a eutectic Lead-Bismuth (melting point 125° C.) target. The operation is facilitated by the fact that the energy of the beam, because of its higher proton energy and range, is distributed over a considerable length. The liquid flow and the corresponding cooling can be realised with the help of natural convection alone. Power in excess of 1 MWatt can be easily dissipated in the flowing, molten metal. The operating temperature is of the order of 400° C., temperature at which corrosion problems are minimal. The beam penetrates the molten liquid environment through a window. In order to avoid damage to the window due to the beam, the beam spot at the position of the window is appropriately enlarged, typically over a diameter of some 10 cm.

The neutron yields $S_0$ achievable by proton Accelerators and different targets for a 1 mA proton current are summarised in FIG. 8. The alternatives of a Beryllium target and of a heavy Spallation target are displayed.

3.5—Leakage Neutrons from a Fission Drive Core

We refer to the configuration for simultaneous elimination of the TRU waste and of the. Transmutation of long-lived FF's according to the previously described scenario (Paragraph 1.4). The source is preferably an Energy Amplifier (EA), although a Fast Breeder (FB) configuration may also be employed.

In this scenario, the transmutations of both offending kinds of waste must be performed concurrently, namely at rates which are predetermined by the composition of the waste which has to be decontaminated. As already pointed out in paragraph 1.5, this implies that the product of the fraction $\alpha_t$ of the fission neutrons which are made available for transmutation and of the fraction $\alpha_f$ of these neutrons which are actually captured in the impurity, be of the order of $\alpha_t \times \alpha_f = 0.106$. In practice it is possible to "leak out" of the order of 20 to 25% of the neutrons of the core, without affecting appreciably the TRU incineration process which demands a sub-critical multiplication constant of the order of k=0.96 to 0.98.

Similar considerations apply to a Fast Breeder, though the requirement of full criticality may be more demanding in terms of neutrons destined to the Core. This implies that $\alpha_f \geqq 0.5$, which is a large number, but, as we shall see, achievable with the present method.

4. Description of the Activator

The practical realisation of the activation device is schematically illustrated in FIG. 7*a* for the intermediate energy beam, and in FIG. 7*b* for the high energy beam and spallation source, respectively. Dimensions are approximate and they are not critical. The overall shape has been chosen somewhat arbitrarily to be cylindrical of roughly equal dimensions in the three axes (length=diameter). Obviously, any other shape is also possible. The device may be divided in a number of concentric functional layers, starting from the centre, where the neutron producing target is, located.

(1) In the case of FIG. 7*a*, the Target 1, assumed to be of small size, is hit by the beam 8 of the Accelerator, transported through the evacuated Beam Channel 2. Of course, the Beam Channel 2 is unnecessary if the neutrons, are produced by a radioactive source. In the latter case, the tube 2 may be needed to extract the source from the device.

The Beam Channel is surrounded by a first Buffer Layer 3. The purpose of this layer ($r_0 \approx 25$ cm of Lead, but not critical) is to provide a first diffusion V enhancement and isotropisation of the neutron flux from the source. The distribution of the flux is made largely independent of the actual angular distribution of the neutron-producing reaction.

Most of the possible neutron sources have an energy spectrum which extends to several MeV, much too high to lead to a practical activation. The buffer layer provides as well a first substantial and quick reduction in the energy spectrum, which is naturally achieved through inelastic scattering processes like (n,n'), (n, 2n), (n,3n) and so on. These last two processes introduce as well a small but significant increase of the flux by neutron multiplication, typically of the order of several percent and which is enhanced for higher energy sources, like for instance in the case of 14 MeV neutrons from the D-T production reaction. At the exit of the Buffer Layer, the energy spectrum in the capture resonance region of the samples has become largely independent of the nature and initial spectrum of the source.

The ideal material for the Buffer Layer is Lead or Bismuth, because of its small, diffusion coefficient D, large transparendy below the inelastic threshold (the Buffer layer must also be very transparent to the lower energy neutrons which diffuse throughout the volume of the Activator) and large inelasticity of the cross-sections in the MeV range.

In the case of high energy Accelerator and Spallation, neutrons (see FIG. 7*b*), the beam 9 traveling in an evacuated pipe 10 is sent-directly through a Window 11 to the Molten Lead 12 which acts simultaneously as (thick) Target and Buffer. Because of the considerable power dissipated by the beam (up to several hundreds of kWatt), the Target/Buffer Layer is best realised, with molten Lead, or eutectic Lead/Bismuth mixture. The molten liquid is circulated by natural convection at speeds of the order of 1 m/s through a pipe 13 in which are inserted a Heat Exchanger 14 and a Supplementary (electric) Heater 15, in order to ensure circulation and a temperature adequate to prevent the liquid from solidifying also when the Accelerator is off. The rest of the Activator Block 16 is in accordance with that of FIG. 7*a* and with, e.g., the parameters of Table 6.

(2) The Activation Region 4 surrounds the Buffer Layer. In such a region—again best realised with Lead because of its small D value and high neutron transparency—are embedded the samples to be activated, for instance inside narrow, thin tubes. Samples must be easily introduced and extracted from the block with a suitable tool, such as a pantograph tool. These samples must be finely distributed over the whole volume of the Activation Region in order (i) to make use of the whole flux. In correspondence with very strong resonances, the sample becomes completely absorptive, and all neutrons having the appropriate energy within the volume are absorbed. If the sample is concentrated in a small volume, only the relatively few neutrons present within the volume with the right energy will be absorbed. This can cause saturation phenomena.

(ii) to avoid self-screening of the sample in the large cross-section energy regions which are the most efficient in the activation.

The sample holders may need structural supports. For this purpose, low-activation, neutron-transparent materials like for instance Steel, Zircalloy or Carbon compounds or, preferably, some more Lead should be used. The thickness of the Activation layer 4 may be application-dependent. Typically, it may be a layer of thickness $r_1$ in the 5-10 cm range, concentric to the Buffer Layer 3. Since the scattering length in Lead is very short, the conditions of absorption by the resonance do not propagate appreciably from the point of occurrence. The absorption of neutrons at the (strong) resonances of the sample is a "local" phenomenon.

(3) The device must be as compact as possible. If the outer volume were to be completed only with diffusing Lead, because of its small lethargy it would become rather bulky and require many hundreds of tons of material. Furthermore, since the energy losses occur in very small steps and the resonance integral is not negligible, this lengthy process would produce a significant depletion in the flux due to resonant self-absorption in the Lead itself. On the other hand, as pointed out, the activation of the wanted sample is a local condition which does not immediately propagate in the whole device. Therefore, one can introduce a Moderation Region 6 made of a thin ($\Delta r$ in the 5-10 cm range, d=2.25 g/cm$^3$) region made for instance with Carbon (Graphite) immediately beyond the Activation Volume 4, preferably preceded by a thin ($r_2$ of the order of a few centimetres, i.e. $r_2$>D) Lead Buffer Layer 5. The presence of the Moderation Region 6, acting both as a "reflector" and as an "energy moderator" has very beneficial effects on the energy spectrum in the Activation Volume.

In FIG. 9, the calculated differential energy spectrum in the Activation Region is plotted in the variable dn/d(log(E)) since, in this variable and for an idealised iso-lethargy behaviour, it is constant and energy-independent: deviations from flatness imply changes from iso-lethargic ideal behaviour. The four curves correspond to different thicknesses of the Carbon layer, $\Delta r$=0, 2.5, 5.0 and 15.0 cm, respectively. It is noted that, in the energy region where resonances are expected, the flux is substantially enhanced with respect to the case of zero thickness of the Carbon layer. A broad optimum is achieved for a thickness $\Delta r$ of the order of 5 to 10 cm. If larger thicknesses are used, the thermal energy peak becomes prominent. The activation probability for a given (weak) sample, for instance in the case of $^{127}$I, is more than doubled with the use of a 5 cm Carbon Layer. The overall size of the device is also substantially reduced.

The alternative of a Moderation region between the Buffer Layer and the Activation region has also been explored and it gives much worse results. The conclusion of these studies is that the thickness of the Moderation Region, within reasonable limits, is not critical with respect to the flux in the resonance region. A thicker Carbon moderator enhances the fraction of neutrons in the thermal region. The optimal amount of thermal neutron captures depends evidently on the actual energy and location of the resonances of the sample. A very thick Carbon slab will quickly move the spectrum to thermal energy, which could be beneficial in some cases. At any rate, the use of Lead near the sample is recommended in all cases, since it produces the best flux enhancement.

(4) The Moderation Region is followed by a Lead Reflector 7, and the whole device is enclosed in a thick Iron Box (not shown) to guarantee mechanical stiffness and shield the remaining neutrons. Additional, absorbing material, like concrete or similar materials, possibly loaded with Boron to efficiently capture the few escaping neutrons may be used to ensure full radio-protection of the device.

The actual dimensions of a typical device are listed in Table 6, with reference to some specific activation tasks. In practice, some of the parts may be fixed and some others may be changed according to the application which is selected. The neutron spectra in the various parts of the Activator, plotted in the variable dn/d(log(E)) are shown in FIG. 10 for the parameters of Table 6 and no appreciable capturing sample. One can remark the general, remarkable flatness of the spectra, showing that the system is close to the idealised iso-lethargy conditions. The flux is roughly constant in the central region, and it drops in the Lead Reflector 7 and even more in the Iron Box. The sharp peaks are due to resonant behaviour of Lead and Iron of the Activator.

TABLE 6

Typical dimensions of the components, as used in the computer simulations. All elements are concentric cylinders, see FIG. 7a.

| | Material | Outer length (cm) | Outer radius (cm) | Remarks |
|---|---|---|---|---|
| Beam Tube 2 | Steel | | 4.0 | Thin, evacuated tube |
| Buffer Layer 3 | Lead | 80 | 25 | |
| Activator 4 | Lead + Sample | 80 | 30 | Samples inserted inside |
| Lead Buffer 5 | Lead | 90 | 35 | |
| C- Moderator 6 | Graphite | 100 | 40 | average density 1.9 gr/cm$^2$ |
| Out Reflector 7 | Lead | 200 | 90 | |
| Containing Box | Steel | 300 | 120 | Shield & support |

5. Performance of a Typical Activator

5.1.—Applicability of the Method

In order to exemplify our method, the performance of the Activator for medical isotope production is briefly summarised.

As already pointed out, transmutation rates are largely independent of the chemical binding and isotopic composition of the materials inserted in the Activator. They are also almost independent on the source geometry and on the process used for the neutron production, provided that the initial neutron energy is sufficiently high (>0.4 MeV). The asymptotic activation, in GBq/gram, of the activation material as a function of the neutron yield from the source is shown in FIG. 11 for the specific examples discussed above.

The main radio-isotopes used in Medicine and the corresponding domains of application are listed in Tables 7, 8 and 9. We shortly review these applications, in the light of the new possibilities offered by the Activator.

A main change which becomes possible is the systematic replacement in the Iodine applications related to diagnosis with the much short-lived $^{128}$I, with the following main advantages:

(1) the much smaller dose to the patient, essentially limited to the time of the examination, since the half-life is only 25 m.

(2) the possibility of activating in situ an already prepared appropriate chemical compound of pharmacological quality, which is directly introduced in the patient after passing through the Activator for a short exposure (the radiation damage of the preparation is negligible, in view of the shortness of the neutron exposure).

The decay scheme of the $^{128}$I has a 7% electron capture probability with K-shell soft photons, which makes it similar to $^{123}$I (which has also a γ-line at 159 keV (83.3%)). The rest is a β-γ transition with <Eβ>=737 keV and with a γ-line at 442.9 keV (16.9%). It is also similar to $^{131}$I (with $^{131}$Xe (11.9 d)), which has a γ-line at 364.8 keV (81.2%) and <Eβ>=182 keV. Therefore, these three elements have all similar diagnostics potentials, for which the γ-lines are relevant. Table 7 summarises the diagnosis data relative to Iodine radio-isotopes. The variety of products used and the general applicability of the Pre-activation method are to be emphasised.

TABLE 7

Main Diagnosis Applications of $^{131}$I (half-life 8.02 days, γ-line at 364.8 keV (81.2%)) and of $^{123}$I (half-life 13.2 hours, decay mode EC and a γ-line at 159 keV (83.3%)).

| PROCEDURE | Iodine-based preparation | DOSE (GBq) | Suggested Method |
|---|---|---|---|
| TUMOR | $^{131}$I-varies | varies | $^{128}$I Activation of preparation |
| ADRENAL CORTEX | $^{131}$I-iodomethyl-norcholesterol | 0.555-0.74 | $^{128}$I Activation of preparation |
| ADRENAL MEDULLA | $^{131}$I-miodobenzyl guanidine | 0.0018 | $^{128}$I Activation of preparation |
| KIDNEYS | $^{131}$I-oiodohip-purate (HIPPURAN) | 0.00074-0.00148 | $^{128}$I Activation of preparation |
| THYROID UPTAKE | $^{131}$I-sodium iodide | 0.000018 | $^{128}$I Activation of preparation |
| TUMOR | $^{131}$I-sodium iodide | 0.185-0.37 | $^{128}$I Activation of preparation |
| THYROID SCAN (substernal) | $^{131}$I-sodium iodide | 0.00015-0.00037 | $^{128}$I Activation of preparation |
| THYROID SCAN (body survey) | $^{131}$I-sodium iodide | 0.37 | $^{128}$I Activation of preparation |
| BRAIN PERFUSION | $^{123}$I-HIPDM ** | 0.185 | $^{128}$I Activation of preparation |
| BRAIN PERFUSION | $^{123}$I-IMP | 0.111-0.185 | $^{128}$I Activation of preparation |
| ADRENAL MEDULLA | $^{123}$I-miodobenzyl-guanidine | 0.185-0.37 | $^{128}$I Activation of preparation |
| THYROID SCAN | $^{123}$I-sodium iodide | 0.00148 | $^{128}$I Activation of preparation |
| THYROID UPTAKE | $^{123}$I-sodium iodide | 0.00074 | $^{128}$I Activation of preparation |

TABLE 8

Main Therapy Applications of $^{131}$I (half-life 8.02 days, γ-line at 364.8 keV (81.2%)).

| PROCEDURE | I-based product | DOSE (GBq) | Suggested Method |
|---|---|---|---|
| THYROID THERAPY (carcinoma) | sodium iodide | 3.7-8.325 | $^{131}$I production by $^{130}$Te (n, γ), Fissium |
| THYROID THERAPY (Graves) | sodium iodide | 0.185-0.37 | $^{131}$I production by $^{130}$Te (n, γ), Fissium |
| THYROID THERAPY (hot nodule) | sodium iodide | 0.925-11.063 | $^{131}$I production by $^{130}$Te (n, γ), Fissium |

TABLE 9

Main Diagnosis Applications of $^{99m}$Tc.

| PROCEDURE | $^{99m}$Tc-BASED PRODUCT | DOSE (Gbq) |
|---|---|---|
| LYMPHO-SCINTIGRAPHY | antimony trisulfide colloid ** | 0.0018-0.74 |
| SPLEEN | damaged RBC's | 0.185 |
| KIDNEYS | dimercaptosuccinic acid (DMSA) | 0.185 |
| HEPATOBILIARY | disofenin (DISIDA) | 0.111-0.296 |
| BRAIN LESIONS | DTPA | 0.555-0.925 |
| KIDNEYS | DTPA | 0.37-0.555 |
| LUNG VENTILATION | | 0.185 |
| BRAIN PERFUSION | ECD | 0.555-0.925 |
| BRAIN LESIONS | glucoheptonate | 0.555-0.925 |
| KIDNEYS | glucoheptonate | 0.185-0.37 |
| HEPATOBILIARY | HIDA | 0.111-0.296 |
| BRAIN PERFUSION | HMPAO | 0.555-0.925 |
| (BLOOD POOL) | human serum albumin (HSA) | 0.555-0.925 |
| BONE IMAGING | hydroxymethylenedi-phosphonate (HDP) | 0.555-0.925 |
| ABSCESS | leukocytes | 0.37-0.555 |
| VENOGRAM | MAA | 0.185-0.37 |
| LUNG PERFUSION | macroaggregated albumin (MAA) | 0.074-0.148 |
| HEPATOBILIARY | mebrofenin (CHOLETEC) | 0.111-0.296 |
| KIDNEYS | mercaptoacetyltri-glycine (MAG3) | 0.185 |
| BONE IMAGING | methylenediphos-phonate (MDP) | 0.555-0.925 |
| SPLEEN | MIAA | 0.185-0.37 |
| BONE MARROW | MIAA 510 | |
| LIVER | microaggregated albumin (MIAA) | 0.185-0.37 |
| GASTRIC EMPTYING | oatmeal (solid phase) | 0.0011-0.0018 |
| GASTRIC EMPTYING | ovalbumin (solid phase) | 0.0011-0.0018 |
| BRAIN LESIONS | pertechnetate | 0.555-0.925 |
| CYSTOGRAM | pertechnetate | 0.444 |
| MECKEL'S DIVERTICULUM | pertechnetate | 0.37 |
| PAROTIDS | pertechnetate | 0.37 |
| THYROID SCAN | pertechnetate | 0.37 |
| TESTICLES | pertechnetate (Torsion) | 0.555 |
| INFARCT (MYOCARD.) | PYP | 0.555-0.925 |
| BONE IMAGING | pyrophosphate (PYP) | 0.555-0.925 |
| CARDIOVASCULAR | RBC's | 0.555-0.925 |
| HEMANGIOMA | RBC's | 0.555-0.925 |
| TESTICLES | red cells (Varicocele) | 0.925 |
| GASTRIC EMPTYING | resin beads in food (solid phase) | 0.0011-0.0018 |
| (MYOCARDIUM) | sestamibi | 0.555-0.925 |
| PARATHYROIDS | sestamibi | 0.37 |
| BONE MARROW | sulfur colloid | 0.185-0.37 |
| CYSTOGRAM | sulfur colloid | 0.444 |
| GE REFLUX | sulfur colloid | 0.0011-0.0018 |
| LIVER | sulfur colloid | 0.185-0.37 |
| LYMPHO-SCINTIGRAPHY | sulfur colloid | 0.00185-0.74 |
| SPLEEN | sulfur colloid | 0.185-0.37 |
| (MYOCARDIUM) | teboroxime | 0.555-0.925 |

The main Therapy applications of Iodine compounds are listed in Table 8. Doses are much higher and the shortness of the. $^{128}$I will require correspondingly larger activities of the injected sample. Therefore, $^{131}$I produced by Te activation in general seems more appropriate.

The dominant use of radio-isotopes in Medicine is presently concentrated on the use of $^{99m}$Tc, as shown in Table 9. As already discussed, our activation method can produce large amounts of $^{98}$Mo activation, and therefore all these procedures can be in general performed with the proposed Activator.

The activation method may be used to produce as well several other products. The activation reaction by neutron capture cannot be easily used to produce a variety of isotopes, amongst which $^{67}$Ga, $^{111}$In, $^{81}$Kr, $^{82}$Rb and $^{201}$Tl, and the short-lived positron emitters for PET scans, for which charged particle activation are preferable. The general availability of a particle accelerator could however foresee their production as well, but with conventional methods.

5.2.—Choice of the Accelerator

The performance of the device is of course determined is by the choice of the accelerator. We assume two schematic configurations:

(1) a "local" production of radio-isotopes within the premises of a Hospital, in which presumably the Accelerator is also used to produce PET isotopes by direct irradiation or other therapy programmes. The Activator is used to produce $^{128}$I and $^{99}$Mo ($^{99m}$Tc) The amount of $^{99m}$Tc required for a single analysis is typically of the order of 1 Gbq. The simple extraction process from Molybdenum is performed near the Accelerator. The Accelerator is a compact cyclotron or a LINAC with 23 MeV protons, and the nominal current of 1 mA. The target is a thick, Beryllium target, water-cooled to absorb the beam-dissipated power (23 kWatt). The beam is spread over a surface of the order of a few square centimetres, to facilitate cooling. According to Table 4, the integrated yield is $S_0=1.66\times10^{14}$ n/sec. The Activator has the geometry described in Table 6. With the help of an appropriate insertion tool, such as a pantograph tool, several different targets can be simultaneously inserted in the device.

(2) a "regional", industrial scale production of radio-isotopes, to be transported and used in the appropriate form at different Hospitals, located relatively near the activation plant. The transport time excludes the use of $^{128}$I, and $^{131}$I is to be used instead. We remark that for Thyroid therapy, rather than diagnosis, a large dose (up to 10 Gbq, see Table 8) must be given to the patient, and therefore the use of $^{131}$I has less counter-indications than in the case of diagnosis, where obviously the dose must be minimal and for which, as already pointed out, the use of $^{128}$I, is preferable. In addition, we have considered the production of $^{99}$Mo ($^{99m}$Tc) which can be transported in a Alumina dispenser, following the standard procedure used today. The amount of initial $^{99}$Mo activation required is of the order of 10 to 100 Gbq. In order to limit the mass of Molybdenum and hence the one of the Alumina in the transport, the activation density must be as large as possible. It is therefore assumed that a larger Accelerator is used and that neutrons are produced by the spallation process on Lead or eutectic Pb/Bi mixture. These complications are acceptable in view of the larger, "factory"-type scale of the operation and the larger amounts of radio-isotopes to be produced. The Accelerator is a compact cyclotron or a LINAC with 200 (150) MeV protons and the nominal current of 2.68 (5.35) mA, resulting in an integrated neutron yield, $S_0=3.0\times10^{16}$ n/sec. The beam power to be dissipated in the molten metal target is 537 (802) kWatt. The Activator has the geometry described in Table 6, but with a significantly enlarged Buffer Layer to allow for the installation of the spallation Target. With the help of an appropriate insertion tool such as a pantograph tool, as in the previous case, several different targets can be inserted in the device.

Since the fraction of the neutrons used for the activation is extremely small, many samples can be simultaneously irradiated in the Activator.

5.3.—Production of $^{99m}$Tc from a Molybdenum Matrix

The target is made either of isotopically enriched $^{98}$Mo or, if this is not available, of Natural Molybdenum containing 24.13% of $^{98}$Mo, in a chemical form discussed later on. The short-lived $^{99}$Mo ($r_{1/2}$=65.94 h) is activated, in turn decaying into 99$^m$Tc. The Mo must be very pure. In particular, it must not contain Rhenium, which complicates the extraction of Molybdenum, since Rhenium has chemical properties similar to those of Technetium. In general, the presence of impurities may lead to unwanted radio-nuclides. The yield of $^{99}$Mo according to Table 3 and for a constant irradiation of 1 gram of $^{98}$Mo (4 g of Natural Mo) for a time t is $1.66\times10^{-6}\times[1-\exp(-t/95.35\ h)]\times S_0$ GBq, where $S_0$ is the neutron yield of the source. For a continuous exposure of 100 hours, $1.07\times10^{-6}\times S_0$ GBq/gr of $^{99}$Mo are activated.

The extraction of Technetium (1 GBq of $^{99m}$Tc corresponds to 5.13 ng of metal) out of Molybdenum matrix is a relatively simple process, vastly documented in the literature (see, for instance, A. K. Lavrukhina and A. A. Pozdnyakov, "Analytical Chemistry of Technetium, Promethium; Astatine and Francium", Academy of Sciences of the USSR, Israel Program for Scientific Trenslations, Jerusalem 1969; and also R. D. Peacock, "The chemistry of Technetium and Rhenium" Elsevier Publishing Company, 1966).

Though it is not part of the activation procedure, for completeness we briefly mention the separation on organic sorbents, especially Aluminium Oxide ($Al_2O_3$) which is widely used. An efficient process of extracting micro-amounts of $^{99m}$Tc from irradiated Molybdenum has been discussed by Mixheev N. B., Garhy M. and Moustafa Z., Atompraxis, Vol 10 (264), 1964. These authors propose that Molybdenum be sorbed by $Al_2O_3$ as anion $H_4[P(Mo_2O_7)_6]^{3-}$. The exchange capacity is about 8 gr/100 gr of $Al_2O_3$.

According to this last method, the irradiated Molybdenum in the form of Sodium phosphomolybdate is converted into the complex salt $K_3H_4[P(Mo_2O_7)_6]nH_2O$ by the reaction with KCl at pH 1.5 to 2.0. The precipitate is dissolved in 0.01 N HCl at 50° C. and the solution obtained is passed through a column filled with $Al_2O_3$ which has been washed by 0.1 N HCl. The phosphomolybdate colours the sorbent yellow.

To elute the $^{99m}$Tc, an isotonic NaCl solution is used. When 40 ml (figures refer to a 10.5 cm×0.5 cm column filled with 20 gr of $Al_2O_3$ ) of the elutent are passed, about 70 to 80% of the $^{99m}$Tc is eluted from the column. The purity of the element is 99.9%. To elute the Molybdenum from the column, 10 to 20 ml of 0.1 N NaOH are used. The recovered Molybdenum can be re-injected in the Activator. Evidently, columns of different sizes can be used, depending on the specific activity required, and taking into account the exchange capacity.

In order to limit to a minimum the handling of radioactive products, it is convenient to insert directly in the Activator the complex salt $K_3H_4[P(Mo_2O_7)_6]nH_2O$. In this way, after irradiation, the activated compound can be simply inserted in the $^{99m}$Tc dispenser, without chemical handling. After the activity of the $^{99}$Mo has decayed below useful level, the salt is recovered (eluted) with 0.1 N NaOH, resulting in Sodium phospho-molybdate, which is regenerated with the above-mentioned reaction with KCl at pH 1.5 to 2, thus closing the cycle. Therefore, the target material can be reused indefinitely.

TABLE 10

Parameters of the Tc separator with Alumina (from Mixheev N. B. et al, Atompraxis, Vol 10 (264), 1964)

| | | |
|---|---|---|
| Alumina | $Al_2O_3$ | 20 gr |
| Exchange capacity | Mo | 1.6 gr |
| Mo adsorbed | Mo | 160 mg |
| Solution | 0.01 KCl | 250 ml |
| Column diameter | | 0.5 cm |
| Column length | | 10.5 cm |
| Chromogram strip | | 1 cm |
| Elutent | NaCl | 40 ml |
| Extracting | NaOH | 15 ml |

An obvious drawback of using complex compounds in the Activator is the possible creation of spurious elements. The main radio-contaminants produced in the salt $K_3H_4[P(Mo_2O_7)_6]nH_2O$ are $^{32}P$ ($\delta$=0.00968, $\tau_{1/2}$=14.26 d) and $^{42}K$ ($\delta$=0.0381, $\tau_{1/2}$=12.36 h), where $\delta$ is defined as the activity with respect to $^{99m}Tc$ in the sample after a long (asymptotic) irradiation and for a natural Molybdenum target. These small contaminants are not expected to be appreciably eluted in the $^{99m}Tc$ sample. If the highest purity is needed, obviously it would be best to use either metallic Molybdenum or oxide, $MoO_3$. The compound can be in transformed into the complex salt after irradiation, using the previously described procedure to extract $^{99m}Tc$ or, alternatively, the extraction of $^{99m}Tc$ can be performed directly from the irradiated sample, for instance using an inorganic sorbent, such as Aluminium oxide as in the previous example. The procedures are described in W. D. Tucker, M. W. Green and A. P. Murrenhoff, Atompraxis, Vol 8 (163), 1962, for metallic Mo, and in K. E. Scheer and W. Maier-Borst, Nucl. Medicine Vol. 3 (214), 1964 for $MoO_3$.

In the alternative (1) of local production of $^{99m}Tc$ (point 2 in FIG. 11), the time delay between production and use is relatively short, but the activation is correspondingly smaller, because of the lower intensity and energy of the accelerator. Assuming indicatively a loss of activity of a factor 2 for handling delays, and a final sample of 1 Gbq, with the indicated irradiation of 100 h of a 23 MeV, 1 mA beam, we arrive at a sample of $^{98}Mo$ of 11.26 g (46.6 g of Natural Mo). Elution of $^{99m}Tc$ from this sample will require 140 g (590 g) of Alumina, according to figures of Table 10. Though this column is probably too large for a portable dispenser, it is perfectly adequate for a fixed installation. The final solution of $^{99m}Tc$ can be easily concentrated before use, evaporating the excess water for instance under vacuum.

The alternative (2) of a portable dispenser (point 3 in FIG. 11) is primarily characterised by a correspondingly smaller Alumina volume and hence a higher Mo activation. With the figures given above for the accelerator, and for an initial $^{99}Mo$ activity of 50 GBq (the commercial Elutec™ Technetium Generator offers activation from 6 to 116 Gbq, calibrated on the 4th day after production), we find a sample of $^{98}Mo$ of 1.56 g (6.4 g of Natural Mo), which will fit within the parameters of the Table 10. In view of the larger scale of the operation, it would be possible to irradiate a sample of $MoO_3$, which is free of spurious activation and to transform the oxide into salt before introducing it into the Alumina dispenser. As before, the Mo could be recycled repetitively in the Activator, once the produced activation has sufficiently decayed, eluting it from the Alumina with the appropriate NaOH elutent. It has been verified that the activity of long-lived radio-nuclides, which could eventually accumulate in the sample is not appreciable.

5.4.—Activation of $^{128}I$ from Natural Iodine

The short life of the $^{128}I$ ($\tau_{1/2}$=24.99 m) precludes the transport, so that only the accelerator option (1) is retained (point 1 in FIG. 11). Fortunately, the resonance integral of $^{127}I$, is very large $I_{res}$=148 b, and therefore the activation is very efficient, even for relatively low neutron fluxes. Assuming an activation exposure of 30 min (½ of asymptotic activation), followed by a pause of 30 minutes before the imaging procedure (50% surviving), the activation is of 1.1 Gbq/gr, which is largely adequate. Different doses can easily be obtained by changing either the exposure time or the pause between exposure and use.

Calculations have been performed also in the case of $^{127}I$ activation. While the capture probabilities in the body of the Activator (Pb, Fe etc.) are, as expected, unchanged, the capture efficiency in $^{127}I$ leading to $^{128}I$ is $\eta=2.62\times10^{-5}$ $g^{-1}$. The energy spectrum of the captured neutrons (solid line, left-hand ordinate scale) and the integrated capture probability (dotted line, right-hand ordinate scale) are shown in FIG. 12. Again, the resonant captures are dominant. As already pointed out, no chemical action is required, since the sample is already prepared in the appropriate form, and it can be immediately used, as required in view of the short half-life of $^{128}I$ ($\tau_{1/2}$=24.9 m)

Captures in the other elements of the compound must be taken into account. In particular, if Sodium Iodide (NaI) is used, the resonance integral for production of $^{24}Na$, a $\beta$-emitter (the decay is accompanied by two strong $\gamma$-lines (100%) at 1368.6 keV and 2754 keV) with a half-life of 14.95 hours is very small, $I_{res}$=0.26 compared with the value $I_{res}$=148 for Iodine. Calculations give capture efficiencies in NaI of $\eta=1.62\times10^{-7}$ $g^{-1}$ for $^{24}Na$ activation, and of $\eta=2.218\times10^{-5}$ $g^{-1}$ for $^{128}I$ activation, normalised for 1 gram of the NaI compound. The number of activated Na atoms are therefore more than two orders of magnitude less than the Iodine activation, with negligible consequences for the overall dose to the patient. Taking into account the ratio of lifetimes, the counting rate from $^{128}I$ is enhanced by an additional factor 36. Therefore, the spurious effects in the measurements due to the presence of the $^{24}Na$ are also negligible. Most likely it is so also for the other compounds of Table 7.

5.5.—Activation of $^{131}I$ from Tellurium

We have considered the case of production of $^{131}I$ ($\tau_{1/2}$=8.04 d), which is an isotope used widely in thyroid therapy. The activating reaction is neutron capture by $^{130}Te$ which is a relatively abundant isotope of Tellurium (33.87%), but having a small resonance integral, $I_{res}$=0.26 b, with the following reactions:

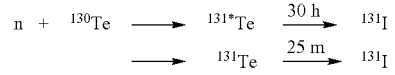

About 10% of captures lead to the isomeric state $^{131*}Te$. The smallness of the resonance integral leads to a small capture probability. Fortunately, the Tellurium is a relatively cheap element (20$/lb), and it permits a simple extraction process for the Iodine produced. Therefore, relatively large amounts of target material can be used. The illustrative extraction method envisaged consists of a simple pyro-metallurgical process in which the ingot of activated element is melted to some 500° C. (melting point 449° C.), either in a crucible or by a simple electron beam device. The Iodine produced is volatised as an element, since the Tellurium Iodide ($TeI_4$) decomposes at such temperatures. The evaporated Iodine is then easily condensed (melting point 113.5°

C.), and thus recovered. This process may be repeated indefinitely, if the ingot is recast to the appropriate shape.

Large amounts of $^{131}I$ ($\tau_{1/2}$=8.04 d) are for instance used in therapy of Thyroid diseases. The activation process proceeds through the neutron capture of an isotope of natural Tellurium, $^{130}Te$ (33.87%, $I_{res}$=0.259 b) . As already pointed out, the relatively small value of the cross-section requires relatively large amounts of target. Since the compound is relatively long-lived, it does not need to be produced locally. Therefore, we consider the accelerator option (2) (point 4 in FIG. 11), though sizeable amounts can also be produced with the conditions of option (1).

We assume an exposure carried out during 12 days with a 10 kg target of natural Tellurium in metallic form, inserted in the form of 32 (cast) cylinders, each 50 cm long and of 0.56 cm radius (50 $cm^3$). The remainder of the activator volume is filled with metallic Lead, in which the holes for the target have beer made. The resulting activated radio-nuclides are listed in Table 11.

In addition to the two obvious isotopes $^{131}Te$ and $^{131m}Te$ which are the father nuclei of $^{131}I$, a number of Tellurium isotopes are produced due to the use of a natural Tellurium target. These activated products remain in the target material during the extraction process. Particularly strong is the decay of $^{127}Te$, though with a relatively short half-life of 9.35 hours. The target material will however remain activated for a relatively long time, due to the presence of $^{121m}Te$ and $^{123m}Te$, with half-life of 154 days and 120 days, respectively. These residual activities may pile up in subsequent irradiations, but with no appreciable consequence. The extracted Iodine is essentially pure $^{131}I$, with a very small contamination of the short-lived $^{130}I$ with a half-life of 12.36 hours, which will be rapidly further reduced by natural decay. In addition, there will be about 6 times as many nuclei of stable $^{127}I$ produced and a negligibly small contamination of $^{129}I$ (half-life 1.57×$10^7$ years). The tiny contamination of $^{131m}Xe$ will be easily separated during the Iodine extraction process. The last isotope in Table 11 is due to the short-lived activation of the Lead of the Activator volume and will not be extracted with the Target material. The total activity at discharge of the essentially pure $^{131}I$ is 7355.42 Gbq (200 Cie).

TABLE 11

Radio-nuclides in the 10 kg natural Tellurium activator volume at the end of a 12 days exposure. The accelerator is option (2).

| Element | Decay mode | Lifetime (1/e) | Activity (GBq) |
|---|---|---|---|
| Tellurium Radio-nuclides | | | |
| $^{121}Te$ | ε | 24.26 d | 422.27 |
| $^{121m}Te$ | IT(88.6%), ε | 222.7 d | 12.04 |
| $^{123m}Te$ | ε | 173.1 d | 1685.06 |
| $^{125m}Te$ | IT | 83 d | 34.64 |
| $^{127}Te$ | $\beta^-$ | 13.52 h | 17892.73 |
| $^{127m}Te$ | $\beta^-$ | 157.6 d | 495.35 |
| $^{129}Te$ | $\beta^-$ | 1.677 h | 306.19 |
| $^{129m}Te$ | IT(64%), $\beta^-$ | 48.59 d | 477.30 |
| $^{131}Te$ | $\beta^-$ | 36.15 m | 214.11 |
| $^{131m}Te$ | IT(22%), $\beta^-$ | 1.808 d | 951.12 |
| Iodine Radio-nuclides | | | |
| $^{131}I$ | $\beta^-$ | 11.63 d | 7355.42 |
| $^{130}I$ | $\beta^-$ | 17.87 h | 51.02 |
| Other Radio-nuclides | | | |
| $^{131m}Xe$ | IT | 17.21 d | 28.02 |
| $^{209}Pb$ | $\beta^-$ | 4.704 h | 121.23 |

As already described, the extraction procedure is performed by volatilising the Iodine content in the target, by melting the metal at about 500° C. In view of the high volatility of Iodine, the extraction should be essentially complete. Tellurium iodide (TeI4) formation is inhibited, since it decomposes at such temperatures. The Iodine is then condensed, while the contamination of Xenon (28.02 Gbq) is separated out and stored until it decays. The extraction process may take of the order of 4-6 hours. After extraction, the metal can be cast again into cylinders, ready for the next exposure. Allowing for a total preparation and handling time of the order of 3 days (surviving fraction 84%), the final sample of $^{131}I$ will have a nominal activity of the order of 6150 GBq.

Assuming instead accelerator option (1) and a 32 kg Tellurium target, the final production rate of 100 Gbq is obtained under the same procedure conditions as above.

Only a very small fraction of the neutrons are captured in the Activator target. Therefore, if deemed necessary, it would be possible to increase considerably the yield by using a correspondingly larger mass of Tellurium target.

5.6.—IC Sources for Interstitial Radiation Therapy

The Interstitial Radiation therapy, known also as brachytherapy, is the direct radioactive seed implant into the tumour. This technique allows the delivery of a highly concentrated and confined dose of radiation directly in the organ to be treated. Neighbouring organs are spared excessive radiation exposure. The radioactive source is usually a low-energy (20 to 30 keV) pure internal conversion (IC) γ-emitter. The lifetime should be long enough to ensure a large tissue dose, but short enough to permit the micro-capsule containing the radioactive product to remain inside the body permanently (capsules must be made of a material compatible with the body tissues). Typical sources used are $^{125}I$ ($\tau_{1/2}$=60.14 d, <Eγ>=27 keV) and $^{103}Pd$ ($\tau_{1/2}$=16.97 d, <Eγ>=20 keV). For $^{103}Pd$, the target can be metallic Rh irradiated with intermediate energy protons (≈20 MeV). The cross-section has a broad maximum of about 0.5 barn around 10 MeV. The yield of $^{103}Pd$ at 23 MeV and thick target (0.75 g/$cm^2$) is 5.20×$10^{-4}$ for one incident proton, corresponding to an activation rate of 132.75 GBq/mA/day. However, the power dissipated in the target is large, 19.6 kWatt/mA. Therefore, if a maximum current of 200 μA is used (4 kwatt in the target), the production rate is the rather modest figure of 26.55 GBq/day (0.717 Cie/day), much smaller than the figures given here for $^{125}I$ and neutron capture (≈600 Cie/day for scenario (2)). Accordingly, $^{103}Pd$ may be better produced in the conventional way, with (p,n) reaction on $^{103}Rh$ (the commercial product is known as Theraseed®-Pd$^{103}$ and it is used in the therapy of cancer of the prostate).

Production of $^{125}I$ can be done with neutron capture of $^{124}Xe$ and the reaction chain $$^{124}Xe + n \longrightarrow {}^{125}Xe + \gamma$$

$$^{125}Xe \xrightarrow{\text{I.C.(16.9 h)}} {}^{125}I$$

The resonance integral of $^{124}Xe$ is very large $I_{res}$=2950 b, and an acceptable capture rate can be realised also with a gaseous target. The capture efficiency $\eta_v$=6.40×$10^{-4}$/litre in pure $^{124}Xe$ at n.p.t. In view of the small fraction of $^{124}Xe$ in natural Xenon, (0.1%), isotopic separation is very beneficial in order to ensure a good, efficiency, also taking into account that the target can be used indefinitely. The calculated neutron spectrum and the capture energy distribution are shown in FIGS. 13*a-b*. Clearly, resonant capture dominates. One can also notice the flux depletion after the (strong) resonance crossing and the structure of the dip in the spectrum.

If natural Xenon is directly activated, the capture efficiency leading to $^{125}I$ is $\eta_v=1.81\times10^{-6}$/litre of Xe at n.p.t. The value is about a factor 3 larger than the one of pure $^{124}Xe$, once corrected for the fractional content (0.1%), since the self-shielding of the very strong resonances in $^{124}Xe$ plays a more important role in the pure compound. The other isotopes in natural Xenon do not produce appreciable amounts of short-lived radioactive isotopes other than Xenon, and therefore do not contaminate the production of Iodine. Since the Xenon is an inert gas, the extraction of Iodine is immediate, because it condenses on the walls of the container. If natural Xenon is used, roughly the same amount of stable Cesium is produced, which is probably extracted with the Iodine. The Cesium is actually slightly contaminated with $^{137}Cs$ which has a half-life of 30.1 years and a negligible activity. Such a contaminant is not present in the case of isotopically-enriched Xenon.

In view of the large capture efficiency, the amount of activated $^{125}I$ can be quite substantial. For instance, in the scenario (2) of the regional accelerator supplying $3.0\times10^{16}$ n/sec, the production rate of $^{125}I$ is of 6.0 Cie/day/litre of target with pure $^{124}Xe$ at n.p.t. A 100 litre Activator at n.p.t will then produce as much as 600 Cie/day of $^{125}I$.

5.7.—Fissium Activation

A considerable number and variety of radio-isotopes are extracted from the fission fragments resulting from the fission of Uranium in a Reactor. The word "Fissium" is used herein to designate the group of elements which are the products of $^{235}U$ fissions.

The present Activator can be loaded with a small amount of Uranium, either natural or preferably enriched of $^{235}U$. Obviously, the target material can be recycled indefinitely. This material can be of the form of metallic Uranium or other compound, for instance Oxide, depending on the requirements of the subsequent extraction chemistry. In this way, practical amounts of Fissium can be produced, far away from criticality conditions and using initially a small sample.

A possible scenario is briefly illustrated. We assume that the target is a small amount of Uranium enriched to 20% of $^{235}U$. The actual geometry used in the calculation was based on a finely subdivided metallic target arrangement for a total mass of about 30 kg. This mass has been chosen in order to ensure the correct representation of the resonance shielding, which is important in the case of Uranium. Typical capture efficiencies for truly infinitesimal amounts of Uranium are about a factor 2 larger than what is quoted in Table 13. The 20% enrichment is set by the requirements of the Non-Proliferation Agreement which limit to 20% the allowed enrichment in order to avoid the possibility of realising a critical mass. Incidentally, the amount of Plutonium which can be produced by this method is negligibly small.

The target must be enclosed in a tight envelope to ensure that there is no leak of Fissium products during the exposure. The efficiencies for capture $\eta$ and Fissium production (fission) $\eta f$ referred to 1 kg of enriched compound are listed in Table 13. Fissions produce additional neutrons which enter in the general neutron economy. The neutron fraction produced is about +1.04% for each kilogram of enriched Uranium, which is very small. Thus, even in the most extreme conditions, of target loading, the device remains vastly non-critical.

Assuming that a specific element is present in the Fissium with an atomic fraction $\lambda$ and that the exposure time $t_{exp}$ and the necessary reprocessing time $t_{rep}$ are both equal to one half-life of such compound, the initial activity for 1 kg of activated sample is given by $2.5\times10^{-10}\,S_0\lambda\eta f$ (Gbq/kg). More generally, for arbitrary times, the activity of the extracted compound at the end of the reprocessing period is given by Equation [2].

In the scenario (2) of the regional accelerator supplying $S_0=3.0\times10^{16}$ n/sec, the production rate for a compound with $\lambda=0.04$, $t_{exp}=t_{rep}=\tau_{1/2}$ and the parameters of Table 6, is 1150 GBq/kg (31.2 Cie/kg) of target.

TABLE 12

Most important Fissium production for 33 kg of 20% enriched Uranium, exposed for 10 days (scenario (1)).

| Element | ½ Life | GBq | Mass (arb. u.) |
|---|---|---|---|
| 77-AS | 1.62 d | 2.278 | 2.214E−7 |
| 83-BR | 2.40 h | 1.686 | 1.092E−8 |
| 88-KR | 2.84 h | 23.52 | 1.911E−7 |
| 85-KR* | 4.48 h | 30.34 | 3.756E−7 |
| 83-KR* | 1.83 h | 6.247 | 3.085E−8 |
| 91-SR | 9.63 h | 832.4 | 2.372E−5 |
| 92-SR | 2.71 h | 30.13 | 2.442E−7 |
| 90-SR | 28.78 y | 1.41 | 1.040E−3 |
| 89-SR | 50.53 d | 222.4 | 7.805E−4 |
| 93-Y | 10.18 h | 978.2 | 3.011E−5 |
| 92-Y | 3.54 h | 317.4 | 3.361E−6 |
| 91-Y | 58.51 d | 234.5 | 9.743E−4 |
| 91-Y* | 0.83 h | 455.4 | 1.116E−6 |
| 97-ZR | 0.70 d | 1330 | 7.089E−5 |
| 95-ZR | 64.02 d | 244.6 | 1.161E−3 |
| 97-NB | 1.20 h | 1433 | 5.431E−6 |
| 95-NB | 34.97 d | 25.14 | 6.517E−5 |
| 95-NB* | 3.61 d | 1.744 | 4.666E−7 |
| 99-MO | 2.75 d | 1830 | 3.884E−4 |
| 99-TC* | 6.01 h | 1724 | 3.335E−5 |
| 105-RU | 4.44 h | 37.81 | 5.732E−7 |
| 103-RU | 39.26 d | 185.6 | 5.856E−4 |
| 106-RU | 1.02 y | 3.038 | 9.389E−5 |
| 105-RH | 1.47 d | 303.1 | 3.659E−5 |
| 103-RH* | 0.93 h | 185.3 | 5.804E−7 |
| 112-PD | 0.88 d | 6.452 | 4.942E−7 |
| 109-PD | 13.70 h | 11.08 | 5.378E−7 |
| 112-AG | 3.13 h | 7.517 | 8.568E−8 |
| 111-AG | 7.45 d | 4.099 | 2.645E−6 |
| 113-AG | 5.37 h | 1.397 | 2.756E−8 |
| 115-CD | 2.23 d | 5.524 | 1.104E−6 |
| 115-IN* | 4.49 h | 5.961 | 9.999E−8 |
| 125-SN | 9.64 d | 4.142 | 3.895E−6 |
| 121-SN | 1.13 d | 7.161 | 7.625E−7 |
| 128-SB | 9.01 h | 4.684 | 1.757E−7 |
| 127-SB | 3.85 d | 51.18 | 1.953E−5 |
| 129-SB | 4.40 h | 21.91 | 4.044E−7 |
| 132-TE | 3.20 d | 1279 | 4.223E−4 |
| 131-TE* | 1.25 d | 112.7 | 1.440E−5 |
| 129-TE | 1.16 h | 27.33 | 1.330E−7 |
| 129-TE* | 33.60 d | 7.317 | 2.475E−5 |
| 127-TE | 9.35 h | 44.78 | 1.729E−6 |
| 135-I | 6.57 h | 529.7 | 1.528E−5 |
| 133-I | 0.87 d | 1676 | 1.508E−4 |
| 132-I | 2.30 h | 1319 | 1.299E−5 |
| 131-I | 8.04 d | 589.8 | 4.849E−4 |
| 135-XE | 9.14 h | 1422 | 5.708E−5 |
| 133-XE | 5.24 d | 1693 | 9.214E−4 |
| 133-XE* | 2.19 d | 66.31 | 1.508E−5 |
| 131-XE* | 11.90 d | 1.852 | 2.253E−6 |
| 137-CS | 30.10 y | 1.445 | 1.698E−3 |
| 140-BA | 12.75 d | 935.2 | 1.303E−3 |
| 141-LA | 3.92 h | 159.3 | 2.864E−6 |
| 140-LA | 1.68 d | 801.8 | 1.470E−4 |
| 143-CE | 1.38 d | 1733 | 2.663E−4 |
| 144-CE | 0.78 y | 47.2 | 1.511E−3 |
| 141-CE | 32.50 d | 416.7 | 1.490E−3 |
| 143-PR | 13.57 d | 782.1 | 1.185E−3 |
| 145-PR | 5.98 h | 282 | 7.959E−6 |
| 147-ND | 10.98 d | 370.8 | 4.672E−4 |

TABLE 12-continued

Most important Fissium production for 33 kg of 20% enriched Uranium, exposed for 10 days (scenario (1)).

| Element | ½ Life | GBq | Mass (arb. u.) |
|---|---|---|---|
| 151-PM | 1.18 d | 114.4 | 1.596E−5 |
| 147-PM | 2.62 y | 1.651 | 1.814E−4 |
| 149-PM | 2.21 d | 340.2 | 8.753E−5 |
| 156-SM | 9.40 h | 3.423 | 1.633E−7 |
| 153-SM | 1.93 d | 47.4 | 1.092E−5 |
| 156-EU | 15.19 d | 2.542 | 4.702E−6 |
| 157-EU | 15.18 h | 1.556 | 1.206E−7 |

TABLE 13

Capture and Fissium production efficiencies for 1 kg of 20% enriched Uranium

| Element | Fractional Content | Capture eff. $\eta$ ($kg^{-1}$) | Fissium eff. $\eta f$ ($kg^{-1}$) |
|---|---|---|---|
| $^{235}U$ | 0.20 | 1.212E−3 | 3.852E−3 |
| $^{238}U$ | 0.80 | 1.676E−3 | 6.587E−5 |

The most important radio-nuclides out of Fissium have been calculated with the geometry of Table 6 and are listed in Table 12. The conditions are the ones of scenario (1). Figures for scenario (2) are about two orders of magnitude larger. The exposure time has been arbitrarily set to 10 days, followed by 1 day of cool-down. The target was 20%-enriched metallic Uranium of a mass of 33 kg. Only elements with final activity larger than 1 Gbq are shown. It is interesting to compare the $^{99}Mo$ production from Fissium with the one by direct activation from $^{98}Mo$ (Paragraph 5.3). The asymptotic yield from 20%-enriched Uranium is calculated to be 51.3 Gbq/kg of target for scenario (1) activation. The same activation will be obtained with 288 grams of $^{98}Mo$. Therefore, we achieve comparable yields.

5.8.—P Implantation in Si Crystals

Natural Silicon is made of the three isotopes $^{28}Si$ (92.23%, $I_{res}$=0.0641 b), $^{29}Si$(4.46%, $I_{res}$=0.0543 b) and $^{30}Si$ (3.1%, $I_{res}$=0697 b). The only isotope leading to an unstable element by neutron capture is the $^{30}Si$, which produces $^{31}Si$, in turn decaying with $\tau_{1/2}$=157 m to $^{331}P$, the only isotope of natural Phosphorus. The Montecarlo-calculated capture efficiencies of the isotopes for 1 kg of natural Si are $\eta=2.353\times10^{-4}$ $kg^{-1}$ for $^{28}Si$, $\eta=8.166\times10^{-6}$ $kg^{-1}$ for $^{29}Si$ and $\eta=1.733\times10^{-5}$ $kg^{-1}$ for the interesting isotope $^{30}Si$. Assuming scenario (2) of the regional accelerator with $S_0=3.0\times10^{16}$ n/s, the atomic P implantation rate is $2.573\times10^{14}$ $s^{-1}$, corresponding to 1 p.p.b. (equivalent to an implanted density of donors of $5\times10^{13}$ $cm^{-3}$) implanted every 10.7 hours. No harmful isotope is apparently produced, and therefore the implantation process is "clean", once the $^{30}Si$ has decayed away. If higher implantation yields are needed, in view of the special, industrial nature of the process, a stronger accelerator (current and energy) may be used.

A similar procedure can be applied to Germanium crystals. The leading captures occur in the $^{70}Ge$ isotope (20%), producing the acceptor $^{71}Ga$ (via $^{71}Ge$). A smaller rate of captures also occurs for $^{74}Ge$ (36%), producing the donor $^{75}As$ (via $^{75}Ge$). Hence, acceptor doping dominates.

6. Description of the Waste Transmuter

The waste transmuter operation is exemplified according to the previously-described scenarios, and in the framework of an EA. As already pointed out, these considerations apply easily also to the case where the "leaky" neutron source is a Fast Breeder reactor core.

The General Layout of an EA operated in conjunction with the Waste transmuter is shown in simplified FIG. 14*a* (plane view at the medium plane of the Core), and FIG. 14*b* (vertical cut in the medium plane).

It consists of a large, robust Steel Tank 20 filled with molten Lead 21, or with a Lead/Bismuth eutectic mixture. The heat produced is, dissipated by natural convection or with the help of pumps, through heat exchangers installed on the top (not shown in figure).

The proton beam which is used to activate the nuclear cascades in the Energy Amplifier Core 22 is brought through an evacuated pipe 23, and it traverses the Beam Window 24 before interacting with the molten Lead in the Spallation Region 25.

For simplicity, we display a common Lead volume for the Spallation Region and the rest of the device. This solution is perfectly acceptable, but it may be otherwise advisable to separate the circulation of the Lead of the Spallation Region from the one for rest of the unit. This alternative if, of course, of no relevance to the operation of the Transmuter.

The Core, in analogy with standard practice in Reactors, comprises a large number of steel-cladded pins, inside which the Fuel is-inserted as Oxide, or possibly in metallic Form. The fuel material includes a fertile element, such as $^{232}Th$, which breeds a fissile element, such as $^{233}U$, after having absorbed a neutron. The subsequent fission of the fissile element exposed to the fast neutron flux in turn yields further neutrons. That breeding-and-fission process remains sub-critical (see WO 95/12203).

The fuel pins, typically 1.3 m long, are uniformly spread inside a Fuel Assembly 26, also made out of Steel, generally of hexagonal shape, with typically 20 cm flat-to-flat distance. Each Fuel Assembly may contain several hundreds of pins.

Molten Lead circulates upwards inside the Fuel Assemblies and cools effectively the Pins, removing the heat produced by the nuclear processes. The typical speed of the coolant is 1 m/s and the temperature rise of about 150 to 200° C.

The high-energy neutrons Spallation neutrons from the Spallation Region drift into the core and initiate the multiplicative, sub-critical, breeding-and-fission process which is advantageously used (i) to Transmute Actinides in the core region and (ii) to produce the leaking neutrons used for the Waste transmutation in the Transmuter.

The Transmuter Volume 27, 29 surrounds the core as closely as possible to make an effective use of the leaking neutrons. We have used for simplicity also for the Transmuter region the same hexagonal lattice 28 used for the Core. However, in order to reduce interactions in the supporting structures, these must be as light as possible. This is simplified by the light weight of the load to be transmuted (few hundred of kilograms). Though not a necessity, the same type of assemblies would permit to make use of the same tooling (pantograph) to extract both the fuel and Transmuter assemblies. The transmuter sections above and below the Core region 29 could be combined assemblies in which both Fuel and Transmuter are held together. A Buffer Region 30 should in principle be inserted between the Core and the Transmuter Volume.

The Transmuter assemblies 28 are essentially filled with the circulating molten Lead, except the finely-distributed metallic $^{99}Tc$ which can be in a variety of forms, for instance wires or sheets. Since $^{99}Tc$ transforms itself into Ruthenium, which is also a metal, it may be left in direct contact with the molten Lead or enclosed in fine steel tubes, like the fuel. The engineering of the sample holder are of course to be defined according to the need and to the applications. In particular, different holders are required for Iodine, which is a vapour at the operating temperature of the EA (a chemical compound could be used instead, like for instance NaI which has higher melting point of 661° C. and a boiling point of 1304° C.), and it must be contained for instance in thin steel cladding. No appreciable heat is produced in the transmutation process, and it can be easily dissipated away by the molten Lead flow, even if its speed can be greatly reduced in the Transmuter sections.

$^{99}$Tc, Iodine and/or Selenium holders can be combined in a single assembly, because the strong resonances of $^{99}$Tc occur at energies which are well below the ones of the other elements, as evidenced in FIG. 1. Since the resonance integral above, say, 50 eV is comparable for the three elements, captures occur first in $^{79}$Se and $^{129}$I and the surviving neutrons are later strongly absorbed by $^{99}$Tc. Therefore, one can imagine thin, sealed stainless tubes, similar to the fuel pins except that they contain $^{99}$Tc in dispersed form of metal wires or equivalent geometry and Iodine vapours at low pressure. Iodine transforms into Xenon which may be periodically purged, while Selenium produces Bromine and Krypton.

7. Performance of the Waste Transmuter

The performance of the Waste Transmuter is exemplified in the case of the $^{99}$Tc. Other elements of Table 1 which have been selected for transmutation in the scenario described in Chapter 1 give quite similar behaviours.

TABLE 14

Neutron balance of illustrative EA.

| General parameters | | |
|---|---|---|
| Initial fuel mixture | $(Th\text{-}TRU)O_2$ | |
| Initial Fuel mass | 11.6 | ton |
| Thermal power output | 1.0 | GWatt |
| Nominal Multiplic. coefficient, k | 0.98 | |
| Initial TRU concentration | 21.07 | % |
| Neutron capture (all reactions) inventory | | |
| Core | 83.5 | % |
| Plenum & structures | 2.22 | % |
| Main Vessel | 0.39 | % |
| Leakage out of core (core fract.) | 14.3 (17.1) | % |
| Leakage out of tank | 1.46 | % |
| Main reactions | | |
| Captures | 64.5 | % |
| Fissions (core fract.) | 31.5 (37.7) | % |
| n, Xn | 2.31 | % |
| Others, incl. escapes | 1.65 | % |

We list in Table 14 the typical neutron balance of an EA operated as a TRU incinerator. The EA is initially filled with a mixture of Thorium and TRU's from the waste of a LWR, either in the form of Oxides (MOX) or of metals. Concentrations are adjusted in order to reach the wanted value of the multiplication coefficient k.

It is a fortunate circumstance that an appropriate cancellation occurs between the increases of reactivity due to the $^{233}$U breeding from the Thorium and the losses of reactivity due to the emergence of FF's captures, reduction of the core active mass and diminishing stockpile of TRU's. Such an equilibrium permits to extend the burning to more than 100 GWatt day/t of fuel without external interventions and the simple adjustment of the produced power with the help of the Accelerator beam. In practice, this means 2 to 3 years of unperturbed operation. At the end of this cycle, the fuel is regenerated, by extracting the most neutron-capturing FF's and the Bred. Uranium and adding to the remaining Actinides an appropriate amount of LWR waste,in order to achieve the wanted value of k. The procedure is repeated indefinitely, until the LWR waste is exhausted. After a few cycles, an "asymptotic" mixture sets in, resultant of the equilibrium condition between the various reactions in the core. Such a mixture has excellent fission probability for fast neutrons, which ensures that the process can be continued in principle indefinitely.

In order to evaluate the transmutation capacity of the Waste Transmuter, the transmutation volume 27 (FIGS. 14*a-b*) has, been filled with 270 kg of $^{99}$Tc in metallic form and finely dispersed in the Lead matrix, corresponding to a relative concentration of $1.04\times10^{-3}$. The elements 29 of FIGS. 14*a-b* are left for spare capacity or transmutation of other elements. The mass of $^{99}$Tc to be eliminated referred to the TRU's in the waste from a standard LWR (see Paragraph 1.4) are in the ratio [$^{99}$Tc/TRU]waste=(0.843 ton)/(10.178 ton)=0.0828. The calculated rate of transmutation for typical conditions of an EA (k=0.97) gives, for a fresh fuel load (first filling), $[^{99}Tc/TRU]_{transm}$=0.0856, i.e. sufficient to keep up with the waste composition.

During the successive cycles of TRU's elimination, the rate of elimination is reduced, since the TRU's having the smallest fission cross-sections accumulate, so that more neutrons are required to achieve a successful fission. Instead, the $^{99}$Tc transmutation rate is essentially constant, since it is related to the fraction of neutrons which escape the core. Integrated over many cycles, as necessary to eliminate completely the TRU's, we find [$^{99}$Tc/TRU]transm=0.1284, which is amply sufficient to eliminate both the $^{99}$Tc of the Waste and the one accumulated in the meantime because of the fissions of the TRU'S.

The initial concentration of $^{99}$Tc has been chosen such as to match the needed performance. In order to see the dependence on this parameter, we have varied it over a wide interval.

In FIG. 15, we display the transmutation rate as a function of the $^{99}$Tc concentration. As one can see progressive saturation occurs due to the self-shielding of the $^{99}$Tc in correspondence with the resonances. This is better evidenced in FIG. 16, where the neutron spectra, averaged over the transmutation volume are displayed for all the points of FIG. 15. A strong, growing depletion of the spectrum is observed after the two main $^{99}$Tc resonances. Note also the diffusive refill occurring after the last resonance and before thermal energies are reached. As already pointed out, this refill is due to the diffusion of neutrons from regions which contain no $^{99}$Tc.

It should also be pointed out that the high energy spectrum, as apparent in FIG. 16, is not affected by the concentration of $^{99}$Tc. This shows that the operation of the main EA is little affected by the Activator parameters. That effect is further confirmed in FIG. 17, where the effective multiplication factor k is displayed, again as a function of the concentration. One can see that the k value is only very slightly affected, indicating that the operation of the EA is essentially independent on the activities in the Transmuter region.

The fractional transmutation rate after 100 GWatt day/ton, which is a reasonable cycle time for the EA, is displayed in FIG. 18. As expected, small $^{99}$Tc loads are more quickly transmuted. In the concentration domain of interest, some 15-20% of the $^{99}$Tc are transmuted at the end of each cycle. This long transmutation time is of no practical concern, since the Transmuter elements can be left in place over several cycles, since the neutron flux is smaller and the radiation damage of the cladding correspondingly smaller.

Finally, the fraction of the neutron leaked out of the vessel as a function of the $^{99}$Tc concentration is displayed in FIG. 19. The small dependence of this fraction with the concentration indicates the local nature of the resonance driven capture, which do not affect appreciably the neutron flux in the vicinity of the walls of the tank. Likewise, the neutron flux and spectrum at a reasonable distance from the Transmuter region are not very affected by the $^{99}$Tc captures. This means that the rest of the space around the core may be used to-transmute additional Waste. We have estimated the ultimate, practical transmutation capability to about twice the one already used to eliminate the $^{99}$Tc. This is amply sufficient to also eliminate all the unwanted elements according to Table 2.

APPENDIX 1

A general analysis of which kind of radio-nuclides could be produced with the neutron Activator has been performed. Target elements must be natural elements which are optionally selected with an isotopic enrichment, though costly. The neutron capture process leads to a daughter element which is unstable, with a reasonable lifetime, conservatively chosen to be between one minute and one year. In turn, the next daughter element can be either stable or unstable. If it is stable, the process is defined as "activation" of the sample. Since a second isotopic separation is unrealistic, the activated compound must be used directly. A practical example of this is the $^{128}$I activation from: a natural Iodine compound ($^{127}$I→$^{128}$I). If, instead, the first daughter element decays into another unstable (the same time window has been used) chemical species, which can be separated with an appropriate technique, the present method may constitute a way to produce pure, separated radio-nuclides for practical applications. As practical example, one may refer to the chain $^{98}$Mo→$^{99}$Mo→$^{99m}$Tc.

The suitability of a given production/decay chain to our proposed method depends on the size of the neutron capture cross-section. Two quantities are relevant: the resonance integral $I_{res}$, which is related to the use of a high A diffusing medium such as Lead, and the thermal capture cross-section which suggests the use of a low A diffuser such as Graphite. Another relevant parameter is the fractional content of the father nuclear species in the natural compound, which is relevant to the possible need of isotopic preparation of the target sample.

| Target | Isotope | Natur. Conc. | Reson. Integr. | Therm. X-sect | Activated Isotope | half-life activated | Decay mode | Decay Br. R. | Next Isotope | half-life next Isot. |
|---|---|---|---|---|---|---|---|---|---|---|
| Na | Na- 23 | 1.00 | 0.26 | 0.607 | Na- 24 | 14.96 h | β− | 100.0 | | |
| Mg | Mg- 26 | 0.1101 | 0.016 | 0.0439 | Mg- 27 | 9.458 m | β− | 100.0 | | |
| Al | Al- 27 | 1.00 | 0.112 | 0.244 | Al- 28 | 2.241 m | β− | 100.0 | | |
| Si | Si- 30 | 0.031 | 0.697 | 0.124 | Si- 31 | 2.622 h | β− | 100.0 | | |
| P | P - 31 | 1.00 | 0.0712 | 0.207 | P - 32 | 14.26 d | β− | 100.0 | | |
| S | S - 34 | 0.0421 | 0.0835 | 0.256 | S - 35 | 87.51 d | β− | 100.0 | | |
| S | S - 36 | 0.0002 | 0.10 | 0.167 | S - 37 | 5.050 m | β− | 100.0 | | |
| Cl | Cl- 37 | 0.2423 | 0.0025 | 0. | Cl- 38 | 37.24 m | β− | 100.0 | | |
| Ar | Ar- 36 | 0.0034 | 1.68 | 6.0 | Ar- 37 | 35.04 d | β+ | 100.0 | | |
| Ar | Ar- 40 | 0.996 | 0.231 | 0.756 | Ar- 41 | 1.822 h | β− | 100.0 | | |
| K | K - 41 | 0.0673 | 1.44 | 1.67 | K - 42 | 12.36 h | β− | 100.0 | | |
| Ca | Ca- 44 | 0.0209 | 0.32 | 1.02 | Ca- 45 | 163.8 d | β− | 100.0 | | |
| Ca | Ca- 46 | 0.00 | 0.252 | 0.85 | Ca- 47 | 4.536 d | β− | 100.0 | Sc- 47 | 3.345 d |
| Ca | Ca- 48 | 0.0019 | 0.379 | 1.26 | Ca- 49 | 8.715 m | β− | 100.0 | Sc- 49 | 57.20 m |
| Sc | Sc- 45 | 1.00 | 9.24 | 31.10 | Sc- 46 | 83.79 d | β− | 100.0 | | |
| Ti | Ti- 50 | 0.054 | 0.0682 | 0.204 | Ti- 51 | 5.760 m | β− | 100.0 | | |
| V | V - 51 | 0.9975 | 2.08 | 5.62 | V - 52 | 3.750 m | β− | 100.0 | | |
| Cr | Cr- 50 | 0.0434 | 5.94 | 18.20 | Cr- 51 | 27.70 d | β+ | 100.0 | | |
| Cr | Cr- 54 | 0.0237 | 0.167 | 0.412 | Cr- 55 | 3.497 m | β− | 100.0 | | |
| Mn | Mn- 55 | 1.00 | 10.50 | 15.40 | Mn- 56 | 2.579 h | β− | 100.0 | | |
| Fe | Fe- 58 | 0.0028 | 1.36 | 1.32 | Fe- 59 | 44.50 d | β− | 100.0 | | |
| Co | Co- 59 | 1.00 | 72.0 | 42.70 | Co- 60* | 10.47 m | β− | 0.24 | | |
| Co | Co- 59 | 1.00 | 72.0 | 42.70 | Co- 60* | 10.47 m | γ | 99.76 | | |
| Ni | Ni- 64 | 0.0091 | 0.627 | 1.74 | Ni- 65 | 2.517 h | β− | 100.0 | | |
| Cu | Cu- 63 | 0.6917 | 4.47 | 5.11 | Cu- 64 | 12.70 h | β+ | 61.0 | | |
| Cu | Cu- 63 | 0.6917 | 4.47 | 5.11 | Cu- 64 | 12.70 h | β− | 39.0 | | |
| Cu | Cu- 65 | 0.3083 | 1.96 | 2.46 | Cu- 66 | 5.088 m | β− | 100.0 | | |
| Zn | Zn- 64 | 0.486 | 1.38 | 0.877 | Zn- 65 | 244.3 d | β+ | 100.0 | | |
| Zn | Zn- 68 | 0.188 | 2.89 | 1.15 | Zn- 69 | 56.40 m | β− | 100.0 | | |
| Zn | Zn- 68 | 0.188 | 2.89 | 1.15 | Zn- 69* | 13.76 h | γ | 99.97 | Zn- 69 | 56.40 m |
| Zn | Zn- 68 | 0.188 | 2.89 | 1.15 | Zn- 69* | 13.76 h | β− | 0.03 | | |
| Zn | Zn- 70 | 0.006 | 0.117 | 0.105 | Zn- 71 | 2.450 m | β− | 100.0 | | |
| Zn | Zn- 70 | 0.006 | 0.117 | 0.105 | Zn- 71* | 3.960 h | γ | 0.05 | Zn- 71 | 2.450 m |
| Zn | Zn- 70 | 0.006 | 0.117 | 0.105 | Zn- 71* | 3.960 h | β− | 99.95 | | |
| Ga | Ga- 69 | 0.601 | 18.0 | 2.52 | Ga- 70 | 21.14 m | β− | 99.59 | | |
| Ga | Ga- 69 | 0.601 | 18.0 | 2.52 | Ga- 70 | 21.14 m | β+ | 0.41 | | |
| Ga | Ga- 71 | 0.399 | 31.80 | 4.26 | Ga- 72 | 14.10 h | β− | 100.0 | | |
| Ge | Ge- 70 | 0.205 | 2.23 | 3.35 | Ge- 71 | 11.43 h | β+ | 100.0 | | |
| Ge | Ge- 74 | 0.365 | 0.416 | 0.482 | Ge- 75 | 1.380 h | β− | 100.0 | | |
| Ge | Ge- 76 | 0.078 | 1.31 | 0.172 | Ge- 77 | 11.30 h | β− | 100.0 | As- 77 | 1.618 d |
| As | As- 75 | 1.00 | 63.50 | 5.16 | As- 76 | 1.097 d | β− | 99.98 | | |
| As | As- 75 | 1.00 | 63.50 | 5.16 | As- 76 | 1.097 d | β+ | 0.02 | | |
| Se | Se- 74 | 0.009 | 575.0 | 59.40 | Se- 75 | 119.8 d | β+ | 100.0 | | |
| Se | Se- 78 | 0.236 | 4.70 | 0.492 | Se- 79* | 3.920 m | γ | 99.94 | | |
| Se | Se- 78 | 0.236 | 4.70 | 0.492 | Se- 79* | 3.920 m | β− | 0.06 | | |
| Se | Se- 80 | 0.497 | 0.928 | 0.699 | Se- 81 | 18.45 m | β− | 100.0 | | |

-continued

| Target | Isotope | Natur. Conc. | Reson. Integr. | Therm. X-sect | Activated Isotope | half-life activated | Decay mode | Decay Br. R. | Next Isotope | half-life next Isot. |
|---|---|---|---|---|---|---|---|---|---|---|
| Se | Se- 80 | 0.497 | 0.928 | 0.699 | Se- 81* | 57.28 m | γ | 99.95 | Se- 81 | 18.45 m |
| Se | Se- 80 | 0.497 | 0.928 | 0.699 | Se- 81* | 57.28 m | β− | 0.05 | | |
| Se | Se- 82 | 0.092 | 0.795 | 0.0506 | Se- 83 | 22.30 m | β− | 100.0 | Br- 83 | 2.400 h |
| Se | Se-82 | 0.092 | 0.795 | 0.0506 | Se- 83* | 1.168 m | β− | 100.0 | Br- 83 | 2.400 h |
| Br | Br- 79 | 0.5069 | 128.0 | 12.60 | Br- 80 | 17.68 m | β+ | 8.3 | | |
| Br | Br- 79 | 0.5069 | 128.0 | 12.60 | Br- 80 | 17.68 m | β− | 91.7 | | |
| Br | Br- 79 | 0.5069 | 128.0 | 12.60 | Br- 80* | 4.421 h | γ | 100.0 | Br- 80 | 17.68 m |
| Br | Br- 81 | 0.4931 | 46.40 | 3.09 | Br- 82 | 1.471 d | β− | 100.0 | | |
| Br | Br- 81 | 0.4931 | 46.40 | 3.09 | Br- 82* | 6.130 m | γ | 97.6 | Br- 82 | 1.471 d |
| Br | Br- 81 | 0.4931 | 46.40 | 3.09 | Br- 82* | 6.130 m | β− | 2.4 | | |
| Kr | Kr- 78 | 0.0035 | 25.10 | 7.11 | Kr- 79 | 1.460 d | β+ | 100.0 | | |
| Kr | Kr- 82 | 0.116 | 225.0 | 32.20 | Kr- 83* | 1.830 h | γ | 100.0 | | |
| Kr | Kr- 84 | 0.57 | 3.47 | 0.0952 | Kr- 85* | 4.480 h | β− | 78.6 | | |
| Kr | Kr- 84 | 0.57 | 3.47 | 0.0952 | Kr- 85* | 4.480 h | γ | 21.4 | | |
| Kr | Kr- 86 | 0.173 | 0.023 | 0.34 | Kr- 87 | 1.272 h | β− | 100.0 | | |
| Rb | Rb- 85 | 0.7217 | 8.68 | 0.551 | Rb- 86 | 18.63 d | β+ | 0.005 | | |
| Rb | Rb- 85 | 0.7217 | 8.68 | 0.551 | Rb- 86 | 18.63 d | β− | 99.99 | | |
| Rb | Rb- 85 | 0.7217 | 8.68 | 0.551 | Rb- 86* | 1.017 m | γ | 100.0 | Rb- 86 | 18.63 d |
| Rb | Rb- 87 | 0.2784 | 2.70 | 0.137 | Rb- 88 | 17.78 m | β− | 100.0 | | |
| Sr | Sr- 84 | 0.0056 | 10.40 | 0.929 | Sr- 85 | 64.84 d | β+ | 100.0 | | |
| Sr | Sr- 84 | 0.0056 | 10.40 | 0.929 | Sr- 85* | 1.127 h | β+ | 13.4 | | |
| Sr | Sr- 84 | 0.0056 | 10.40 | 0.929 | Sr- 85* | 1.127 h | γ | 86.6 | Sr- 85 | 64.84 d |
| Sr | Sr- 86 | 0.0986 | 4.70 | 1.19 | Sr- 87* | 2.803 h | γ | 99.7 | | |
| Sr | Sr- 86 | 0.0986 | 4.70 | 1.19 | Sr- 87* | 2.803 h | β+ | 0.3 | | |
| Sr | Sr- 88 | 0.8258 | 0.0628 | 0.66 | Sr- 89 | 50.53 d | β− | 99.991 | | |
| Sr | Sr- 88 | 0.8258 | 0.0628 | 0.66 | Sr- 89 | 50.53 d | β− | 0.009 | | |
| Y | Y - 89 | 1.00 | 0.821 | 1.48 | Y - 90 | 2.671 d | β− | 100.0 | | |
| Y | Y - 89 | 1.00 | 0.821 | 1.48 | Y - 90* | 3.190 h | γ | 100.0 | Y - 90 | 2.671 d |
| Y | Y - 89 | 1.00 | 0.821 | 1.48 | Y - 90* | 3.190 h | β− | 0.002 | | |
| Zr | Zr- 94 | 0.1738 | 0.316 | 0.057 | Zr- 95 | 64.02 d | β− | 98.89 | Nb- 95 | 34.97 d |
| Zr | Zr- 94 | 0.1738 | 0.316 | 0.057 | Zr- 95 | 64.02 d | β− | 1.11 | Nb- 95* | 3.608 d |
| Zr | Zr- 96 | 0.028 | 5.86 | 0.0261 | Zr- 97 | 16.90 h | β− | 5.32 | Nb- 97 | 1.202 h |
| Zr | Zr- 96 | 0.028 | 5.86 | 0.0261 | Zr- 97 | 16.90 h | β− | 94.68 | | |
| Nb | Nb- 93 | 1.00 | 9.78 | 1.32 | Nb- 94* | 6.263 m | γ | 99.5 | | |
| Nb | Nb- 93 | 1.00 | 9.78 | 1.32 | Nb- 94* | 6.263 m | β− | 0.5 | | |
| Mo | Mo- 92 | 0.1484 | 0.967 | 0.0237 | Mo- 93* | 6.850 h | γ | 99.88 | | |
| Mo | Mo- 92 | 0.1484 | 0.967 | 0.0237 | Mo- 93* | 6.850 h | β+ | 0.12 | | |
| Mo | Mo- 98 | 0.2413 | 6.54 | 0.149 | Mo- 99 | 2.747 d | β− | 12.5 | | |
| Mo | Mo- 98 | 0.2413 | 6.54 | 0.149 | Mo- 99 | 2.747 d | β− | 87.5 | Tc- 99* | 6.010 h |
| Mo | Mo-100 | 0.0963 | 3.88 | 0.228 | Mo-101 | 14.61 m | β− | 100.0 | Tc-101 | 14.22 m |
| Ru | Ru- 96 | 0.0552 | 7.26 | 0.332 | Ru- 97 | 2.900 d | β+ | 99.962 | | |
| Ru | Ru- 96 | 0.0552 | 7.26 | 0.332 | Ru- 97 | 2.900 d | β+ | 0.038 | Tc- 97* | 90.10 d |
| Ru | Ru-102 | 0.316 | 4.17 | 1.41 | Ru-103 | 39.26 d | β− | 0.25 | | |
| Ru | Ru-102 | 0.316 | 4.17 | 1.41 | Ru-103 | 39.26 d | β− | 99.75 | Rh-103* | 56.11 m |
| Ru | Ru-104 | 0.187 | 6.53 | 0.37 | Ru-105 | 4.440 h | β− | 72.0 | Rh-105 | 1.473 d |
| Ru | Ru-104 | 0.187 | 6.53 | 0.37 | Ru-105 | 4.440 h | β− | 28.0 | | |
| Rh | Rh-103 | 1.00 | 928.0 | 169.0 | Rh-104* | 4.340 m | γ | 99.87 | | |
| Rh | Rh-103 | 1.00 | 928.0 | 169.0 | Rh-104* | 4.340 m | β− | 0.13 | | |
| Pd | Pd-102 | 0.0102 | 19.20 | 3.85 | Pd-103 | 16.99 d | β+ | 0.1 | | |
| Pd | Pd-102 | 0.0102 | 19.20 | 3.85 | Pd-103 | 16.99 d | β+ | 99.9 | Rh-103* | 56.11 m |
| Pd | Pd-108 | 0.2646 | 251.0 | 9.77 | Pd-109 | 13.70 h | β− | 0.05 | | |
| Pd | Pd-108 | 0.2646 | 251.0 | 9.77 | Pd-109 | 13.70 h | β− | 99.95 | | |
| Pd | Pd-108 | 0.2646 | 251.0 | 9.77 | Pd-109* | 4.696 m | γ | 100.0 | Pd-109 | 13.70 h |
| Pd | Pd-110 | 0.1172 | 2.79 | 0.261 | Pd-111 | 23.40 m | β− | 0.75 | Ag-111 | 7.450 d |
| Pd | Pd-110 | 0.1172 | 2.79 | 0.261 | Pd-111 | 23.40 m | β− | 99.25 | Ag-111* | 1.080 m |
| Pd | Pd-110 | 0.1172 | 2.79 | 0.261 | Pd-111* | 5.500 h | γ | 73.0 | Pd-111 | 23.40 m |
| Pd | Pd-110 | 0.1172 | 2.79 | 0.261 | Pd-111* | 5.500 h | β− | 7.5 | Ag-111 | 7.450 d |
| Pd | Pd-110 | 0.1172 | 2.79 | 0.261 | Pd-111* | 5.500 h | β− | 19.5 | Ag-111* | 1.080 m |
| Ag | Ag-107 | 0.5184 | 100. | 44.20 | Ag-108 | 2.370 m | β− | 97.15 | | |
| Ag | Ag-107 | 0.5184 | 100. | 44.20 | Ag-108 | 2.370 m | β+ | 2.85 | | |
| Ag | Ag-109 | 0.4816 | 1460. | 104.0 | Ag-110* | 249.8 d | γ | 1.36 | | |
| Ag | Ag-109 | 0.4816 | 1460. | 104.0 | Ag-110* | 249.8 d | β− | 98.64 | | |
| Cd | Cd-106 | 0.0125 | 10.60 | 1.11 | Cd-107 | 6.500 h | β+ | 0.06 | | |
| Cd | Cd-106 | 0.0125 | 10.60 | 1.11 | Cd-107 | 6.500 h | β+ | 99.94 | | |
| Cd | Cd-110 | 0.1249 | 38.20 | 12.60 | Cd-111* | 48.54 m | γ | 100.0 | | |
| Cd | Cd-114 | 0.2873 | 16.90 | 0.391 | Cd-115 | 2.227 d | β− | 0.0 | | |
| Cd | Cd-114 | 0.2873 | 16.90 | 0.391 | Cd-115 | 2.227 d | β− | 100.0 | In-115* | 4.486 h |
| Cd | Cd-114 | 0.2873 | 16.90 | 0.391 | Cd-115* | 44.60 d | β− | 99.989 | | |
| Cd | Cd-114 | 0.2873 | 16.90 | 0.391 | Cd-115* | 44.60 d | β− | 0.011 | In-115* | 4.486 h |
| Cd | Cd-116 | 0.0749 | 1.74 | 0.0859 | Cd-117 | 2.490 h | β− | 8.4 | In-117 | 43.20 m |
| Cd | Cd-116 | 0.0749 | 1.74 | 0.0859 | Cd-117 | 2.490 h | β− | 91.6 | In-117* | 1.937 h |
| Cd | Cd-116 | 0.0749 | 1.74 | 0.0859 | Cd-117* | 3.360 h | β− | 98.6 | In-117 | 43.20 m |
| Cd | Cd-116 | 0.0749 | 1.74 | 0.0859 | Cd-117* | 3.360 h | β− | 1.4 | In-117* | 1.937 h |
| In | In-113 | 0.043 | 322.0 | 13.90 | In-114 | 1.198 m | β− | 99.5 | | |
| In | In-113 | 0.043 | 322.0 | 13.90 | In-114 | 1.198 m | β+ | 0.5 | | |
| In | In-113 | 0.043 | 322.0 | 13.90 | In-114* | 49.51 d | γ | 95.6 | In-114 | 1.198 m |
| In | In-113 | 0.043 | 322.0 | 13.90 | In-114* | 49.51 d | β+ | 4.4 | | |

-continued

| Target | Isotope | Natur. Conc. | Reson. Integr. | Therm. X-sect | Activated Isotope | half-life activated | Decay mode | Decay Br. R. | Next Isotope | half-life next Isot. |
|---|---|---|---|---|---|---|---|---|---|---|
| In | In-115 | 0.957 | 3110. | 232.0 | In-116* | 54.41 m | β− | 100.0 | | |
| Sn | Sn-112 | 0.0097 | 30.40 | 1.16 | Sn-113 | 115.1 d | β+ | 0.0 | | |
| Sn | Sn-112 | 0.0097 | 30.40 | 1.16 | Sn-113 | 115.1 d | β+ | 100.0 | In-113* | 1.658 h |
| Sn | Sn-112 | 0.0097 | 30.40 | 1.16 | Sn-113* | 21.40 m | γ | 91.1 | Sn-113 | 115.1 d |
| Sn | Sn-112 | 0.0097 | 30.40 | 1.16 | Sn-113* | 21.40 m | β+ | 8.9 | | |
| Sn | Sn-116 | 0.1453 | 12.40 | 0.147 | Sn-117* | 13.60 d | γ | 100.0 | | |
| Sn | Sn-118 | 0.2422 | 5.32 | 0.25 | Sn-119* | 293.1 d | γ | 100.0 | | |
| Sn | Sn-120 | 0.3259 | 1.21 | 0.16 | Sn-121 | 1.127 d | β− | 100.0 | | |
| Sn | Sn-122 | 0.0463 | 0.916 | 0.21 | Sn-123 | 129.2 d | β− | 100.0 | | |
| Sn | Sn-122 | 0.0463 | 0.916 | 0.21 | Sn-123* | 40.06 m | β− | 100.0 | | |
| Sn | Sn-124 | 0.0579 | 7.84 | 0.155 | Sn-125 | 9.640 d | β− | 100.0 | | |
| Sn | Sn-124 | 0.0579 | 7.84 | 0.155 | Sn-125* | 9.520 m | β− | 100.0 | | |
| Sb | Sb-121 | 0.573 | 213.0 | 6.88 | Sb-122 | 2.700 d | β− | 97.6 | | |
| Sb | Sb-121 | 0.573 | 213.0 | 6.88 | Sb-122 | 2.700 d | β+ | 2.4 | | |
| Sb | Sb-121 | 0.573 | 213.0 | 6.88 | Sb-122* | 4.210 m | γ | 100.0 | Sb-122 | 2.700 d |
| Sb | Sb-123 | 0.427 | 122.0 | 4.80 | Sb-124* | 60.20 d | β− | 100.0 | | |
| Sb | Sb-123 | 0.427 | 122.0 | 4.80 | Sb-124* | 1.550 m | γ | 75.0 | Sb-124 | 60.20 d |
| Sb | Sb-123 | 0.427 | 122.0 | 4.80 | Sb-124* | 1.550 m | β− | 25.0 | | |
| Sb | Sb-123 | 0.427 | 122.0 | 4.80 | Sb-124** | 20.20 m | γ | 100.0 | Sb-124* | 1.550 m |
| Te | Te-120 | 0.001 | 22.20 | 2.69 | Te-121 | 16.78 d | β+ | 100.0 | | |
| Te | Te-120 | 0.001 | 22.20 | 2.69 | Te-121* | 154.0 d | γ | 88.6 | Te-121 | 16.78 d |
| Te | Te-12 | 0.001 | 22.20 | 2.69 | Te-121* | 154.0 d | β+ | 11.4 | | |
| Te | Te-122 | 0.026 | 79.90 | 3.86 | Te-123* | 119.7 d | γ | 100.0 | | |
| Te | Te-124 | 0.0482 | 5.13 | 7.79 | Te-125* | 57.40 d | γ | 100.0 | | |
| Te | Te-126 | 0.1895 | 8.05 | 1.19 | Te-127 | 9.350 h | β− | 100.0 | | |
| Te | Te-126 | 0.1895 | 8.05 | 1.19 | Te-127* | 109.0 d | γ | 97.6 | Te-127 | 9.350 h |
| Te | Te-126 | 0.1895 | 8.05 | 1.19 | Te-127* | 109.0 d | β− | 2.4 | | |
| Te | Te-128 | 0.3169 | 1.73 | 0.247 | Te-129 | 1.160 h | β− | 100.0 | | |
| Te | Te-128 | 0.3169 | 1.73 | 0.247 | Te-129* | 33.60 d | β− | 36.0 | | |
| Te | Te-128 | 0.3169 | 1.73 | 0.247 | Te-129* | 33.60 d | γ | 64.0 | Te-129 | 1.160 h |
| Te | Te-130 | 0.338 | 0.259 | 0.31 | Te-131 | 25.00 m | β− | 100.0 | I -131 | 8.040 d |
| Te | Te-130 | 0.338 | 0.259 | 0.31 | Te-131* | 1.250 d | β− | 77.8 | I -131 | 8.040 d |
| Te | Te-130 | 0.338 | 0.259 | 0.31 | Te-131* | 1.250 d | γ | 22.2 | Te-131 | 25.00 m |
| I | I -127 | 1.00 | 148.0 | 7.09 | I-128 | 24.99 m | β+ | 6.9 | | |
| I | I -127 | 1.00 | 148.0 | 7.09 | I-128 | 24.99 m | β− | 93.1 | | |
| Xe | Xe-124 | 0.001 | 2950. | 190. | Xe-125 | 16.90 h | β+ | 100.0 | I -125 | 59.41 d |
| Xe | Xe-126 | 0.0009 | 43.90 | 2.52 | Xe-127 | 36.40 d | β+ | 100.0 | | |
| Xe | Xe-126 | 0.0009 | 43.90 | 2.52 | Xe-127* | 1.153 m | γ | 100.0 | Xe-127 | 36.40 d |
| Xe | Xe-128 | 0.0191 | 10.70 | 6.13 | Xe-129* | 8.890 d | γ | 100.0 | | |
| Xe | Xe-13 | 0.041 | 15.30 | 29.80 | Xe-131* | 11.90 d | γ | 100.0 | | |
| Xe | Xe-132 | 0.269 | 4.46 | 0.517 | Xe-133 | 5.243 d | β− | 100.0 | | |
| Xe | Xe-132 | 0.269 | 4.46 | 0.517 | Xe-133* | 2.190 d | γ | 100.0 | Xe-133 | 5.243 d |
| Xe | Xe-134 | 0.104 | 0.591 | 0.303 | Xe-135 | 9.140 h | β− | 100.0 | | |
| Xe | Xe-134 | 0.104 | 0.591 | 0.303 | Xe-135* | 15.29 m | γ | 100.0 | Xe-135 | 9.140 h |
| Xe | Xe-134 | 0.104 | 0.591 | 0.303 | Xe-135* | 15.29 m | β− | 0.004 | | |
| Xe | Xe-136 | 0.089 | 0.116 | 0.299 | Xe-137 | 3.818 m | β− | 100.0 | | |
| Cs | Cs-133 | 1.00 | 393.0 | 33.20 | Cs-134* | 2.910 h | γ | 100.0 | | |
| Ba | Ba-130 | 0.0011 | 176.0 | 13.0 | Ba-131 | 11.80 d | β+ | 100.0 | Cs-131 | 9.690 d |
| Ba | Ba-130 | 0.0011 | 176.0 | 13.0 | Ba-131* | 14.60 m | γ | 100.0 | Ba-131 | 11.80 d |
| Ba | Ba-132 | 0.001 | 30.40 | 8.06 | Ba-133* | 1.621 d | β+ | 0.01 | | |
| Ba | Ba-132 | 0.001 | 30.40 | 8.06 | Ba-133* | 1.621 d | γ | 99.99 | | |
| Ba | Ba-134 | 0.0242 | 24.60 | 2.30 | Ba-135* | 1.196 d | γ | 100.0 | | |
| Ba | Ba-136 | 0.0785 | 2.02 | 0.458 | Ba-137* | 2.552 m | γ | 100.0 | | |
| Ba | Ba-138 | 0.717 | 0.23 | 0.413 | Ba-139 | 1.384 h | β− | 100.0 | | |
| La | La-139 | 0.9991 | 10.50 | 10.30 | La-140 | 1.678 d | β− | 100.0 | | |
| Ce | Ce-136 | 0.0019 | 64.30 | 7.18 | Ce-137 | 9.000 h | β+ | 100.0 | | |
| Ce | Ce-136 | 0.0019 | 64.30 | 7.18 | Ce-137* | 1.433 d | γ | 99.22 | Ce-137 | 9.000 h |
| Ce | Ce-136 | 0.0019 | 64.30 | 7.18 | Ce-137* | 1.433 d | β+ | 0.78 | | |
| Ce | Ce-138 | 0.0025 | 3.08 | 1.25 | Ce-139 | 137.6 d | β+ | 100.0 | | |
| Ce | Ce-140 | 0.8848 | 0.235 | 0.651 | Ce-141 | 32.50 d | β− | 100.0 | | |
| Ce | Ce-142 | 0.1108 | 0.835 | 1.15 | Ce-143 | 1.377 d | β− | 100.0 | Pr-143 | 13.57 d |
| Pr | Pr-141 | 1.00 | 17.10 | 13.20 | Pr-142 | 19.12 h | β− | 99.98 | | |
| Pr | Pr-141 | 1.00 | 17.10 | 13.20 | Pr-142 | 19.12 h | β+ | 0.02 | | |
| Pr | Pr-141 | 1.00 | 17.10 | 13.20 | Pr-142* | 14.60 m | γ | 100.0 | Pr-142 | 19.12 h |
| Nd | Nd-146 | 0.1719 | 2.77 | 1.61 | Nd-147 | 10.98 d | β− | 100.0 | | |
| Nd | Nd-148 | 0.0576 | 14.50 | 2.85 | Nd-149 | 1.720 h | β− | 100.0 | Pm-149 | 2.212 d |
| Nd | Nd-150 | 0.0564 | 15.80 | 1.38 | Nd-151 | 12.44 m | β− | 100.0 | Pm-151 | 1.183 d |
| Sm | Sm-144 | 0.031 | 1.75 | 1.88 | Sm-145 | 340.0 d | β+ | 100.0 | | |
| Sm | Sm-152 | 0.267 | 2740. | 236.0 | Sm-153 | 1.928 d | β− | 100.0 | | |
| Sm | Sm-154 | 0.227 | 35.50 | 9.64 | Sm-155 | 22.30 m | β− | 100.0 | | |
| Eu | Eu-151 | 0.478 | 1850. | 10700. | Eu-152* | 9.274 h | β− | 72.0 | | |
| Eu | Eu-151 | 0.478 | 1850. | 10700. | Eu-152* | 9.274 h | β+ | 28.0 | | |
| Eu | Eu-151 | 0.478 | 1850. | 10700. | Eu-152** | 1.600 h | γ | 100.0 | | |
| Eu | Eu-153 | 0.522 | 1390. | 359.0 | Eu-154* | 46.30 m | γ | 100.0 | | |
| Gd | Gd-152 | 0.002 | 898.0 | 1210. | Gd-153 | 241.6 d | β+ | 100.0 | | |
| Gd | Gd-158 | 0.2484 | 63.70 | 2.86 | Gd-159 | 18.56 h | β− | 100.0 | | |
| Gd | Gd-160 | 0.2186 | 7.80 | 0.874 | Gd-161 | 3.660 m | β− | 100.0 | Tb-161 | 6.880 d |

-continued

| Target | Isotope | Natur. Conc. | Reson. Integr. | Therm. X-sect | Activated Isotope | half-life activated | Decay mode | Decay Br. R. | Next Isotope | half-life next Isot. |
|---|---|---|---|---|---|---|---|---|---|---|
| Tb | Tb-159 | 1.00 | 469.0 | 31.70 | Tb-160 | 72.30 d | β− | 100.0 | | |
| Dy | Dy-156 | 0.0006 | 953.0 | 37.90 | Dy-157 | 8.140 h | β+ | 100.0 | | |
| Dy | Dy-158 | 0.001 | 179.0 | 49.20 | Dy-159 | 144.4 d | β+ | 100.0 | | |
| Dy | Dy-164 | 0.282 | 174.0 | 2890. | Dy-165 | 2.334 h | β− | 100.0 | | |
| Dy | Dy-164 | 0.282 | 174.0 | 2890. | Dy-165* | 1.257 m | γ | 97.76 | Dy-165 | 2.334 h |
| Dy | Dy-164 | 0.282 | 174.0 | 2890. | Dy-165* | 1.257 m | β− | 2.24 | | |
| Ho | Ho-165 | 1.00 | 755.0 | 76.10 | Ho-166 | 1.118 d | β− | 100.0 | | |
| Er | Er-162 | 0.0014 | 520. | 30. | Er-163 | 1.250 h | β+ | 100.0 | | |
| Er | Er-164 | 0.0161 | 143.0 | 15.0 | Er-165 | 10.36 h | β+ | 100.0 | | |
| Er | Er-168 | 0.268 | 40.60 | 3.19 | Er-169 | 9.400 d | β− | 100.0 | | |
| Er | Er-170 | 0.149 | 58.10 | 6.73 | Er-171 | 7.516 h | β− | 100.0 | | |
| Tm | Tm-169 | 1.00 | 1700. | 120. | Tm-170 | 128.6 d | β+ | 0.15 | | |
| Tm | Tm-169 | 1.00 | 1700. | 120. | Tm-170 | 128.6 d | β− | 99.85 | | |
| Yb | Yb-168 | 0.0013 | 378.0 | 2660. | Yb-169 | 32.03 d | β+ | 100.0 | | |
| Yb | Yb-174 | 0.318 | 21.0 | 79.30 | Yb-175 | 4.185 d | β− | 100.0 | | |
| Yb | Yb-176 | 0.127 | 6.64 | 3.28 | Yb-177 | 1.911 h | β− | 100.0 | Lu-177 | 6.734 d |
| Lu | Lu-175 | 0.9741 | 644.0 | 29.80 | Lu-176* | 3.635 h | β− | 99.91 | | |
| Lu | Lu-175 | 0.9741 | 644.0 | 29.80 | Lu-176* | 3.635 h | β+ | 0.1 | | |
| Lu | Lu-176 | 0.0259 | 896.0 | 2810. | Lu-177 | 6.734 d | β− | 100.0 | | |
| Lu | Lu-176 | 0.0259 | 896.0 | 2810. | Lu-177* | 160.4 d | β− | 78.3 | | |
| Lu | Lu-176 | 0.0259 | 896.0 | 2810. | Lu-177* | 160.4 d | γ | 21.7 | Lu-177 | 6.734 d |
| Hf | Hf-174 | 0.0016 | 295.0 | 463.0 | Hf-175 | 70.00 d | β+ | 100.0 | | |
| Hf | Hf-176 | 0.0521 | 613.6 | 16.20 | Hf-177** | 51.40 m | γ | 100.0 | | |
| Hf | Hf-178 | 0.273 | 1910. | 90. | Hf-179** | 25.10 d | γ | 100.0 | | |
| Hf | Hf-179 | 0.1363 | 540. | 44.70 | Hf-180* | 5.500 h | γ | 98.6 | | |
| Hf | Hf-179 | 0.1363 | 540. | 44.70 | Hf-180* | 5.500 h | β− | 1.4 | Ta-180 | 8.152 h |
| Hf | Hf-180 | 0.351 | 34.40 | 15.0 | Hf-181 | 42.39 d | β− | 100.0 | | |
| Ta | Ta-181 | 0.9999 | 657.0 | 23.70 | Ta-182 | 114.4 d | β− | 100.0 | | |
| Ta | Ta-181 | 0.9999 | 657.0 | 23.70 | Ta-182** | 15.84 m | γ | 100.0 | | |
| W | W -180 | 0.0013 | 248.0 | 42.80 | W -181 | 121.2 d | β+ | 100.0 | | |
| W | W -184 | 0.3067 | 16.10 | 1.95 | W -185 | 75.10 d | β− | 100.0 | | |
| W | W -184 | 0.3067 | 16.10 | 1.95 | W -185* | 1.670 m | γ | 100.0 | W -185 | 75.10 d |
| W | W -186 | 0.286 | 344.0 | 43.30 | W -187 | 23.72 h | β− | 100.0 | | |
| Re | Re-185 | 0.374 | 1710. | 129.0 | Re-186 | 3.777 d | β− | 93.1 | | |
| Re | Re-185 | 0.374 | 1710. | 129.0 | Re-186 | 3.777 d | β+ | 6.9 | | |
| Re | Re-187 | 0.626 | 288.0 | 87.90 | Re-188 | 16.98 h | β− | 100.0 | | |
| Re | Re-187 | 0.626 | 288.0 | 87.90 | Re-188* | 18.60 m | γ | 100.0 | Re-188 | 16.98 h |
| Os | Os-184 | 0.0002 | 869.0 | 3430. | Os-185 | 93.60 d | β+ | 100.0 | | |
| Os | Os-188 | 0.133 | 153.0 | 5.36 | Os-189* | 5.800 h | γ | 100.0 | | |
| Os | Os-189 | 0.161 | 837.0 | 28.90 | Os-190* | 9.900 m | γ | 100.0 | | |
| Os | Os-190 | 0.264 | 24.20 | 15.0 | Os-191 | 15.40 d | β− | 100.0 | | |
| Os | Os-190 | 0.264 | 24.20 | 15.0 | Os-191* | 13.10 h | γ | 100.0 | Os-191 | 15.40 d |
| Os | Os-192 | 0.41 | 6.12 | 2.29 | Os-193 | 1.271 d | β− | 100.0 | | |
| Ir | Ir-191 | 0.373 | 1170. | 1100. | Ir-192 | 73.83 d | β− | 95.24 | | |
| Ir | Ir-191 | 0.373 | 1170. | 1100. | Ir-192 | 73.83 d | β+ | 4.76 | | |
| Ir | Ir-191 | 0.373 | 1170. | 1100. | Ir-192* | 1.450 m | γ | 99.98 | Ir-192 | 73.83 d |
| Ir | Ir-191 | 0.373 | 1170. | 1100. | Ir-192* | 1.450 m | β− | 0.02 | | |
| Ir | Ir-193 | 0.627 | 1310. | 128.0 | Ir-194 | 19.15 h | β− | 100.0 | | |
| Ir | Ir-193 | 0.627 | 1310. | 128.0 | Ir-194* | 171.0 d | β− | 100.0 | | |
| Pt | Pt-19 | 0.0001 | 86.70 | 175.0 | Pt-191 | 2.900 d | β+ | 100.0 | | |
| Pt | Pt-192 | 0.0079 | 162.0 | 12.90 | Pt-193* | 4.330 d | γ | 100.0 | | |
| Pt | Pt-194 | 0.329 | 8.15 | 1.65 | Pt-195* | 4.020 d | γ | 100.0 | | |
| Pt | Pt-196 | 0.253 | 5.95 | 0.813 | Pt-197 | 18.30 h | β− | 100.0 | | |
| Pt | Pt-196 | 0.253 | 5.95 | 0.813 | Pt-197* | 1.590 h | β− | 3.3 | | |
| Pt | Pt-196 | 0.253 | 5.95 | 0.813 | Pt-197* | 1.590 h | γ | 96.7 | Pt-197 | 18.30 h |
| Pt | Pt-198 | 0.072 | 52.70 | 4.34 | Pt-199 | 30.80 m | β− | 100.0 | Au-199 | 3.139 d |
| Au | Au-197 | 1.00 | 1550. | 113.0 | Au-198 | 2.693 d | β− | 100.0 | | |
| Au | Au-197 | 1.00 | 1550. | 113.0 | Au-198* | 2.300 d | γ | 100.0 | Au-198 | 2.693 d |
| Hg | Hg-196 | 0.0014 | 230. | 3520. | Hg-197 | 2.672 d | β+ | 100.0 | | |
| Hg | Hg-196 | 0.0014 | 230. | 3520. | Hg-197* | 23.80 h | γ | 93.0 | Hg-197 | 2.672 d |
| Hg | Hg-196 | 0.0014 | 230. | 3520. | Hg-197* | 23.80 h | β+ | 7.0 | | |
| Hg | Hg-198 | 0.1002 | 74.80 | 2.28 | Hg-199* | 42.60 m | γ | 100.0 | | |
| Hg | Hg-202 | 0.298 | 2.65 | 5.68 | Hg-203 | 46.61 d | β− | 100.0 | | |
| Hg | Hg-204 | 0.0685 | 0.256 | 0.492 | Hg-205 | 5.200 m | β− | 100.0 | | |
| Tl | Tl-205 | 0.7048 | 0.648 | 0.119 | Tl-206 | 4.199 m | β− | 100.0 | | |
| Tl | Tl-205 | 0.7048 | 0.648 | 0.119 | Tl-206* | 3.740 m | γ | 100.0 | Tl-206 | 4.199 m |
| Pb | Pb-208 | 0.524 | 0.61 | 0.06 | Pb-209 | 3.253 h | β− | 100.0 | | |
| Bi | Bi-209 | 1.00 | 0.202 | 0.0389 | Bi-210 | 5.013 d | α | 0.0 | Tl-206 | 4.199 m |
| Bi | Bi-209 | 1.00 | 0.202 | 0.0389 | Bi-210 | 5.013 d | β− | 100.0 | Po-210 | 138.4 d |
| Th | Th-232 | 1.00 | 83.50 | 8.49 | Th-233 | 22.30 m | β− | 100.0 | Pa-233 | 26.97 d |

The invention claimed is:

1. A method of transmuting at least one long-lived isotope of fission fragment radioactive waste, the method comprising the steps of:

providing an inner buffer region around a neutron source for providing a first reduction in neutron energy by inelastic scattering;

providing an activation region around said inner buffer region, the activation region being made of heavy elements of at least one of lead and/or bismuth;

distributing a material containing said long-lived isotope of fission fragment radioactive waste throughout the whole volume of the activation region the inner buffer region and the neutron source being devoid of radioactive waste; and activating the neutron source to emit a neutron flux, wherein multiple elastic collisions between the neutrons in the neutron flux and the heavy elements in the activation region result in an enhanced neutron flux in the activation region, and rate of progressive decrease in neutron energy such that increased neutron capture in the resonance spectrum of said material is exploited to enhance neutron capture in said material.

2. A method according to claim 1, wherein said transmuted isotope comprises $^{99}$Tc.

3. A method according to claim 1, wherein said transmuted isotope comprises $^{129}$I.

4. A method according to claim 1, wherein said transmuted isotope comprises $^{79}$Se.

5. A method according to claim 1, wherein the neutron source is a critical fast breeder reactor core, out of which fast neutrons leak.

6. A method according to claim 1, wherein the neutron source is an energy amplifier core comprising a spallation target and a nuclear fuel material, wherein the spallation target is bombarded by a high-energy charged particle beam to produce high-energy neutrons which initiate a sub-critical process of breeding a fissile element from a fertile element of the fuel material and fission of the fissile element, whereby fast neutrons leak out of the energy amplifier core toward the activation region.

7. A method according to claim 6, wherein lead and/or bismuth form both said spallation target and said inner buffer region, at least some of said lead and/or bismuth being in liquid phase and circulated along a cooling circuit to extract heat from the energy amplifier core.

8. A method according to claim 6, wherein the nuclear fuel material comprises further fissile elements consisting of actinides to be disposed of.

* * * * *